United States Patent [19]

Kobayashi et al.

[11] Patent Number: 4,948,713

[45] Date of Patent: Aug. 14, 1990

[54] PROCESSING SOLUTION FOR A LIGHT-SENSITIVE SILVER HALIDE COLOR PHOTOGRAPHIC MATERIAL

[75] Inventors: Kazuhiro Kobayashi; Shigeharu Koboshi; Satoru Kuse; Masao Ishikawa, all of Hino, Japan

[73] Assignee: Konishiroku Photo Industry Co., Ltd., Tokyo, Japan

[21] Appl. No.: 329,281

[22] Filed: Mar. 27, 1989

Related U.S. Application Data

[62] Division of Ser. No. 77,336, Jul. 24, 1987, Pat. No. 4,837,139.

[30] Foreign Application Priority Data

Jul. 26, 1986 [JP] Japan ..... 61-176303
Aug. 9, 1986 [JP] Japan ..... 61-187137
Aug. 9, 1986 [JP] Japan ..... 61-187139

[51] Int. Cl.[5] ..... G03C 7/32; G03C 5/24

[52] U.S. Cl. ..... 430/434; 430/464; 430/467; 430/482; 430/484; 430/485; 430/486; 430/487; 430/490; 430/491

[58] Field of Search ..... 430/434, 464, 467, 482, 430/484, 485, 486, 487, 490, 491

[56] References Cited

U.S. PATENT DOCUMENTS

| | | | |
|---|---|---|---|
| 2,875,049 | 2/1959 | Kridel | 430/490 |
| 3,655,764 | 4/1972 | Bader et al. | 564/301 |
| 3,746,544 | 5/1973 | Heilmann | 96/66.4 |
| 3,839,045 | 10/1974 | Brown | 96/66.4 |
| 4,155,763 | 5/1979 | Hasebe et al. | 430/469 |
| 4,170,478 | 10/1979 | Case et al. | 430/490 |
| 4,252,892 | 2/1981 | Case | 430/489 |
| 4,264,716 | 4/1981 | Vincent et al. | 430/490 |
| 4,500,635 | 2/1985 | Aoki et al. | 430/553 |
| 4,543,322 | 9/1985 | Ishikawa et al. | 430/490 |
| 4,557,999 | 12/1985 | Aoki et al. | 430/553 |
| 4,565,777 | 1/1986 | Ogawa et al. | 430/553 |
| 4,596,765 | 6/1986 | Kurematsu et al. | 430/467 |
| 4,600,688 | 7/1986 | Kawakatsu et al. | 430/558 |

FOREIGN PATENT DOCUMENTS

| | | |
|---|---|---|
| 649724 | 12/1964 | Belgium . |
| 0039752 | 11/1981 | European Pat. Off. . |
| 0117142 | 8/1984 | European Pat. Off. . |
| 0269740 | 6/1988 | European Pat. Off. . |
| 2740322 | 3/1978 | Fed. Rep. of Germany . |
| 3444091 | 7/1985 | Fed. Rep. of Germany . |
| 1185725 | 4/1959 | France . |
| 2394113 | 1/1979 | France . |
| 2135788 | 9/1984 | United Kingdom . |
| 2139370 | 11/1984 | United Kingdom . |

OTHER PUBLICATIONS

Patent Abstracts of Japan, vol. 8, No. 233 (P-309)[1670], Oct. 26, 1984.

*Primary Examiner*—Paul R. Michl
*Assistant Examiner*—Patrick A. Doody
*Attorney, Agent, or Firm*—Finnegan, Henderson, Farabow, Garrett, and Dunner

[57] ABSTRACT

There are disclosed a processing solution of a light-sensitive silver halide color photographic material, which comprises containing a compound represented by the formula (I) shown below, and a processing method of the same, which comprises subjecting a light-sensitive silver halide color photographic material having at least one layer of silver halide emulsion layer on a support to imagewise exposure and then applying processing including at least a color developing processing, characterized in that the color developing solution to be used in the color developing processing contains a compound represented by the formula (I) shown below:

(I)

wherein $R_1$ represents an alkyl group having 1 to 5 carbon atoms substituted with an alkoxy group, and $R_2$ represents a hydrogen atom, an alkyl group having 1 to 5 carbon atoms or an alkyl group having 1 to 5 carbon atoms substituted with an alkoxy group, and $R_1$ and $R_2$ may be bonded with each other to form a ring containing an oxygen atom.

11 Claims, No Drawings

PROCESSING SOLUTION FOR A LIGHT-SENSITIVE SILVER HALIDE COLOR PHOTOGRAPHIC MATERIAL

This is a division of application Ser. No. 07/077,336, filed Jul. 24, 1987 now U.S. Pat. No. 4,837,139.

BACKGROUND OF THE INVENTION

This invention relates to a processing solution of a light-sensitive silver halide color photographic material and a processing method of the same, more particularly to a processing solution of a light-sensitive silver halide color photographic material which is improved in processing stability and color staining, and also little in fluctuation in maximum density of cyan dye or magenta dye and a processing method of the same.

Processing of a light-sensitive silver halide color photographic material basically comprises the two steps of color developing and desilverization, and desilverization comprises the bleaching and fixing steps or bleach-fixing step. Other than these steps, rinsing processing, stabilizing processing, etc. may be added as the additional processing steps.

In color developing, exposed silver halide is reduced to silver simultaneously with the reaction of the oxidized aromatic primary amine type developing agent with a coupler to form a dye. During this process, halogen ions formed by reduction of silver halide are dissolved and accumulated into the developing solution. Also, separately, components such as inhibitors, etc. contained in the light-sensitive silver halide photographic material are also dissolved out to be accumulated into the color developing solution. In the desilverization step, the silver formed by developing is bleached with an oxidizing agent, and subsequently all the silver salts are removed with the fixing agent as soluble silver salts from within the photographic light-sensitive material. Also, one bath bleach-fixing processing method is known, in which the bleaching step and the fixing step are comprehensively processed at the same time.

In the color developing solution, color developing inhibitors are accumulated by developing processing of the light-sensitive silver halide color photographic material as mentioned above, while the color developing agent or benzyl alcohol, etc. are consumed or brought out as accumulated in the photographic light-sensitive material, whereby the concentrations of such components will be lowered. Accordingly, in the developing processing method in which a large amount of light-sensitive silver halide color photographic materials are continuously processed by means of an automatic developing machine, etc., a means for maintaining the components in the color developing solution within the range of constant concentrations, in order to avoid change in finished characteristics of developing dye to change in component concentrations. As such means, there is ordinarily used the method in which a supplemental solution for supplementing components in shortage and diluting the unnecessary increased components is supplemented. Due to supplement of the supplementing solution, a large amount of overflow will necessary occur and discharged, and therefore, this method poses a great problem in economy and pollution. Therefore, in recent years, for the purpose of reducing the above overflowed solution, there have been proposed the regeneration method of developing solution according to the ion exchange resin method or the electrodualysis method, the concentrated low supplement method, and further the method in which the overflowed solution is added with a regenerating agent to be used again as the supplementing solution. Among them, the concentrated low supplement method may be said to be the method which is extremely suitable for a small scale laboratory such as mini-laboratory, because no special new device is required and processing management is easy.

On the other hand, in a conventional color developing solution, for the purpose of preventing oxidation of an aromatic primary amine color developing agent as represented by p-phenylenediamine type developing agent, a sulfite, or sulfite and a water-soluble salt of hydroxylamine are added as the preservative.

Since storability is not necessarily sufficient if these sulfites are added singly into the developing solution, it has been already known that more effective preservability can be obtained by adding hydroxylamine as a water-soluble salt.

However, it has been known that a hydroxylamine salt is not only decomposed by receiving the catalytic action of co-existing minute amount of metal ions, particularly iron ions to be reduced in the preserving effect, but also ammonia is generated by decomposition, whereby fog or contamination is formed on the light-sensitive color photographic material, or abnormality in photographic characteristics, particularly hardening in tone at the shoulder portion may be caused to lower processing stability.

Such mixing of metal ions, particularly iron ions into a color developing solution occurs by the so-called back contamination in which a bleaching solution or bleach-fixing solution employing conventionally ferric salts of an organic salt as the bleaching agent is carried over into the color developing solution by splashing or by means of a conveying leader, or a hanger for hanging a belt or a film.

For preventing these undesirable actions of metal ions, the technique of incorporating various metal chelating agents has been proposed and practically applied. For example, there may be included the technique in which hydroxyalkylidenediphosphonic acid sequestering agent and lithium salt are used in combination as disclosed in U.S. Pat. No. 3,839,045, the technique in which a polyhydroxy compound and an aminopolycarboxylic acid sequestering agent are used in combination as disclosed in U.S. Pat. No. 3,746,544, and the technique in which a polyhydroxy compound and an aminopolyphosphonic acid sequestering agent are used in combination, etc. However, even by used of these techniques, the problems as mentioned above cannot be solved under the present state.

Such lowering in processing stability caused by hydroxylamine salt is more amplified in the low supplement processing. That is, in the low supplement processing, not only the metal ions accumulated are increased, but also renewal rate of the developing solution is lowered, whereby the residence time in the processing tank of the developing solution is remarkably increased. For this reason, the problems of generation of fog, hardening in tone at the shoulder portion by decomposition of the hydroxylamine become further marked. Also, under such situation, it has become clear that decomposition acceleration of hydroxylamine salt occurs by minute metals contained in reagents, which have little effect in the much supplement processing of the prior art, particularly copper ions. Against the copper ions, it has been found that use of a chelating agent of the prior art proved to be difficult in intoxication thereof.

Accordingly, the present inventors have investigated variously above preservatives free from the drawbacks of lowering in processing stability possessed by hydroxylamine salt, and also high in preserving ability, to accomplish the present invention.

Further, as the result of investigation of the use technique of the specific preservative to be used in the present invention, it has been found that the maximum density of cyan dye or magenta dye is susceptible to influence by the change in concentration of the specific preservative to be used in the present invention. That is, if the concentration of the specific preservative to be used in the present invention is elevated, the maximum density of cyan dye or magenta dye is liable to be lowered. The reason for having influence on the maximum density of cyan dye or magenta dye is not necessarily clear, and cannot be explained by simple coupling inhibition or inhibition of silver development, but it may be considered to be due to the balance between silver development and coupling which tends to be readily unbalanced.

SUMMARY OF THE INVENTION

Accordingly, a first object of the present invention is to provide a method for processing of a light-sensitive silver halide color photographic material, which is excellent in stability with lapse of time of the color developing solution such as preservability, etc., and also excellent in processing stability with little fluctuation in photographic performances such as increase in fog at the dye image and hardening in tone at the shoulder portion, etc.

A second object of the present invention is to provide a method for processing, which is not only little in change of photographic performances such as stability with lapse of time of the color developing solution such as preservability, etc., increase in fog at the dye image, hardening in tone at the shoulder portion, etc., but also little in fluctuation in maximum density of cyan dye or magenta dye.

The above objects of the present invention have been accomplished by the processing solution of a light-sensitive silver halide color photographic material, which comprises containing a compound represented by the formula (I) shown below, and a processing method of the same, which comprises subjecting a light-sensitive silver halide color photographic material having at least one layer of silver halide emulsion layer on a support to imagewise exposure and then applying processing including at least a color developing processing, characterized in that the color developing solution to be used in said color developing processing contains a compound represented by the formula (I) shown below:

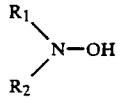

(I)

wherein $R_1$ represents an alkyl group having 1 to 5 carbon atoms substituted with an alkoxy group, and $R_2$ represents a hydrogen atom, an alkyl group having 1 to 5 carbon atoms or an alkyl group having 1 to 5 carbon atoms substituted with an alkoxy group, and $R_1$ and $R_2$ may be bonded with each other to form a ring containing an oxygen atom.

Further, according to a preferred embodiment of the present invention, (1) in at least one layer of said silver halide emulsion layers, at least one cyan coupler selected from the cyan couplers represented respectively by the following formulae (C-1), (C-2) and (C) is contained.

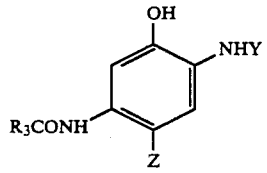

(C-1)

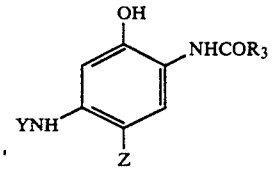

(C-2)

wherein Y represents $-COR_4$,

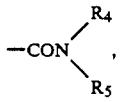

$-SO_2R_4$,

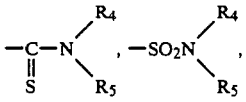

$-CONHCOR_4$ or $-CONHSO_2R_4$ (where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); R3 represents a ballast group; and Z represents a hydrogen atom or a group eliminatable through the coupling reaction with an oxidized product of an aromatic primary amine type color developing agent.

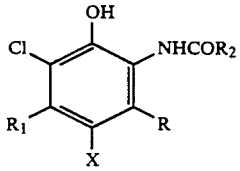

(C)

wherein one of R and $R_1$ represents a hydrogen atom and the other is a straight or branched alkyl group having at least 2 to 12 carbon atoms; X represents a hydrogen atom or a group eliminatable through the coupling reaction with an oxidized product of an aromatic primary amine type color developing agent; and $R_2$ represents a ballast group.

Further, (2) in at least one layer of said silver halide emulsion layers, at least one magenta coupler represented by the following formula (M) is contained.

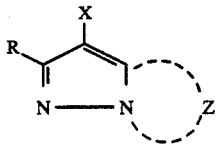

(M)

wherein Z represents a group of non-metallic atoms necessary for forming a nitrogen-containing heterocyclic ring and the ring formed by said Z may have a substituent; X represents a hydrogen atom or a substituent eliminatable through the reaction with an oxidized product of a color developing agent; and R represents a hydrogen atom or a substituent.

Also, (3) in the color developing solution to be used in said color developing processing, at least one compound selected from the compounds represented by the following formulae (II) and (III) is contained.

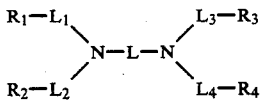

(II)

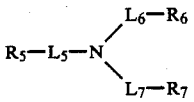

(III)

in the formulae (II) and (III), L represents an alkylene group, a cycloalkylene group, a phenylene group, $-L_8-O-L_8-O-L_8-$ or $-L_9-Z-L_9-$(where Z represents $>N-L_{10}-R_8$,

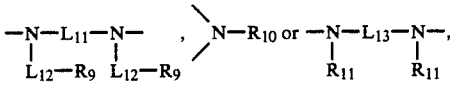

$L_1$ to $L_{13}$ each represent an alkylene group, $R_1$ to $R_{11}$ each represent a hydrogen atom, a hydroxyl group, a carboxylic acid group including its salt, or a phosphonic acid group including its salt, provided that at least two of $R_1$ to $R_4$ are the carboxylic acid group including its salt or the phosphonic acid group including its salt, and at least two of $R_5$ to $R_7$ are the carboxylic acid group including its salt or the phosphonic acid group including its salt).

DESCRIPTION OF THE PREFERRED EMBODIMENTS

In the color developing solution to be used in the processing method of the present invention, the compound represented by the formula (I) (hereinafter called the compound of the present invention) is used as the preservative.

In the formula (I), $R_1$ represent an alkyl group having 1 to 5 carbon atoms substituted with an alkoxy group, and examples of the above alkoxy group may include a methoxy group, an ethoxy group, a propoxy group and the like, and examples of the alkyl group to be substituted with said alkoxy group may include a methyl group, an ethyl group, an n-propyl group, an i-propyl group, a butyl group, a pentyl group and the like, and the position where alkoxy group is substituted on the alkyl group except for the methyl group may be at any desired position. Also, at least one alkoxy group may be substituted.

In the formula (I), $R_2$ represents a hydrogen atom, an alkyl group having 1 to 5 carbon atoms or an alkyl group having 1 to 5 carbon atoms substituted with an alkoxy group. Examples of the alkyl group having 1 to 5 carbon atoms substituted with an alkoxy group represented by $R_2$ may be the same as the group represented by $R_1$, and examples of the alkyl group having 1 to 5 carbon atoms may include those having the alkoxy group in the group represented by the above $R_1$. Further, $R_1$ and $R_2$ may be bonded with each other to form a ring having an oxygen atom.

In the following, specific examples of the compound of the present invention are enumerated, but the present invention is not limited thereto.

Exemplary compounds

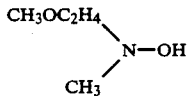

(1)

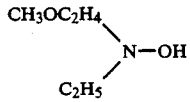

(2)

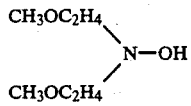

(3)

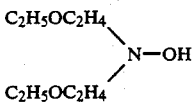

(4)

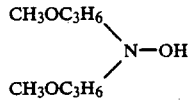

(5)

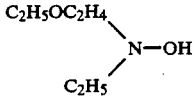

(6)

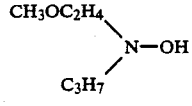

(7)

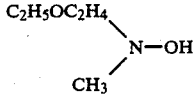

(8)

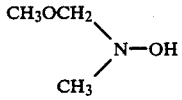

(9)

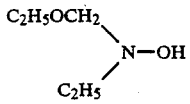

(10)

-continued

Exemplary compounds

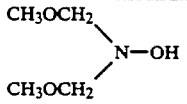
(11)

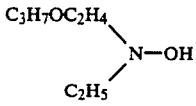
(12)

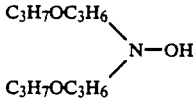
(13)

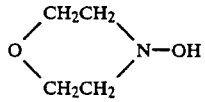
(14)

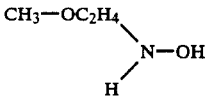
(15)

These compounds of the present invention are generally used in the forms of free amine, hydrochloride, sulfate, p-toluenesulfonate, oxalate, phosphate, acetate, etc.

The compound of the present invention may be used either singly or as a combination of two or more kinds, and its amount added may be any which can effectively accomplish the object of the present invention, but preferably 0.001 mole to 60 mole per one liter of the color developing solution, more preferably in the range of 0.005 mole to 40 mole.

A part of the compounds of the present invention have been known as monochromatic developing agents. For example, in Japanese Provisional Patent Publication No. 43742/1986, use of a dicarboxylic acid salt as the developing agent in the processing composition for diffusion transfer is described.

However, it has not been entirely known at all that use of the compound of the present invention in the color developing solution not only acts as a good preservative, but also occurs substantially no decomposition reaction with metal ions as the catalyst as in the case of hydroxylamine sulfate broadly used in the prior art as the preservative.

Further, as compared with N,N-dialkylhydroxylamines having similar structures such as N,N-diethylhydroxylamine, N,N-dimethylhydroxylamine, the compound of the present invention has the advantage of being free from objectionable amine odor inherent in N,N-dialkylhydroxylamines, thus having great superiority in practical techniques. Further, as compared with N,N-dialkylhydroxylamines having the drawbacks of coloration of the color developing solution to yellow, and contamination onto light-sensitive material, etc., the compound of the present invention has also no problem in this respect.

In the processing method of the light-sensitive silver halide color photographic material of the present invention, the specific feature resides in the point of incorporating the above compound of the present invention in the color developing solution. However, since the maximum density of cyan dye tends to be lowered when the concentration of the compound of the present invention is elevated, it is preferable to contain at least one cyan coupler selected from the cyan couplers represented respectively by the formulae (C-1), (C-2) and (C) shown below in at least one layer of the silver halide emulsion layers in the light-sensitive silver halide color photographic material to be applied for the present invention.

The cyan coupler represented by the formula (C-1), (C-2) or (C) preferably used in the present invention is to be explained.

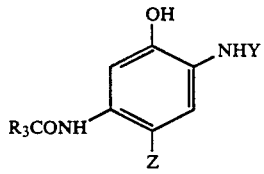
(C-1)

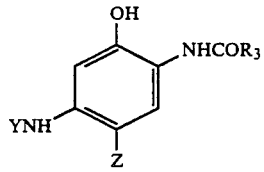
(C-2)

wherein Y represents —$COR_4$,

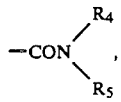

—$SO_2R_4$,

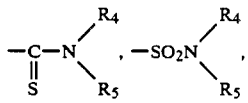

—$CONHCOR_4$ or —$CONHSO_2R_4$ (where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); R3 represents a ballast group; and Z represents a hydrogen atom or a group eliminatable through the coupling reaction with the oxidized product of an aromatic primary amine type color developing agent.

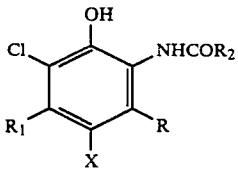
(C)

wherein one of R and $R_1$ represents a hydrogen atom and the other is a straight or branched alkyl group having at least 2 to 12 carbon atoms; X represents a hydrogen atom or a group eliminatable through the coupling reaction with an oxidized product of an aromatic primary amine type color developing agent; and $R_2$ represents a ballast group.

In the above formulae (C-1) and (C-2), Y is a group represented by —$COR_4$,

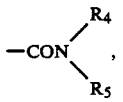

—$SO_2R_4$,

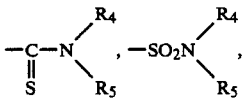

—$CONHCOR_4$ or —$CONHSO_2R_4$. Here, $R_4$ represents an alkyl group, preferably an alkyl group having 1 to 20 carbon atoms (e.g., methyl, ethyl, t-butyl, dodecyl, etc.), an alkenyl group, preferably an alkenyl group having 2 to 20 carbon atoms (e.g., an allyl group, a heptadecenyl group, etc.), a cycloalkyl group, preferably 5- to 7-membered group (for example, cyclohexyl, etc.), an aryl group (for example, a phenyl group, a tolyl group, a naphthyl group, etc.), a heterocyclic group, preferably 5-membered or 6-membered heterocyclic group containing 1 to 4 nitrogen atom, oxygen atom or sulfur atom (for example, a furyl group, a thienyl group, a benzothiazolyl group, etc.). $R_5$ represents a hydrogen atom or a group represented by $R_4$. $R_4$ and $R_5$ may be bonded with each other to form a 5-membered or 6-membered heterocyclic ring containing a nitrogen atom. In $R_2$ and $R_3$, optional substituents can be introduced therein, and there may be mentioned, for example, an alkyl group having 1 to 10 carbon atoms (for example, ethyl, i-propyl, i-butyl, t-butyl, t-octyl, etc.), an aryl group (for example, phenyl, naphthyl, etc.), a halogen atom (fluorine, chlorine, bromine, etc.), a cyano group, a nitro group, a sulfoneamido group (for example, methanesulfonamido, butansulfonamido, p-toluenesulfonamido, etc.), a sulfamoyl group (for example, methylsulfamoyl, phenylsulfamoyl, etc.), a sulfonyl group (for example, methanesulfonyl, p-toluenesulfonyl, etc.), a fluorosulfonyl group, a carbamoyl group (e.g., dimethylcarbamoyl, phenylcarbamoyl, etc.), and oxycarbonyl group (e.g., ethoxycarbonyl, phenoxycarbonyl, etc.), a heterocyclic group (e.g., a pyridyl group, a pyrazolyl group, etc.), an alkoxy group, an aryloxy group, an acyloxy group and the like.

In the formulae (C-1) and (C-2), $R_3$ represents a ballast group necessary for providing a diffusion resistance to the cyan coupler represented by the formulae (C-1) and (C-2) and a cyan dye derived from said cyan coupler. Preferably, $R_3$ may be an alkyl group having 4 to 30 carbon atoms, an aryl group or a heterocyclic group. For example, $R_3$ may include a straight or branched alkyl group (e.g. t-butyl, n-octyl, t-octyl, n-dodecyl, etc.), an alkenyl group, a cycloalkyl group, a 5-membered or 6-membered heterocyclic group and the like.

In the formulae (C-1) and (C-2), Z represents a hydrogen atom or a group eliminatable through the coupling reaction with an aromatic primary amine color developing agent. For example, Z may include a halogen atom (e.g. chlorine, bromine, fluorine, etc.), a substituted or unsubstituted alkoxy group, an aryloxy group, a heterocyclyloxy group, an acyloxy group, a carbamoyloxy group, a sulfonyloxy group, an alkylthio group, an arylthio group, a heterocyclicthio group or a sulfonamido group, and more specifically, those as disclosed in U.S. Pat. No. 3,741,563, Japanese Provisional Patent Publication No. 37425/1972, Japanese Patent Publication No. 36894/1973, Japanese Provisional Patent Publications No. 10135/1975, No. 108841/1976, No. 120334/1975, No. 18315/1977, No. 105226/1978, No. 14736/1979, No. 48237/1979, No. 32071/1980, No. 65957/1980, No. 1938/1981, No. 12643/1981, No. 27147/1981, No. 146050/1984, No. 166956/1984, No. 24547/1985, No. 35731/1985 and No. 37557/1985.

In the present invention, the cyan couplers represented by the following formulae (C-3), (C-4) or (C-5) are more preferred.

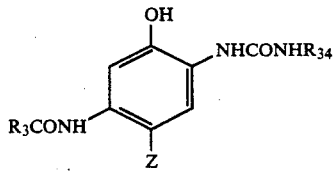

(C-3)

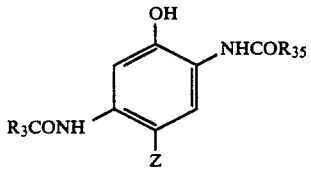

(C-4)

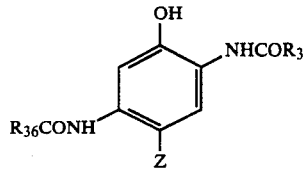

(C-5)

In the formula (C-3), $R_{34}$ is a substituted or unsubstituted aryl group (particularly preferred is a phenyl group). As the substituent for said aryl group represented by $R_{34}$, they may be mentioned at least one substituent selected from —$SO_2R_{37}$ a halogen atom (e.g., fluorine, bromine, chlorine, etc.), —$CF_3$, —$NO_2$, —CN, —$COR_{37}$, —$COOR_{37}$, —$SO_2OR_{37}$,

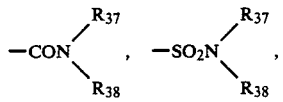

—$OR_{37}$, —$OCOR_{37}$,

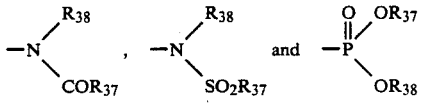

In the above, $R_{37}$ represents an alkyl group, preferably an alkyl group having 1 to 20 carbon atoms (e.g., methyl, ethyl, tert-butyl, dodecyl, etc.), an alkenyl group, preferably an alkenyl group having 2 to 20 carbon atoms (e.g., an aryl group, a heptadecenyl group, etc.), a cycloalkyl group, preferably 5 to 7-membered ring group (e.g., a cyclohexyl group, etc.), an aryl group (e.g., a phenyl group, a tolyl group, a naphthyl group, etc.); and $R_{38}$ is a hydrogen atom or a group represented by the above $R_{37}$.

The preferred compounds of the phenol type cyan coupler represented by (C-3) includes a compound in which $R_{37}$ is a substituted or unsubstituted phenyl group, and the substituent for the phenyl group includes a cyano group, a nitro group, $—SO_2R_{39}$ (in which $R_{39}$ is an alkyl group), a halogen atom or a trifluoromethyl group.

In the formulae (C-3) and (C-4), $R_{35}$ and $R_{36}$ each represent an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, oleyl, etc.), a cycloalkyl group, preferably a 5 to 7-membered cyclic group (e.g. cyclohexyl, etc.), an aryl group (e.g. a phenyl group, a tolyl group, a naphthyl group, etc.), a heterocyclic group (preferably a hetero ring of 5-membered or 6-membered ring having 1 to 4 hetero atoms of a nitrogen atom, an oxygen atom or a sulfur atom, such as a furyl group, a thienyl group, a benzothiazolyl group, etc.) and the like.

In the aforesaid $R_{37}$ and $R_{38}$, and $R_{35}$ and $R_{36}$ of the formulae (C-4) and (C-5), optional substituents may be introduced therein and such substituents may by those which may be introduced in $R_4$ and $R_5$ in the formulae (C-1) and (C-2) as mentioned above. As to the substituents, a halogen atom (a chlorine atom, a fluorine atom, etc.) is particularly preferred.

In the above formulae (C-3), (C-4) and (C-5), Z and $R_3$ each have the same meanings as in the formulae (C-1) and (C-2). Preferred examples of the ballast group represented by $R_3$ is a group represented by the following formula (C-6):

(C-6)

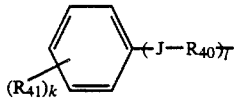

In the formula, J represents an oxygen atom, a sulfur atom or a sulfonyl group; k represents an integer of 0 to 4; l represents 0 or 1; provided that k is 2 or more, 2 or more of $R_{42}$ may be the same or different from each other; $R_{40}$ represents a straight or branched alkylene group having 1 to 20 carbon atoms which may be substituted by an aryl group, etc.; $R_{41}$ represents a monovalent group, preferably a hydrogen atom, a halogen atom (e.g., chlorine, bromine, etc.), an alkyl group, preferably a straight or branched alkyl group having 1 to 20 carbon atoms (e.g., methyl, t-butyl, t-pentyl, t-octyl, dodecyl, pentadecyl, benzyl, phenethyl, etc.), an aryl group (e.g., a phenyl group), a heterocyclic group (preferably a nitrogen containing heterocyclic group), an alkoxy group, preferably a straight or branched alkoxy group having 1 to 20 carbon atoms (e.g., methoxy, ethoxy, t-butyloxy, octyloxy, decyloxy, dodecyloxy, etc.), an aryloxy group (e.g., a phenoxy group), a hydroxy group, an acyloxy group, preferably an alkylcarbonyloxy group, an arylcarbonyloxy group (e.g., an acetoxy group, a benzoyloxy group), a carboxy group, an alkyloxycarbonyl group, preferably a straight or branched alkyloxycarbonyl group having 1 to 20 carbon atoms, an aryloxycarbonyl group, preferably a phenoxycarbonyl group, an alkylthio group preferably having 1 to 20 carbon atoms, an acyl group, a straight or branched alkylcarbonyl group which may preferably have 1 to 20 carbon atoms, an acylamino group, a straight or branched alkylcarboamido group which may preferably have 1 to 20 carbon atoms, a benzenecarboamido group, a sulfonamido group, preferably a straight or branched alkylsulfonamido group having 1 to 20 carbon atoms or a benzenesulfonamido group, a carbamoyl group, a straight or branched alkylaminocarbonyl group which may preferably have 1 to 20 carbon atoms or a phenylaminocarbonyl group, a sulfamoyl group, a straight or branched alkylaminosulfonyl group which may preferably have 1 to 20 carbon atoms or a phenylaminosulfonyl group, and the like.

Next, representative exemplary compounds of the cyan coupler represented by the formulae (C-1) or (C-2) are shown below, but the present invention is not limited by these compounds.

[Exemplary compounds]

C-1

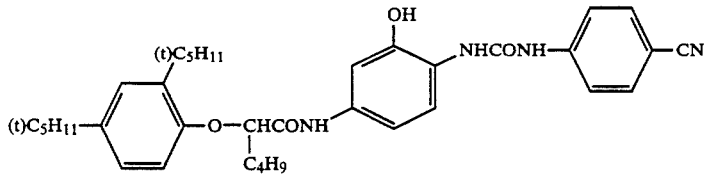

C-2

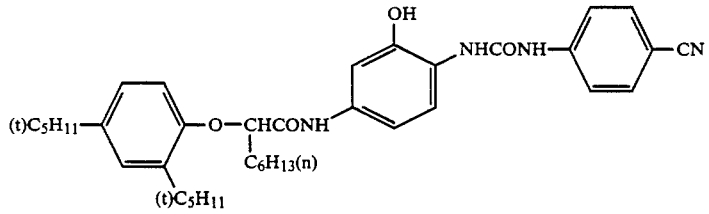

C-3

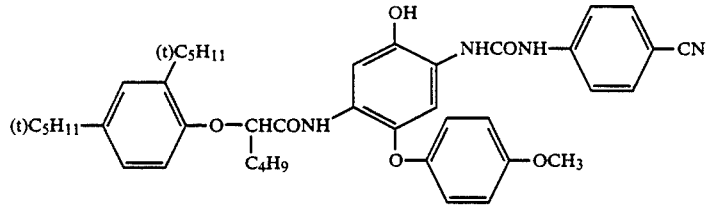

-continued
[Exemplary compounds]
C-4
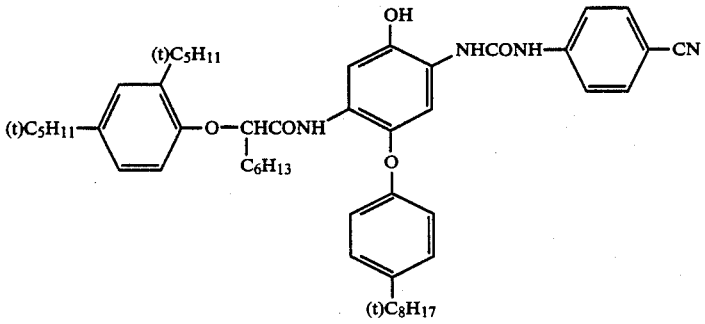
C-5
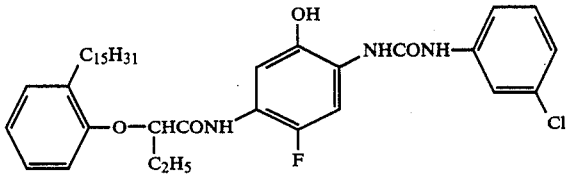
C-6
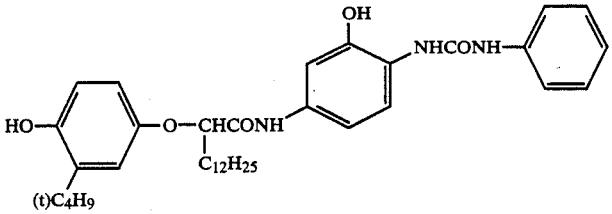
C-7
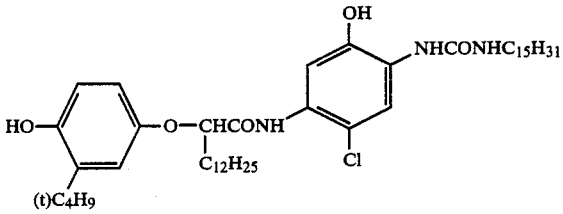
C-8
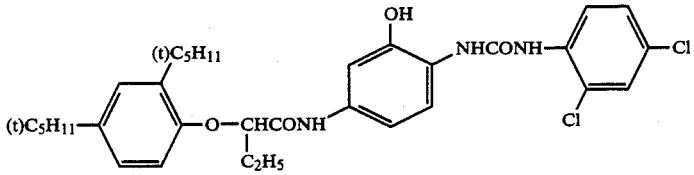
C-9
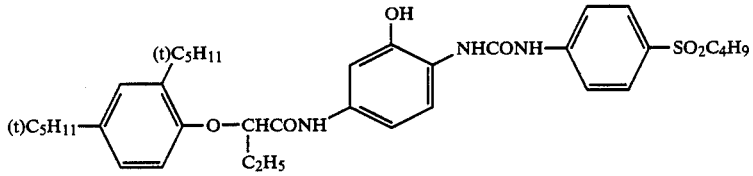
C-10
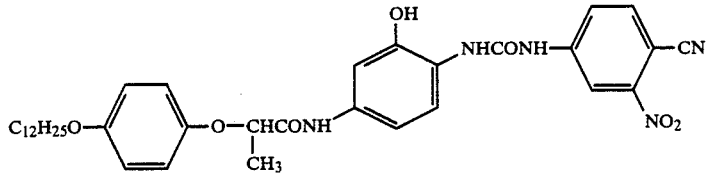

-continued
[Exemplary compounds]
C-11
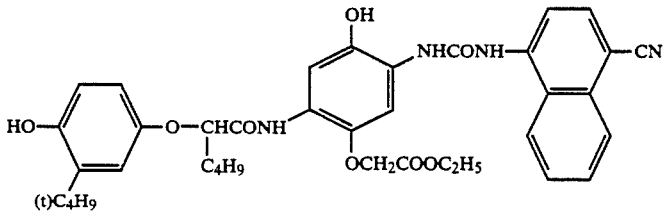
C-12
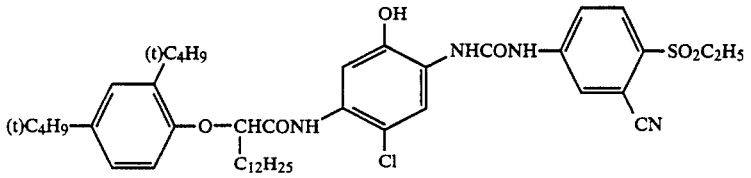
C-13
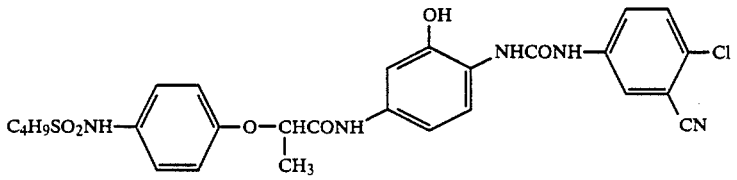
C-14
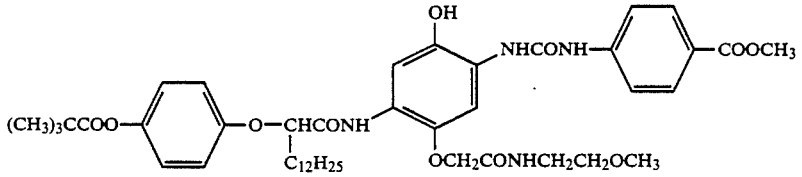
C-15
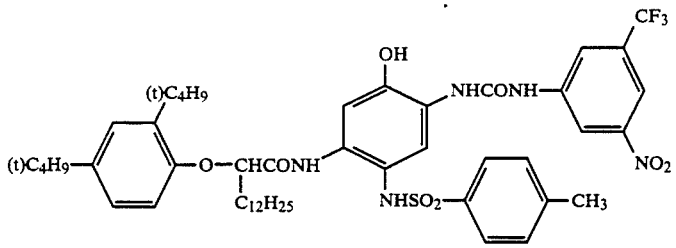
C-16
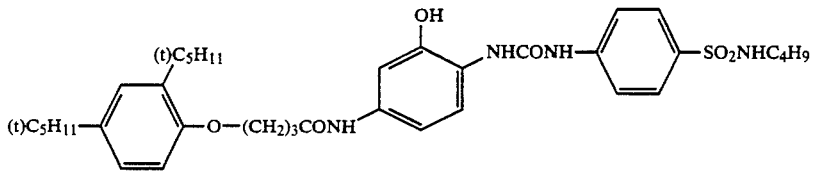
C-17
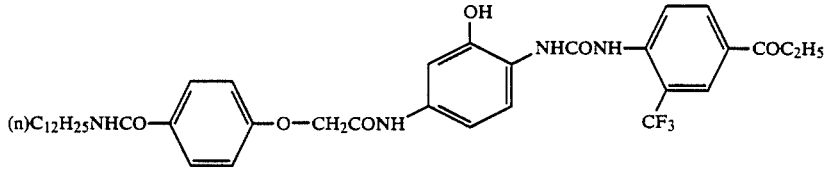

-continued
[Exemplary compounds]
C-18
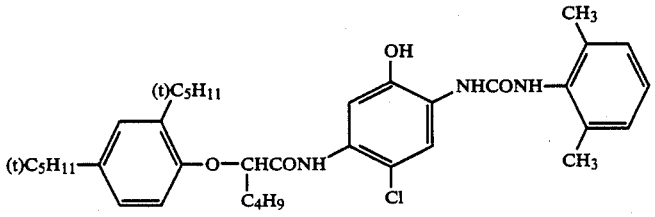
C-19
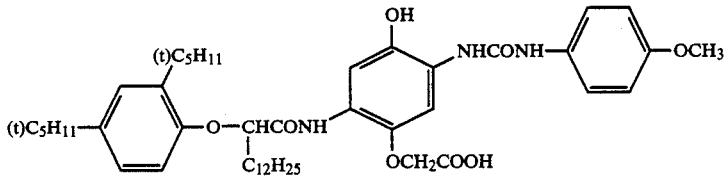
C-20
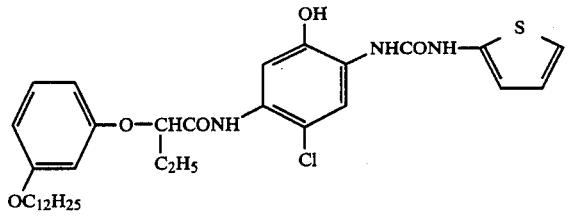
C-21
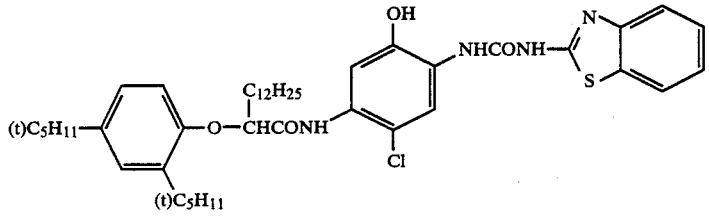
C-22
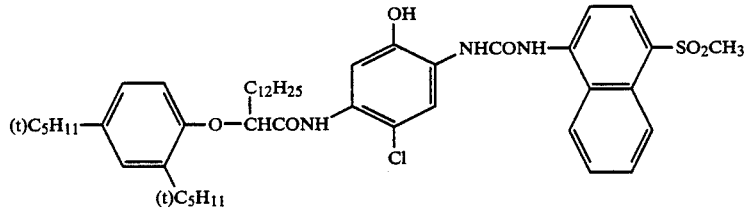
C-23
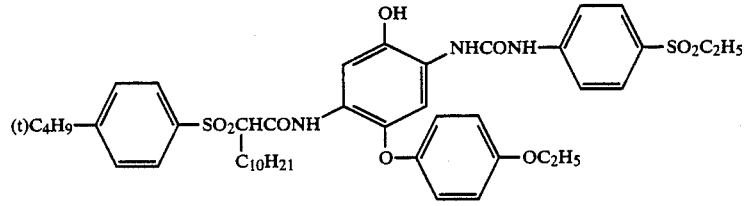
C-24
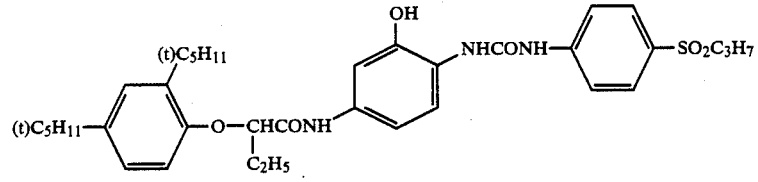

-continued
[Exemplary compounds]
C-25
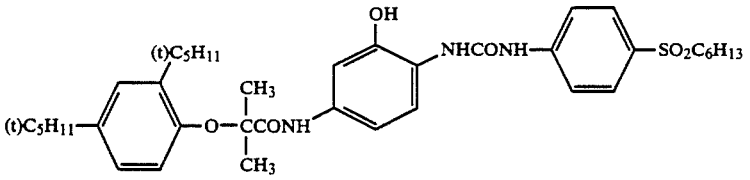
C-26
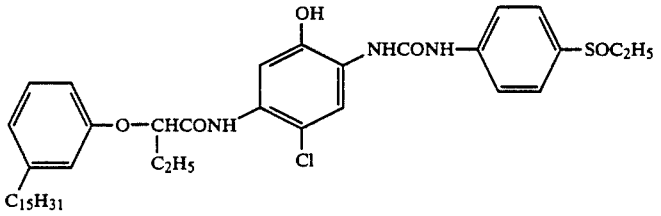
C-27
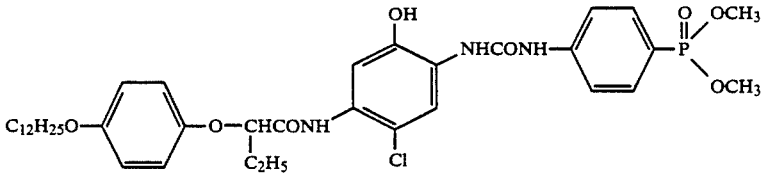
C-28
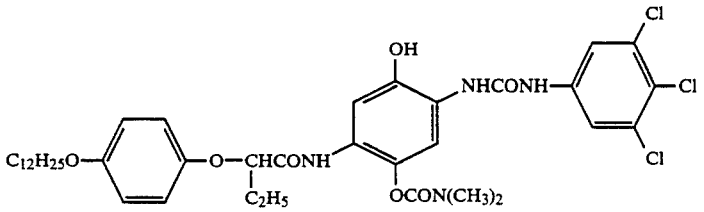
C-29
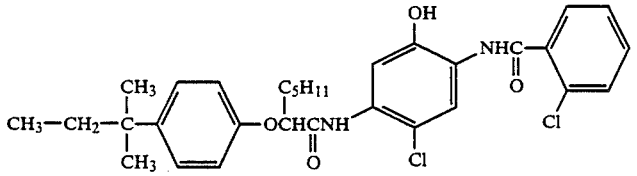
C-30
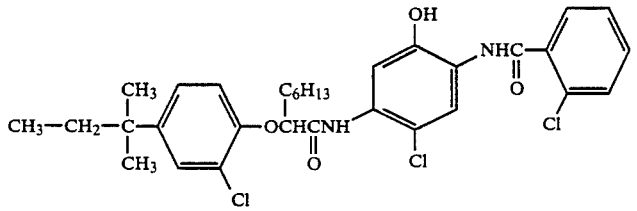
C-31
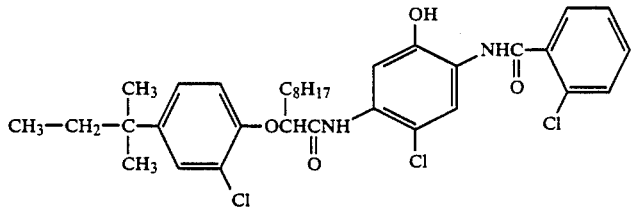

-continued
[Exemplary compounds]
C-32
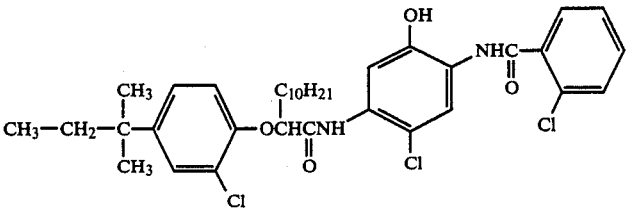
C-33
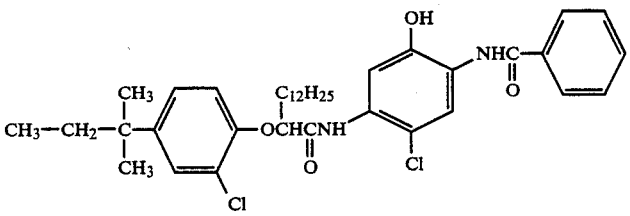
C-34
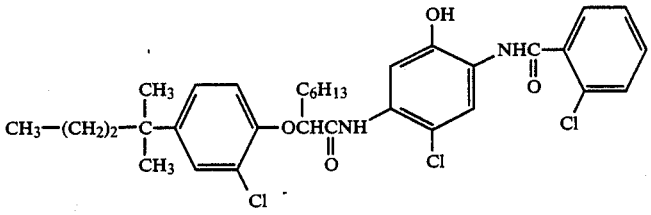
C-35
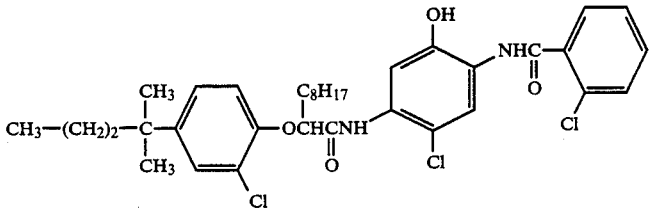
C-36
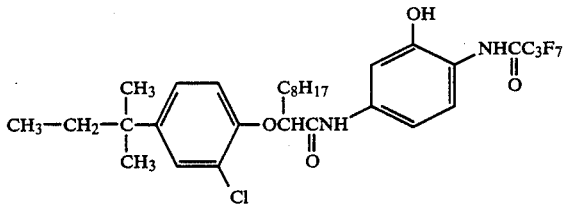
C-37
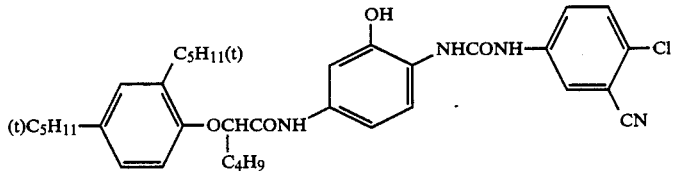
C-38
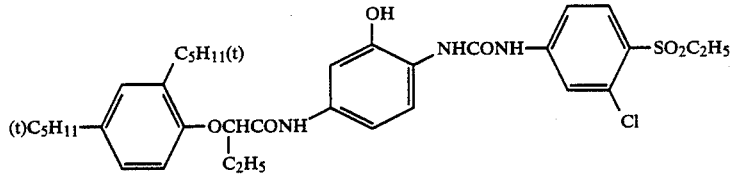

-continued
[Exemplary compounds]
C-39
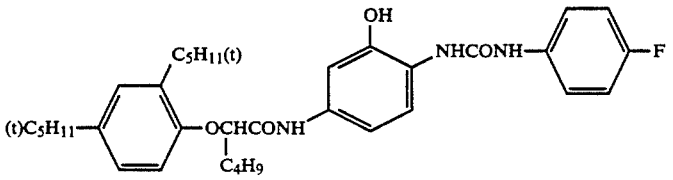
C-40
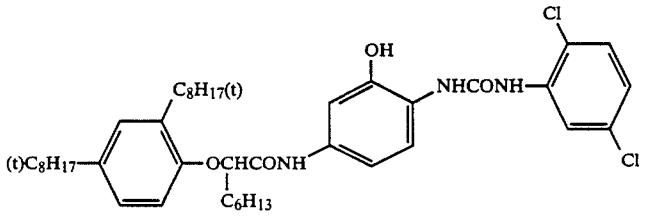
C-41
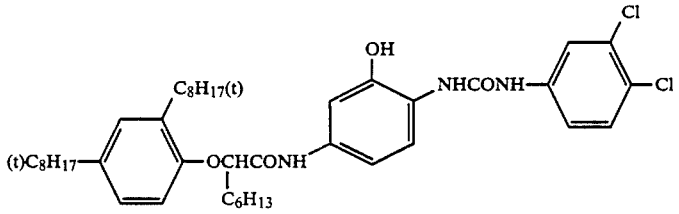
C-42
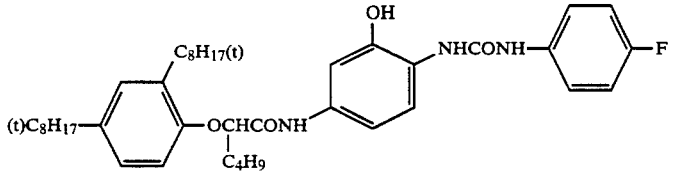
C-43
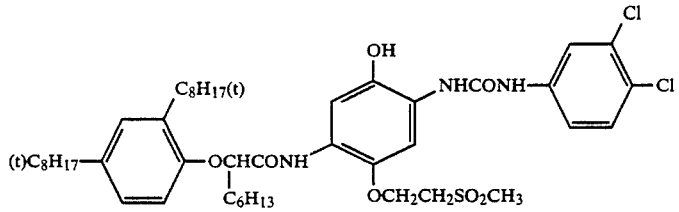
C-44
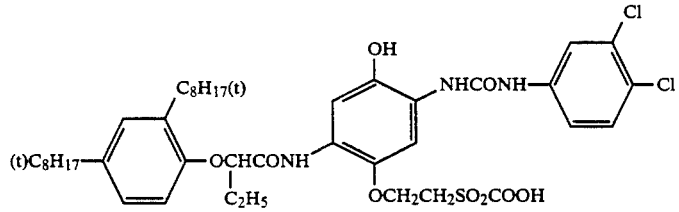
C-45
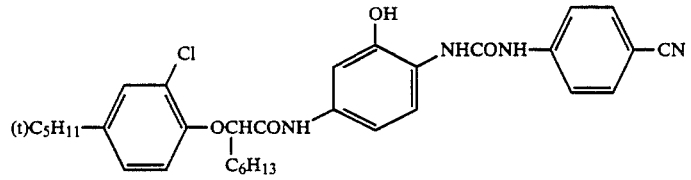

-continued
[Exemplary compounds]
C-46
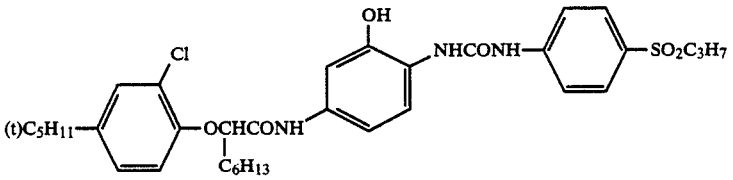
C-47
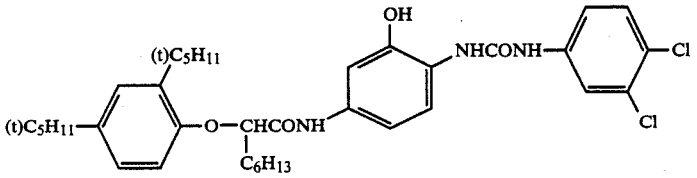
C-48
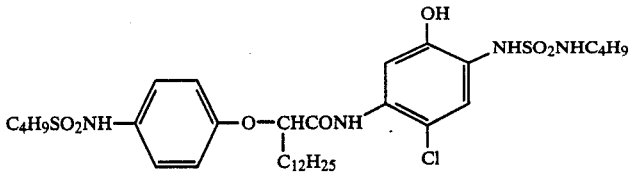
C-49
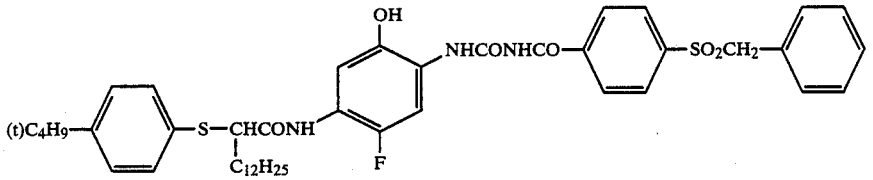
C-50
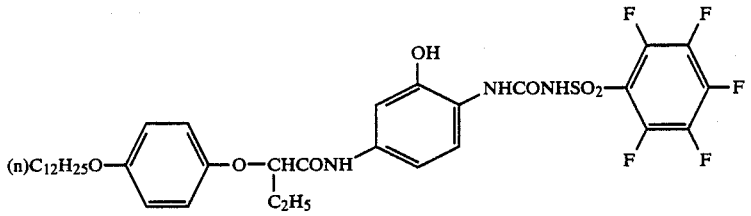
C-51
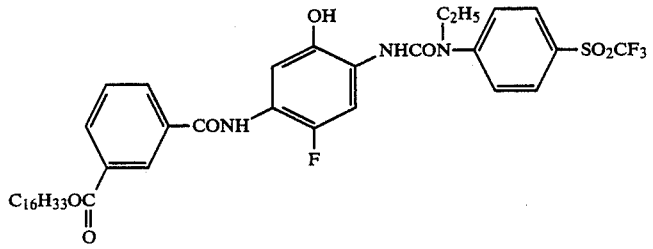
C-52
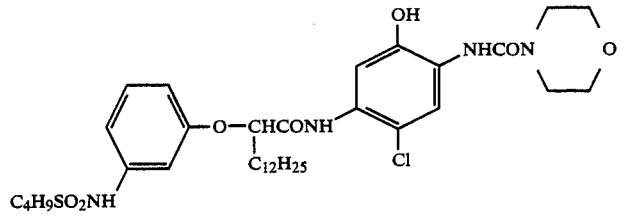

-continued
[Exemplary compounds]
C-53
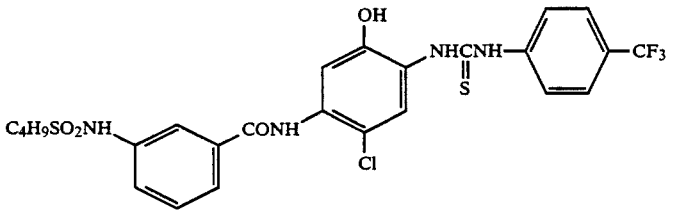
C-54
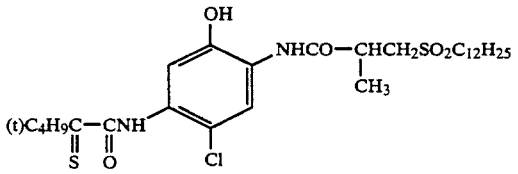
C-55
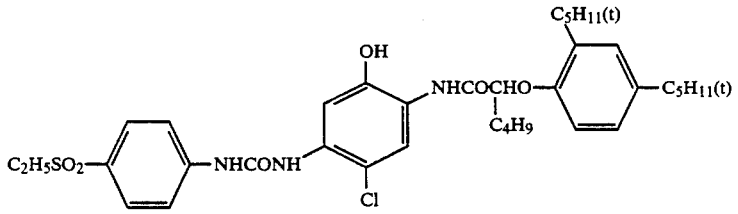
C-56
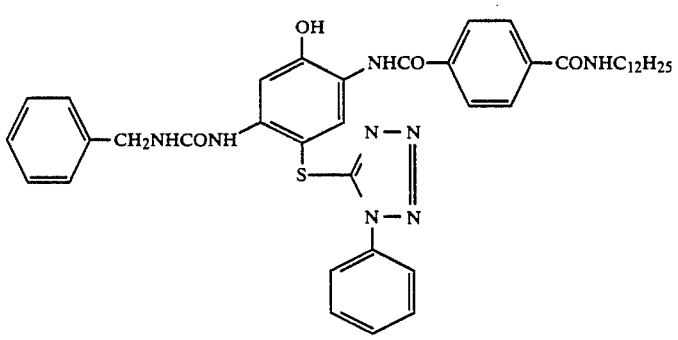
C-57
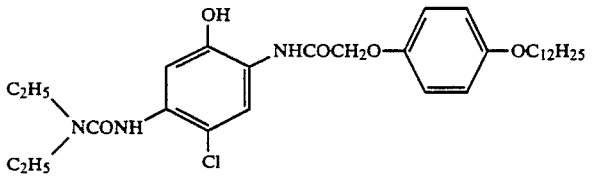
C-58
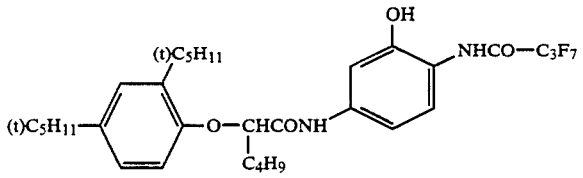
C-59
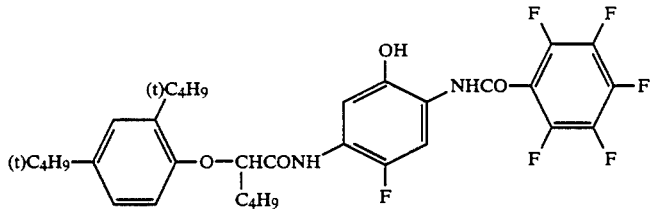

-continued
[Exemplary compounds]
C-60
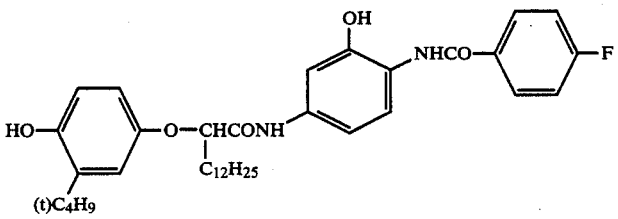
C-61
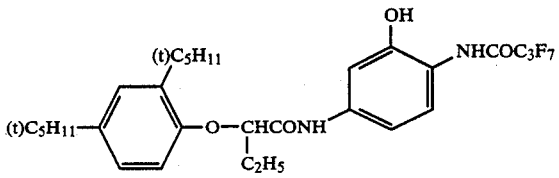
C-62
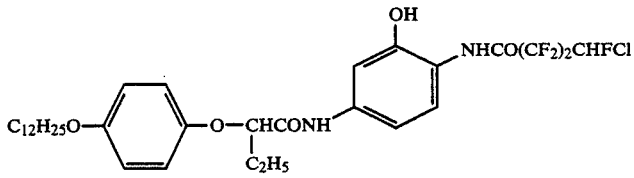
C-63
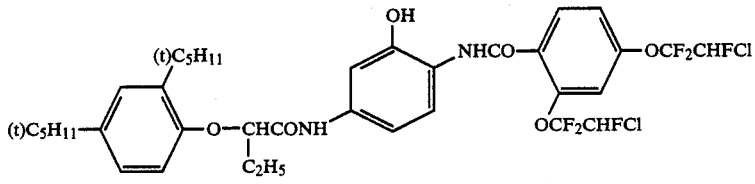
C-64
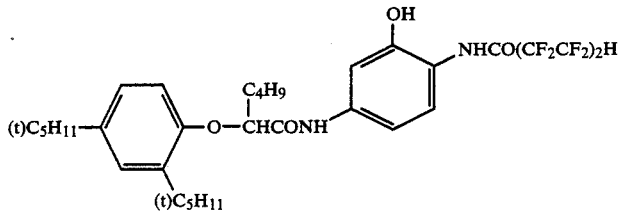
C-65
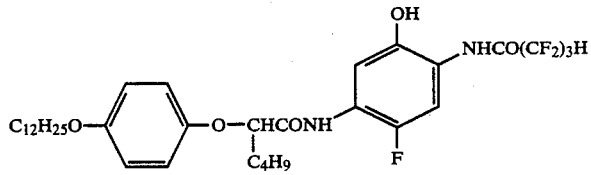
C-66
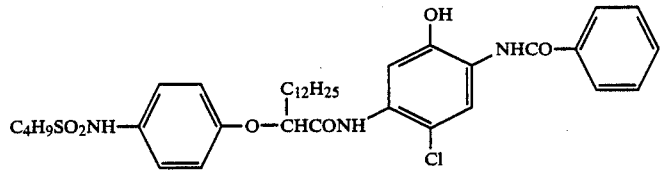
C-67
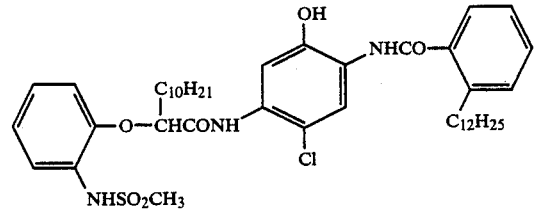

-continued
[Exemplary compounds]
C-68
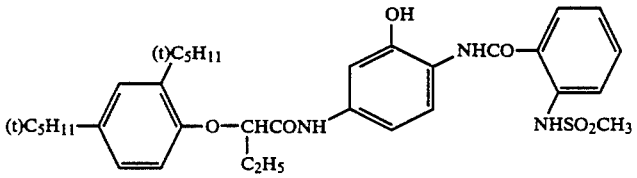
C-69
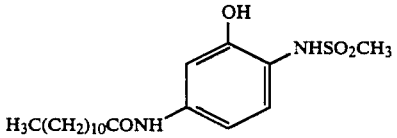
C-70
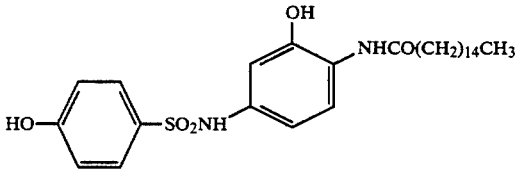
C-71
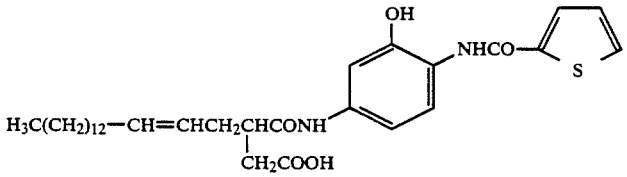
C-72
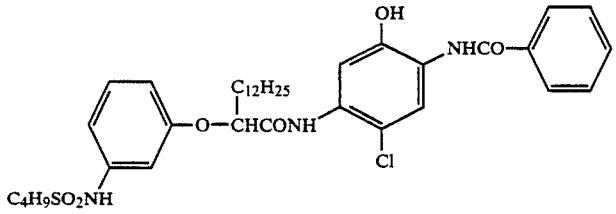
C-73
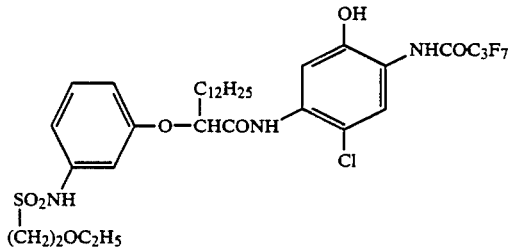
C-74
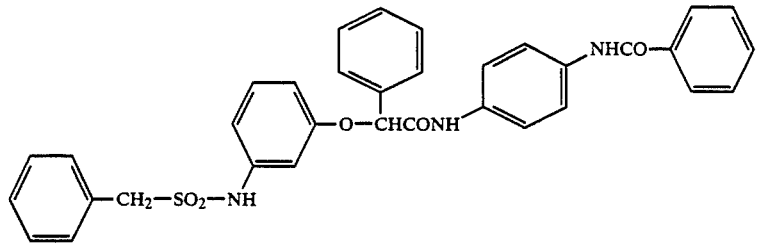

-continued
[Exemplary compounds]
C-75
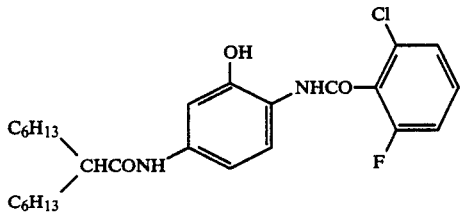
C-76
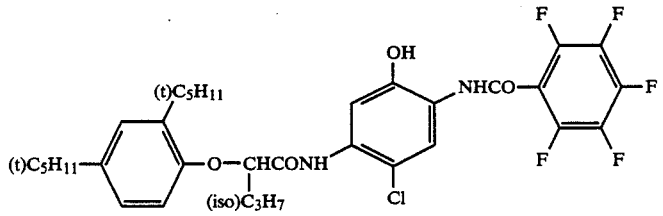
C-77
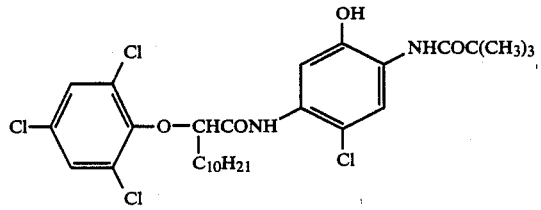
C-78
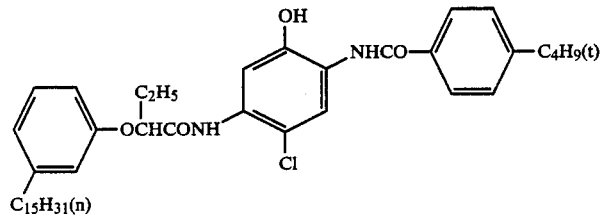
C-79
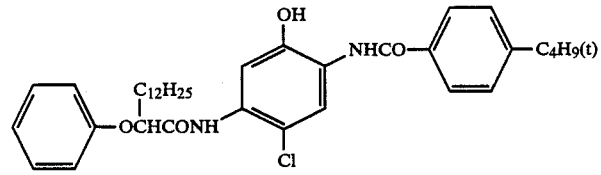
C-80
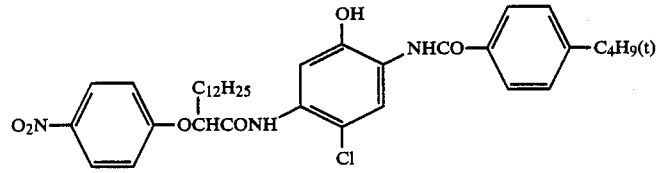
C-81
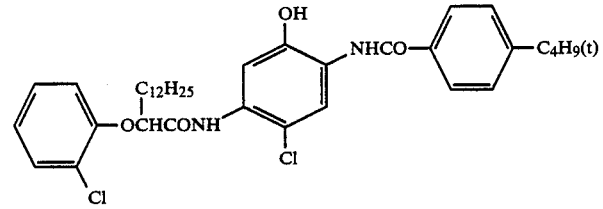

-continued
[Exemplary compounds]
C-82
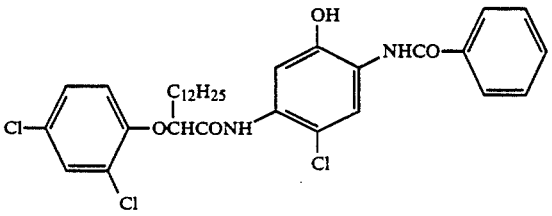
C-83
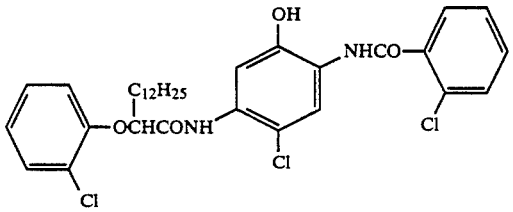
C-84
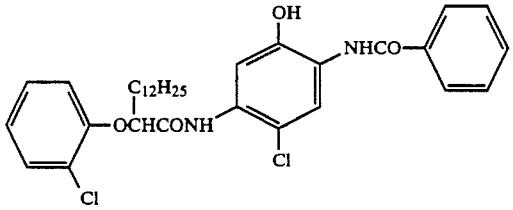
C-85
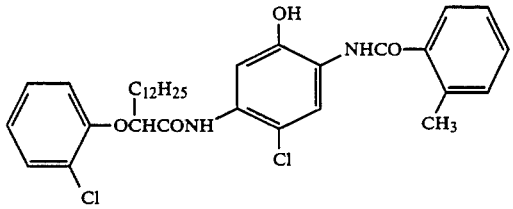
C-86
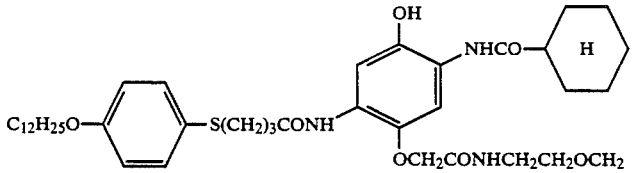
C-87
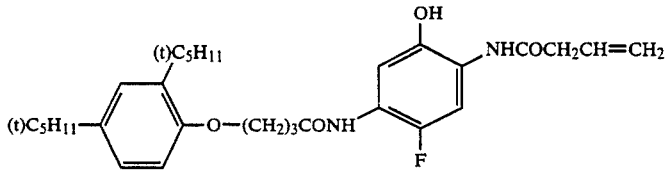
C-88
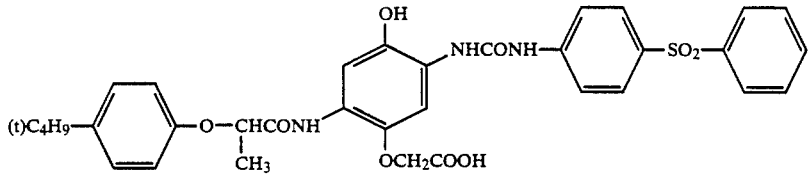

-continued
[Exemplary compounds]
C-89
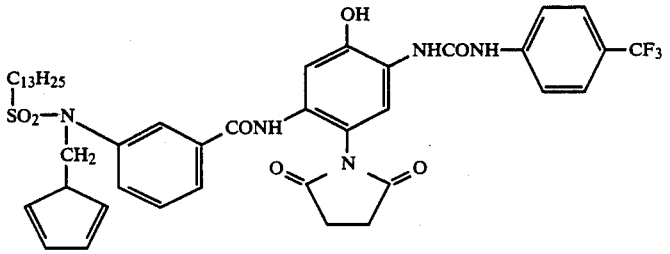
C-90
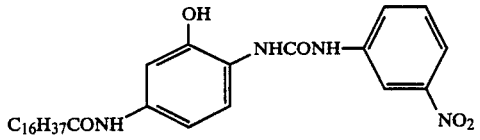
C-91
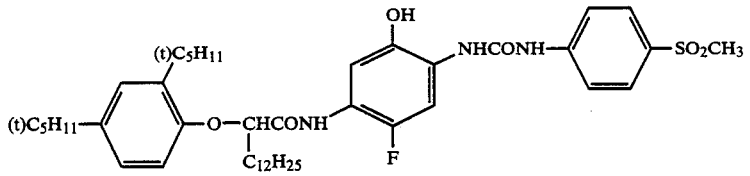
C-92
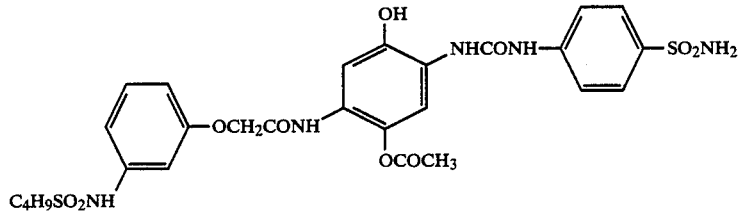
C-93
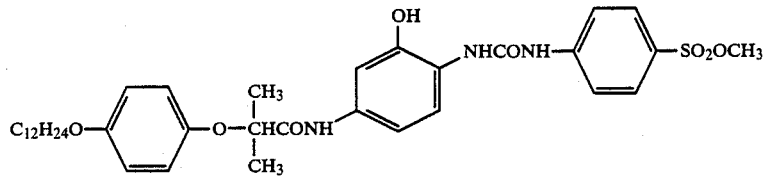
C-94
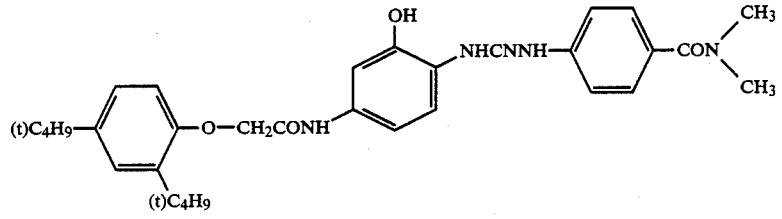
C-95
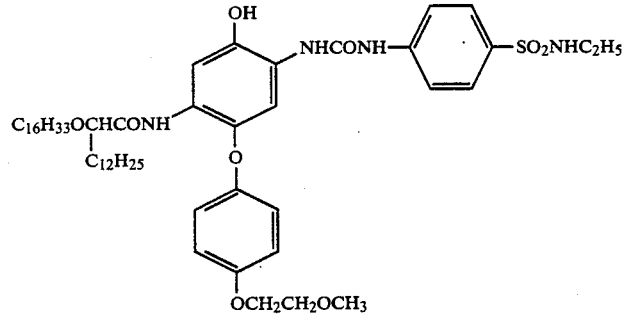

-continued

[Exemplary compounds]

C-96

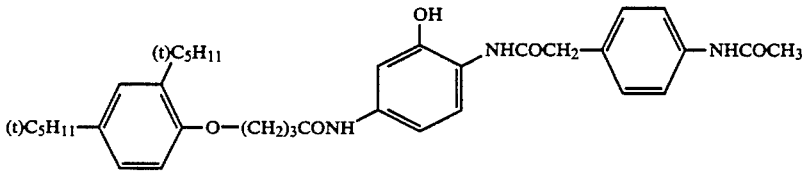

C-97

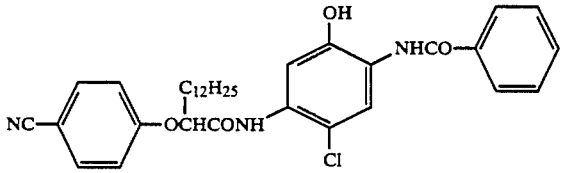

C-98

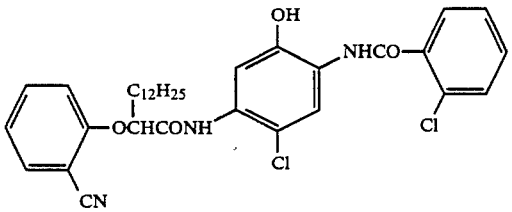

C-99

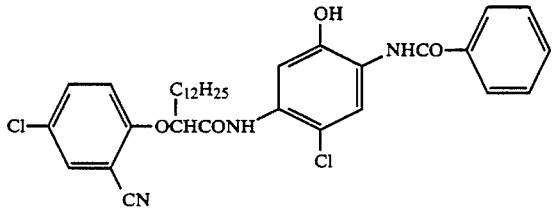

C-100

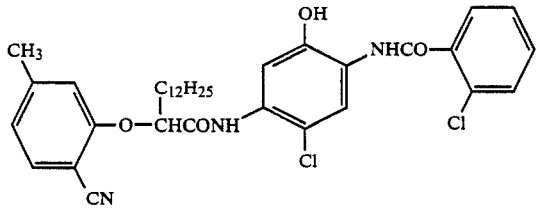

These cyan couplers can be synthesized by the known method, and for example, they can be synthesized by the methods as disclosed in U.S. Pat. Nos. 2,772,162, No. 3,758,308, No. 3,880,661, No. 4,124,396 and No. 3,222,176; British Patent No. 975,773; Japanese Provisional Patent Publications No. 21139/1972, No. 112038/1975, No. 163537/1980, No. 29235/1981, No. 99341/1980, No. 116030/1981, No. 69329/1977, No. 55945/1981, No. 80045/1981 and No. 134644/1975; British Patent No. 1,011,940; U.S. Pat. Nos. 3,446,622 and No. 3,996,253; Japanese Provisional Patent Publications No. 65134/1981, No. 204543/1982, No. 204544/1982, No. 204545/1982, No. 33249/1983, No. 33251/1983, No. 33252/1983, No. 33250/1983, No. 33248/1983, No. 46645/1984, No. 31334/1983, No. 146050/1984, No. 166956/1984, No. 24547/1985, No. 35731/1985 and No. 37557/1985 and the like.

In the present invention, the cyan couplers represented by the formula (C - 1) or (C - 2) may be used in combination with the conventionally known cyan couplers so long as it does not contradict to the object of the present invention. Further, the cyan couplers represented by the formulae (C - 1) and (C - 2) may be used in combination therewith.

The cyan couplers represented by the formula (C - 1) or (C - 2) in accordance with the present invention is typically used in an amount of about 0.005 to 2 moles, preferably 0.01 to 1 mole per one mole of silver halide.

In the processing method of the silver halide color photographic material of the present invention, it is preferred to combinedly use the cyan coupler represented by the above formula (C) in addition to the coupler represented by the formula (C - 1) or (C - 2).

In the formula (C), one of R and R1 represents a hydrogen atom and the other is a straight or branched alkyl group having at least 2 to 12 carbon atoms; X represents a hydrogen atom or a group eliminatable through the coupling reaction with a oxidized product of an aromatic primary amine type color developing agent; and $R_2$ represents a ballast group.

While the cyan color forming coupler in accordance with the present invention can be represented by the above formula (C), the formula (C) will further be explained in the following.

In the present invention, the straight or branched alkyl group having at least 2 to 12 carbon atoms represented by $R_1$ and R of the above formula (C) are, for example, an ethyl group, a propyl group, a butyl group.

In the formula (C), the ballast group represented by $R_2$ is an organic group having a size and form which affords a coupler molecule bulkiness sufficient to substantially prevent the coupler from diffusing from the layer in which it has been contained to the other layer. As the representative ballast group, there may be mentioned an alkyl group or an aryl group each having total carbon atoms of 8 to 32, preferably those having total carbon atoms of 13 to 28. As the substituent for the alkyl group and the aryl group, there may be mentioned, for example, an alkyl group, an aryl group, an alkoxy group, an aryloxy group, a carboxy group, an acyl group, an ester group, a hydroxy group, a cyano group, a nitro group, a carbamoyl group, a carbonamido group, an alkylthio group, an arylthio group, a sulfonyl group, a sulfonamido group, a sulfamoyl group, a halogen atom and the like, and as the substituent for the alkyl group, those as mentioned for the above aryl group except for the alkyl group.

Preferred ones for the ballast group represented by the following formula:

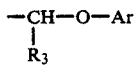

$R_3$ represents an alkyl group having 1 to 12 carbon atoms; and Ar represents an aryl group such as a phenyl group, etc., and the aryl group may have a substituent. As the substituent, an alkyl group, a hydroxy group, a halogen atom, an alkylsulfonamido group, etc. may be mentioned and the most preferred is a branched alkyl group such as a t-butyl group, etc.

The group represented by X in the above formula (C), which is capable of being released through the coupling reaction, determines not only the equivalence number of the coupler but also the reactivity thereof, as known well to one skilled in the art.

The representative examples for X includes halogen represented by chlorine and fluorine, an aryloxy group, a substituted or unsubstituted alkoxy group, an acyloxy group, a sulfonamido group, an arylthio group, a heteroylthio group, a heteroyloxy group, a sulfonyloxy group, a carbamoyloxy group and the like. As specific examples for X, there may be mentioned the groups as disclosed in Japanese Provisional Patent Publications No. 10135/1975, No. 120334/1975, No. 130414/1975, No. 48237/1979, No. 146828/1976, No. 14736/1979, No. 37425/1972, No. 123341/1975 and No. 95346/1983, Japanese Patent Publication No. 36894/1973, and U.S. Pat. Nos. 3,476,563, No. 3,737,316 and No. 3,227,551.

Next, exemplary compounds of the cyan coupler represented by the formula (C) which is specified $R_1$, X, $R_2$ and R, respectively, are shown below, but the present invention is not limited by these compounds.

(Exemplary compounds)

| Coupler No. | $R_1$ | X | $R_2$ | R |
|---|---|---|---|---|
| C-1 | $-C_2H_5$ | $-H$ | 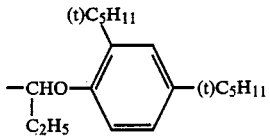 | $-H$ |
| C-2 | $-C_2H_5$ | $-Cl$ | 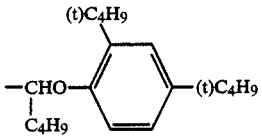 | $-H$ |
| C-3 | $-C_2H_5$ | $-H$ | 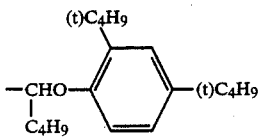 | $-H$ |
| C-4 | $-C_2H_5$ | $-Cl$ | 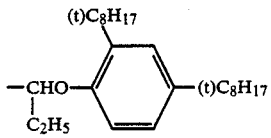 | $-H$ |
| C-5 | $-C_2H_5$ | $-Cl$ | 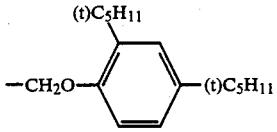 | $-H$ |

-continued
(Exemplary compounds)
| Coupler No. | $R_1$ | X | $R_2$ | R |
|---|---|---|---|---|
| C-6 | $-C_2H_5$ | 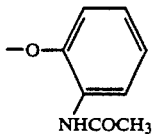 | 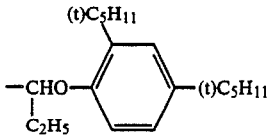 | —H |
| C-7 | 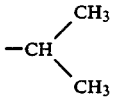 | —Cl | 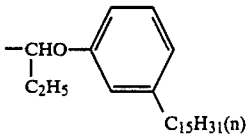 | —H |
| C-8 | $-C_2H_5$ | —Cl | 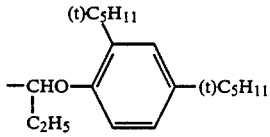 | —H |
| C-9 | $-C_2H_5$ | —Cl | 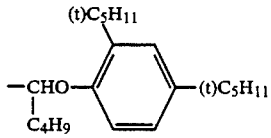 | —H |
| C-10 | $-C_4H_9$ | —F | 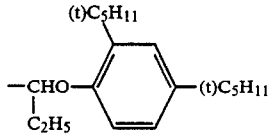 | —H |
| C-11 | $-C_2H_5$ | —F | 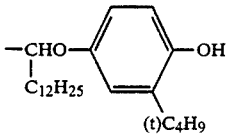 | —H |
| C-12 | $-C_2H_5$ | —Cl | 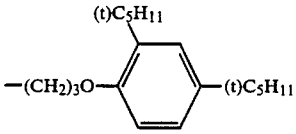 | —H |
| C-13 | $-C_2H_5$ | —F | 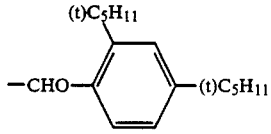 | —H |
| C-14 | $-C_4H_9$ | —Cl | 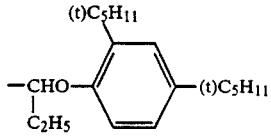 | —H |
| C-15 | $-C_2H_5$ | —Cl | 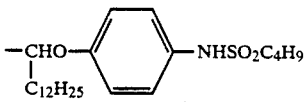 | —H |

-continued
(Exemplary compounds)
| Coupler No. | $R_1$ | X | $R_2$ | R |
|---|---|---|---|---|
| C-16 | $-C_2H_5$ | $-Cl$ | 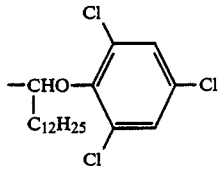 | $-H$ |
| C-17 | 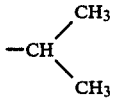 | $-Cl$ | $-C_{18}H_{37}$ | $-H$ |
| C-18 | $-C_2H_5$ | $-F$ | 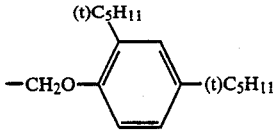 | $-H$ |
| C-19 | $-C_2H_5$ | 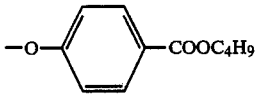 | 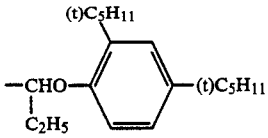 | $-H$ |
| C-20 | $-C_2H_5$ | $-Cl$ | 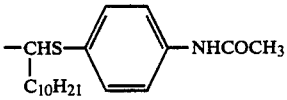 | $-H$ |
| C-21 | $-C_3H_7$ | $-Cl$ | 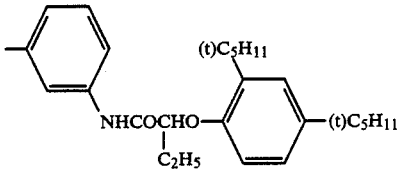 | $-H$ |
| C-22 | $-C_3H_7$ | $-Cl$ | 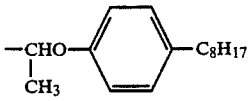 | $-H$ |
| C-23 | $-C_2H_4NHCOCH_3$ | $-Cl$ | 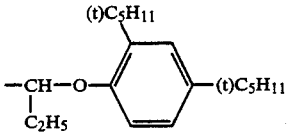 | $-H$ |
| C-24 | $-C_3H_6OCH_3$ | $-Cl$ | 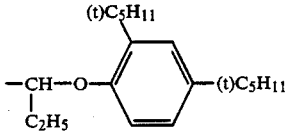 | $-H$ |
| C-25 | $-H$ | $-Cl$ | 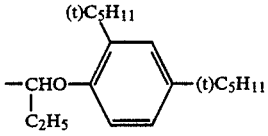 | $-C_2H_5$ |
| C-26 | $-H$ | $-Cl$ | 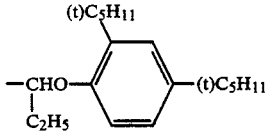 | $-C_3H_7$ |

-continued (Exemplary compounds)

| Coupler No. | $R_1$ | X | $R_2$ | R |
|---|---|---|---|---|
| C-27 | —H | —Cl | 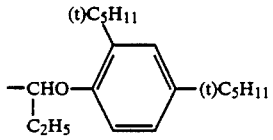 | $-C_5H_{11}$ |
| C-28 | $-C_2H_5$ | —Cl | 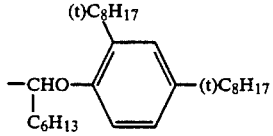 | —H |

In the following, the synthesis method for obtaining exemplary compounds are shown, but the other exemplary compounds can also be synthesized similarly.

SYNTHESIS OF EXEMPLARY COMPOUNDS (1)

[(1) -a] Synthesis of 2-nitro-4,6-dichloro-5-ethylphenol

In 150 ml of glatial acetic acid were dissolved 33 g of 2-nitro-5-ethylphenol, 0.6 g of iodine and 1.5 g of ferric chloride. To the mixture was added dropwise 75 ml of sulfuryl chloride at 40° C. over 3 hours. After completion of the dropwise addition of the sulfuryl chloride, precipitates formed during the dripwise addition reacted and dissolved by heating under reflux. It took about 2 hours for the heating under reflux. Then, the reaction mixture was poured into water and the formed crystals were purified by recrystallization from methanol. Identification of (1) - a was carried out by the nuclear magnetic resonance spectrum and the elemental analysis.

[(1) - b] Synthesis of 2-amino-4,6-dichloro-5-ethylphenol

In 300 ml of alcohol was dissolved 21.2 g of the above compound [(1) - a], and to the solution was added a catalytic amount of Raney nickel and hydrogen was passed therethrough under ambient pressure until no hydrogen absorption was observed. After the reaction, the Raney nickel was removed and the alcohol was distilled out under reduced pressure. The resulting reside (1) - b was employed in the next acylation step without purification.

[(1) - c] Synthesis of 2-[(2,4-di-tert-acylphenoxy)acetamido]-4,6-dichloro-5-ethylphenol In a mixed solution comprising 500 ml of glacial acetic acid and 16.7 g of sodium acetate was dissolved a crude amino derivative obtained in [(1) - b], and to the resulting solution was added dropwise at room temperature an acetic acid solution which had dissolved 28.0 g of 2,4-di-tert-aminophenoxyacetic acid chloride in 50 ml of acetic acid. The acetic solution was added dropwise for 30 minutes, and after further stirring for 30 minutes, the reaction mixture was poured into ice-cold water. After the formed precipitates were collected by filration and dried, recrystallized twice from acetnitrile to obtain the title compound. Identification the title compound was carried out by the elemental analysis and the nuclear magnetic resonance spectrum.

| | $C_{21}H_{35}NO_3Cl_2$ | | | |
|---|---|---|---|---|
| | C | H | N | Cl |
| Calculated (%) | 65.00 | 7.34 | 2.92 | 14.76 |
| Observed (%) | 64.91 | 7.36 | 2.99 | 14.50 |

An amount to be added of the cyan coupler of the present invention is not limitative, but preferred is $2\times10^{-3}$ to $5\times10^{-1}$ mole, more preferred is $1\times10^{-2}$ to $5\times10^{-1}$ mole per 1 mole of silver in the red-sensitive silver halide photographic material.

In the present invention, the aforesaid cyan couplers of the present invention may be used in combination with other cyan couplers, and as the cyan couplers which can be combinedly used, there may be mentioned phenol series compounds and naphthol series compounds e.g., those as disclosed in U.S. Pat. Nos. 2,369,929, No. 2,434,272, No. 2,474,293, No. 2,895,826, No. 3,253,924, No. 3,034,892, No. 3,311,476, No. 3,386,301, No. 3,419,390, No. 3,458,315, No. 3,476,563, No. 3,531,383 and the like. Synthesis methods for these compounds have also been described in these references.

The magenta coupler represented by the formula (M) will be explained below.

In the formula (M) according to the present invention,

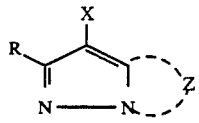

(M)

Z represents a group of non-metallic atoms necessary for forming a nitrogen-containing heterocyclic ring and the ring formed by said Z may have a substituent.

X represents a hydrogen atom or a substitutent eliminatable through the reaction with the oxidized product of a color developing agent.

Further, R represents a hydrogen atom or a substituent.

As the substituent represented by R, there may be mentioned, for example, halogen atoms, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As halogen atoms, for example, chlorine atom, bromine atom may be used, particularly preferably chlorine atom.

The alkyl group represented by R may include preferably those having 1 to 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through an oxygen atom such as of a hydroxy group, an alkoxy group, an aryloxy group, a heterocyclyloxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a 1-hexynonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-(α-[4''-(p-hydroxybenzenesulfonyl)phenoxy]dodecanoylamino)phenylpropyl group, a 3-(4'-[α-(2'',4''-di-t-amylphenoxy)butaneamido]phenyl)-propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g. an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphosphonyl group and the like; alkoxyphosphonyl groups such as an octyloxyphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R may be, for example, bicyclo[2.2.1]heptan-1-yl, tricyclo[3.3.1.1$^{3,7}$]decan-1-yl, 7,7-dimethylbicyclo[2.2.1]heptan-1-yl and the like.

The alkoxy group represented by R may be substituted by those as mentioned above as substituents for alkyl groups, including a methoxy group, a propoxy group, a 2-ethoxy-ethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substitutents or atoms for the aryl groups, including, for example, a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneimidoanilino group and the like.

The acylamino group represented by R may include an alkylcarbonylamino group, an arylcarbonylamino group (preferably a phenylcarbonylamino group), etc., which may further have substituents, specifically and acetamide group, an α-ethylpropaneamide group, an N-phenylacetamide group, a dodecaneamide group, a 2,4-di-t-amylphenoxyacetamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzenesulfonamide and the like.

The imide group represented by R may be either open-chained or cyclic, which may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N-N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phenethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminatable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include the groups represented by the formula:

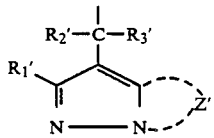

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heterocyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

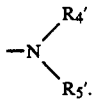

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ or $R_5'$ and alkyl groups. Typical examples of said aryl group may be, for example, a phenyl group, a 1-nathtyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-bennzothiazolyl group, a 2-pyridyl group and the like.

The sulfamoyl group represented by $R_4'$ or $R_5'$ may include an N-alkylsulfamoyl group, an N-N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclyl group may have substituents. Typical examples of the acyl group are a hexafluorobutanoyl group, a 2,3,4,5,6-pentafluorobenzoyl group, an acetyl group, a benzoyl group, a naththoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl gorup and the like.

The aryloxycarbonyl group represented by $R_4'$ or $R_5'$ may have substitutents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6membered ring, which may be either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladiene group, a 2-oxo-1-piperdinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (M) and the formulae (M - 1) to (M - 7) as hereinafter described has a moiety of the formula:

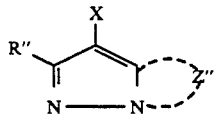

(wherein R", X and Z" have the same meanings as R, X and Z in the formula (M)), the so-called bis-form type coupler is formed, which is of course included in the present invention. The ring formed by Z, Z', Z" and $Z_1$ as hereinafter described may also be fused with another ring (e.g. a 5-to 7-membered cycloalkene). For example, $R_5$ and $R_6$ in the formula (M - 4), $R_7$ and $R_8$ in the formula (M - 5) may be bonded to each other to form a ring (e.g. a 5- to 7-membered rings).

The compounds represented by the formula (M) can be also represented specifically by the following formulae (M - 1) through (M - 6).

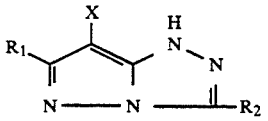

(M-1)

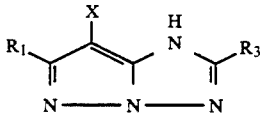

(M-2)

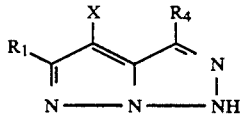

(M-3)

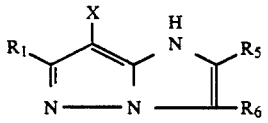

(M-4)

-continued

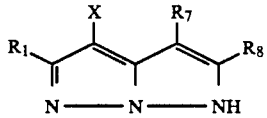

(M-5)

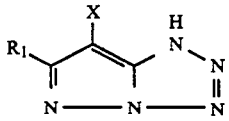

(M-6)

In the above formulae (M - 1) to (M - 6), $R_1$ to $R_8$ and X have the same meanings as the above R and X.

Of the compounds represented by the formula (M), those represented by the following formula (M - 7) are preferred.

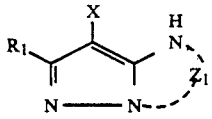

(M-7)

wherein $R_1$, X and $Z_1$ have the same meanings as R, X and Z in the formula (M).

Of the magenta couplers represented by the formulae (M - 1) to (M - 6), the magenta coupler represented by the formula (M - 1) is particularly preferred.

To describe about the substituents on the heterocyclic ring in the formulae (M) to (M - 7), R in the formula (M) and $R_1$ in the formulae (M - 1) to (M - 7) should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (M - 8) shown below:

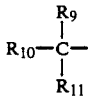

(M-8)

In the above formula, each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g., cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (M), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possessed thereby may include examples of cycloalkyl, cycloalkenyl and heterocyclic groups as mentioned for substituents on the R in the aforesaid formula (M) and substituents thereof.

Of the compounds of the formula (M - 8), preferred are:

(i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in the formula (M) and the substituents thereof.

The substituents which the ring to be formed by Z in the formula (M) and the ring to be formed by $Z_1$ in the formula (M - 7) may have, and the substituents $R_2$ to $R_8$ in the formulae (M - 1) to (M - 5), are preferably those represented by the formula (M - 9) shown below:

$$-R^1\text{-}SO_2\text{-}R^2 \qquad \text{(M - 9)}$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in the formula (M) may have.

Preferable substituents may include a phenyl.

Preferable example for the alkylene represented by $R^1$ are shown below:

$-CH_2CH_2CH_2-$, $-CH(CH_3)CH_2CH_2-$, $-CH(C_2H_5)CH_2CH_2-$, $-CH_2CH_2CH(C_7H_{15})-$, $-CH_2CH_2CH(C_2H_5)-$, $-CH_2CH_2CH_2CH_2-$,

-continued $-CH_2CH_2CH_2CH(C_6H_{13})-$, 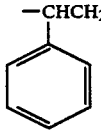 , $-C(CH_3)_2-CH_2CH_2-$.

The alkyl group represented by $R^2$ may be of straight chain or branched structure.

Specifically, it may include methyl, ethyl, propyl, iospropyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group, and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by the formula (M) are those represented by the formula (M - 10) shown below:

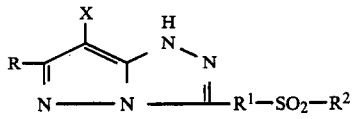

(M-10)

wherein R and X each have the same meaning as R and X in the formula (M), and $R^1$ and $R^2$ each have the same meaning as $R^1$ and $R^2$ in the formula (M - 9).

In the following, examples of the magenta coupler of the present ivention are enumerated, which are not limitative of the present invention.

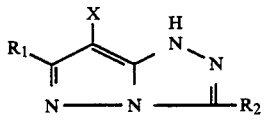

| Compound | X | $R_1$ | $R_2$ |
|---|---|---|---|
| 1 | 2 | 11 | 51 |
| 2 | 2 | 11 | 71 |
| 3 | 3 | 11 | 73 |
| 4 | 2 | 11 | 66 |
| 5 | 2 | 11 | 62 |
| 6 | 184 | 11 | 46 |
| 7 | 2 | 11 | 108 |
| 8 | 2 | 11 | 124 |
| 9 | 2 | 11 | 121 |
| 10 | 2 | 11 | 115 |
| 11 | 184 | 11 | 62 |
| 12 | 2 | 11 | 136 |
| 13 | 2 | 11 | 142 |
| 14 | H | 11 | 88 |
| 15 | 2 | 11 | 102 |
| 16 | 2 | 13 | 52 |
| 17 | 217 | 14 | 52 |

-continued
| Compound | X | $R_1$ | $R_2$ |
|---|---|---|---|
| 18 | 2 | 11 | 79 |
| 19 | 2 | 22 | 80 |
| 20 | 2 | 22 | 20 |
| 21 | 234 | 11 | 166 |
| 22 | 2 | 15 | 71 |
| 23 | 2 | 15 | 52 |
| 24 | 2 | 15 | 51 |
| 25 | 2 | 15 | 38 |
| 26 | 2 | 15 | 36 |
| 27 | 2 | 15 | 59 |
| 28 | 2 | 15 | 62 |
| 29 | 2 | 15 | 47 |
| 30 | 184 | 15 | 31 |
| 31 | 3 | 15 | 68 |
| 32 | 2 | 15 | 79 |
| 33 | 2 | 15 | 77 |
| 34 | 217 | 15 | 78 |
| 35 | 2 | 15 | 49 |
| 36 | 199 | 15 | 42 |
| 37 | 236 | 15 | 165 |
| 38 | 2 | 15 | 88 |
| 39 | 183 | 15 | 89 |
| 40 | 2 | 15 | 22 |
| 41 | 2 | 15 | 108 |
| 42 | 2 | 15 | 102 |
| 43 | 2 | 15 | 194 |
| 44 | 2 | 15 | 128 |
| 45 | 2 | 15 | 136 |
| 46 | 2 | 15 | 134 |
| 47 | 2 | 15 | 132 |
| 48 | 2 | 15 | 135 |
| 49 | 2 | 15 | 127 |
| 50 | 2 | 15 | 133 |
| 51 | 2 | 15 | 138 |
| 52 | 2 | 15 | 131 |
| 53 | 2 | 15 | 130 |
| 54 | 2 | 15 | 139 |
| 55 | 2 | 15 | 137 |
| 56 | 2 | 15 | 129 |
| 57 | 2 | 15 | 140 |
| 58 | 2 | 15 | 142 |
| 59 | 2 | 15 | 121 |
| 60 | 2 | 15 | 120 |
| 61 | 2 | 15 | 118 |
| 62 | 2 | 15 | 115 |
| 63 | 2 | 15 | 105 |
| 64 | 2 | 15 | 126 |
| 65 | 184 | 15 | 113 |
| 66 | 2 | 15 | 123 |
| 67 | 221 | 15 | 107 |
| 68 | 2 | 15 | 112 |
| 69 | 2 | 15 | 117 |
| 70 | 182 | 15 | 119 |
| 71 | 3 | 15 | 109 |
| 72 | 2 | 15 | 114 |
| 73 | 204 | 15 | 121 |
| 74 | 2 | 15 | 111 |
| 75 | 2 | 15 | 104 |
| 76 | 2 | 15 | 189 |
| 77 | 3 | 15 | 181 |
| 78 | 2 | 15 | 233 |
| 79 | 2 | 15 | 238 |
| 80 | 211 | 15 | 52 |
| 81 | 213 | 15 | 52 |
| 82 | H | 15 | 52 |
| 83 | 2 | 18 | 52 |
| 84 | 2 | 21 | 52 |
| 85 | 2 | 21 | 44 |
| 86 | 2 | 21 | 116 |
| 87 | 2 | 24 | 110 |
| 88 | 2 | 24 | 55 |
| 89 | 2 | 24 | 32 |
| 90 | 2 | 153 | 71 |
| 91 | 2 | 153 | 75 |
| 92 | 222 | 153 | 52 |
| 93 | 2 | 151 | 89 |
| 94 | 2 | 153 | 141 |
| 95 | 234 | 153 | 106 |
| 96 | 2 | 153 | 125 |
| 97 | 2 | 152 | 89 |
-continued
| Compound | X | $R_1$ | $R_2$ |
|---|---|---|---|
| 98 | 2 | 151 | 121 |
| 99 | 2 | 16 | 71 |
| 100 | 2 | 16 | 52 |
| 101 | 2 | 16 | 56 |
| 102 | 2 | 16 | 54 |
| 103 | 2 | 16 | 35 |
| 104 | 2 | 16 | 69 |
| 105 | 2 | 16 | 66 |
| 106 | 3 | 16 | 48 |
| 107 | 2 | 16 | 39 |
| 108 | 183 | 16 | 29 |
| 109 | 184 | 16 | 59 |
| 110 | 2 | 16 | 61 |
| 111 | 227 | 16 | 85 |
| 112 | 2 | 16 | 88 |
| 113 | 200 | 16 | 45 |
| 114 | 2 | 16 | 101 |
| 115 | 182 | 16 | 108 |
| 116 | 2 | 16 | 27 |
| 117 | 2 | 16 | 79 |
| 118 | 214 | 16 | 74 |
| 119 | 2 | 16 | 41 |
| 120 | 2 | 16 | 72 |
| 121 | 2 | 16 | 73 |
| 122 | 2 | 16 | 128 |
| 123 | 3 | 16 | 136 |
| 124 | 2 | 16 | 135 |
| 125 | 214 | 16 | 136 |
| 126 | 203 | 16 | 136 |
| 127 | 2 | 16 | 136 |
| 128 | 2 | 16 | 143 |
| 129 | 2 | 16 | 144 |
| 130 | 2 | 16 | 121 |
| 131 | 2 | 16 | 115 |
| 132 | 2 | 16 | 123 |
| 133 | H | 16 | 122 |
| 134 | 236 | 16 | 231 |
| 135 | 2 | 26 | 52 |
| 136 | 2 | 16 | 24 |
| 137 | 199 | 19 | 52 |
| 138 | 2 | 28 | 52 |
| 139 | 2 | 25 | 36 |
| 140 | 2 | 155 | 51 |
| 141 | 2 | 154 | 52 |
| 142 | 2 | 16 | 164 |
| 143 | 197 | 16 | 44 |
| 144 | 2 | 161 | 55 |
| 145 | 2 | 168 | 11 |
| 146 | 2 | 171 | 128 |
| 147 | 2 | 171 | 45 |
| 148 | 197 | 232 | 40 |
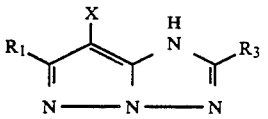
| Compound | X | $R_1$ | $R_3$ |
|---|---|---|---|
| 149 | 2 | 16 | 42 |
| 150 | 2 | 15 | 66 |
| 151 | 2 | 16 | 193 |
| 152 | 2 | 62 | 11 |
| 153 | 2 | 76 | 11 |
| 154 | 2 | 89 | 11 |
| 155 | 198 | 27 | 11 |
| 156 | 2 | 193 | 11 |
| 157 | 2 | 11 | 34 |
| 158 | 2 | 56 | 11 |
| 159 | 192 | 56 | 11 |
| 160 | 187 | 23 | 11 |
| 161 | 2 | 11 | 58 |
| 162 | 186 | 11 | 58 |

-continued
| Compound | X | $R_1$ | $R_3$ |
|---|---|---|---|
| 163 | 2 | 67 | 11 |
| 164 | 2 | 16 | 93 |
| 165 | 1 | 11 | 94 |
| 166 | 2 | 196 | 33 |
| 167 | 225 | 188 | 11 |
| 168 | 2 | 11 | 81 |
| 169 | 2 | 11 | 84 |
| 170 | 2 | 11 | 82 |
| 171 | 201 | 63 | 11 |
| 172 | 235 | 11 | 89 |
| 173 | 232 | 167 | 11 |
| 174 | 191 | 70 | 11 |
| 175 | 223 | 195 | 11 |
| 176 | 220 | 11 | 11 |
| 177 | 190 | 11 | 58 |
| 178 | 2 | 16 | 90 |
| 179 | 224 | 11 | 95 |
| 180 | 2 | 11 | 65 |
| 181 | 2 | 64 | 11 |
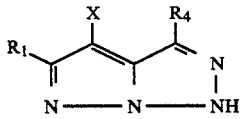
| Compound | X | $R_1$ | $R_4$ |
|---|---|---|---|
| 182 | 2 | 16 | 53 |
| 183 | 2 | 52 | 11 |
| 184 | 2 | 92 | 11 |
| 185 | 218 | 96 | 11 |
| 186 | 219 | 99 | 172 |
| 187 | 215 | 15 | 89 |
| 188 | 224 | 98 | 11 |
| 189 | 184 | 13 | 83 |
| 190 | H | 52 | 11 |
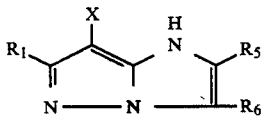
| Compound | X | $R_1$ | $R_5$ | $R_6$ |
|---|---|---|---|---|
| 191 | 2 | 16 | 11 | 52 |
| 192 | 2 | 15 | H | 52 |
| 193 | 2 | 16 | 60 | H |
| 194 | 2 | 174 | 11 | H |
-continued
| Compound | X | $R_1$ | $R_5$ | $R_6$ |
|---|---|---|---|---|
| 195 | 184 | 11 | 30 | H |
| 196 | 2 | 152 | H | 57 |
| 197 | 185 | 12 | 162 | 11 |
| 198 | 3 | 11 | 11 | 89 |
| 199 | H | 226 | H | H |
| 200 | 2 | 23 | 173 | 17 |
| 201 | 2 | 23 | H | H |
| 202 | H | 23 | H | H |
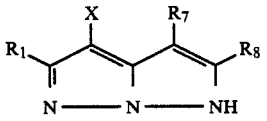
| Compound | X | $R_1$ | $R_7$ | $R_8$ |
|---|---|---|---|---|
| 203 | 2 | 11 | H | 91 |
| 204 | 2 | 11 | H | 92 |
| 205 | 219 | 172 | H | 100 |
| 206 | 235 | 15 | H | 87 |
| 207 | 2 | 11 | H | 62 |
| 208 | 202 | 13 | 11 | 97 |
| 209 | H | 11 | H | 91 |
| 210 | 2 | 16 | H | 52 |
| 211 | 2 | 16 | H | 42 |
| 212 | 184 | 15 | H | 66 |
| 213 | 2 | 203 | H | 163 |
| 214 | 204 | 212 | H | 50 |
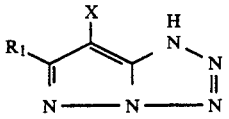
| Compound | X | $R_1$ |
|---|---|---|
| 215 | 2 | 20 |
| 216 | 184 | 88 |
| 217 | 2 | 69 |
| 218 | 222 | 216 |
| 219 | 199 | 188 |
| 220 | 2 | 98 |
| 221 | 2 | 86 |
| 222 | 235 | 43 |
| 223 | 2 | 103 |
Provided that numbers in the Tables show the following each groups.
| | |
|---|---|
| —F | 1 |
| —Cl | 2 |
| —Br | 3 |
| —$CH_3$ | 11 |
| —$CF_3$ | 12 |
| —$C_2H_5$ | 13 |
| —$C_3H_7$ | 14 |
| —(i)$C_3H_7$ | 15 |
| —(t)$C_4H_9$ | 16 |
| —$C_5H_{11}$ | 17 |

-continued
18
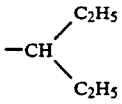
19
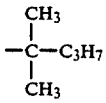
20
$-C_7H_{15}$
21
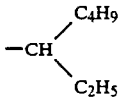
22
$-C_{15}H_{31}$
23
$-C_{17}H_{35}$
24
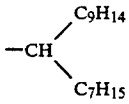
25
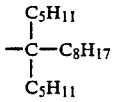
26
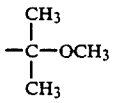
27
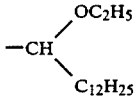
28
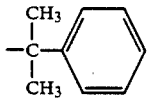
29
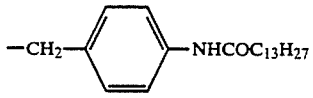
30
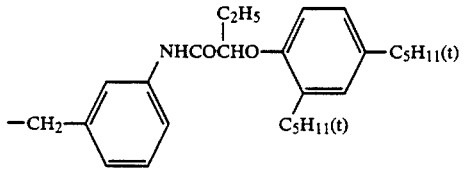
31
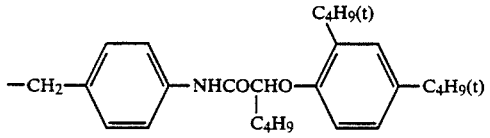

-continued
32
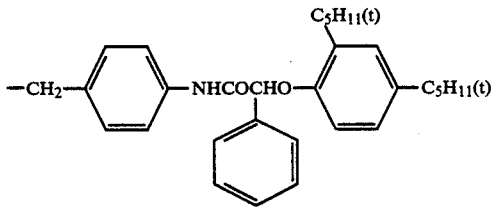
33
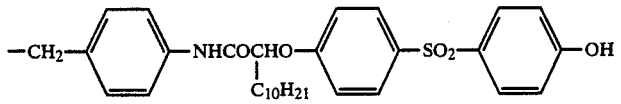
34
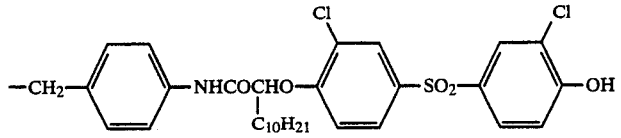
35
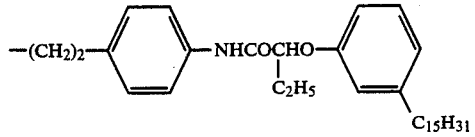
36
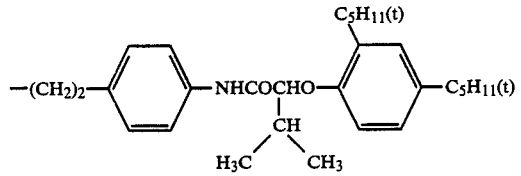
37
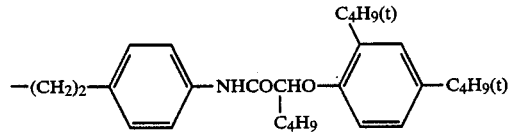
38
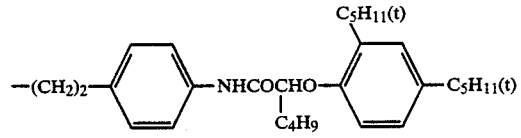
39
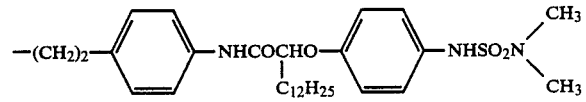
40
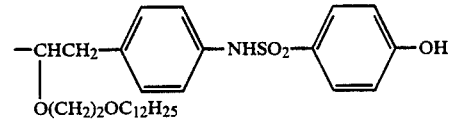
41
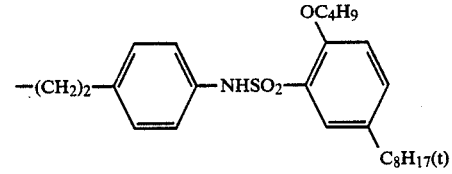

-continued
42
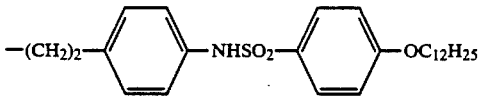
43
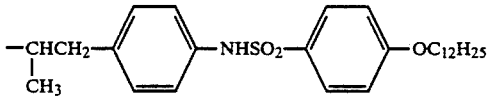
44
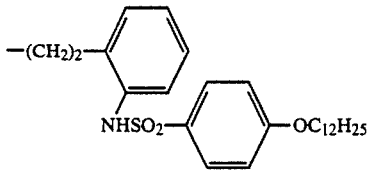
45
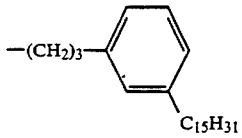
46
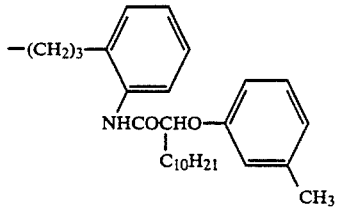
47
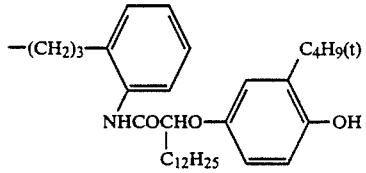
48
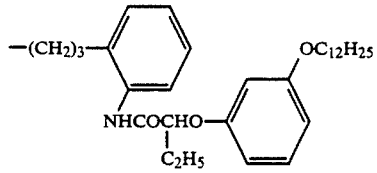
49
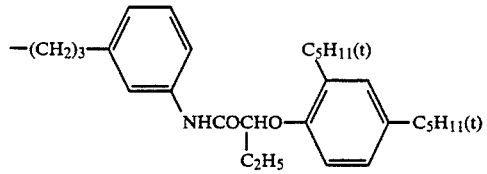
50
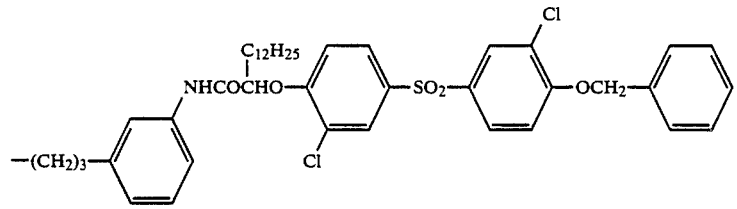

-continued
51
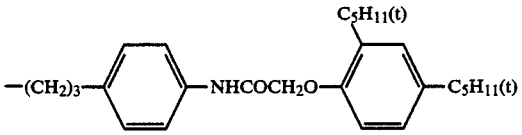
52
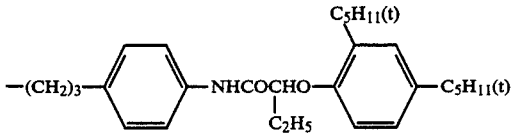
53
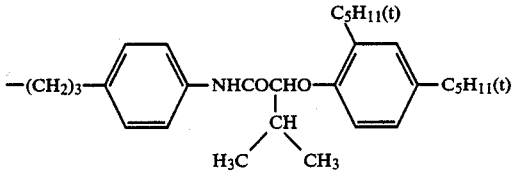
54
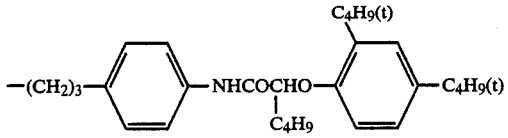
55
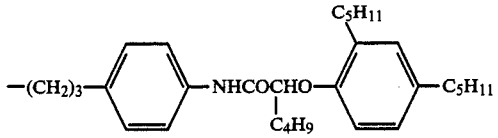
56
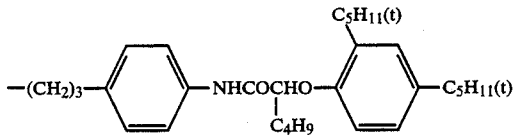
57
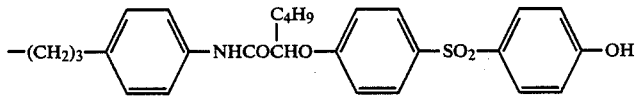
58
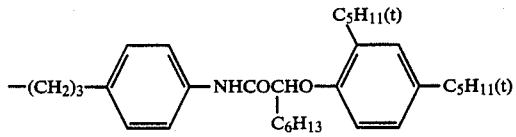
59
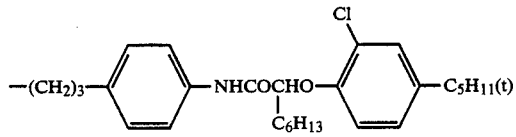
60
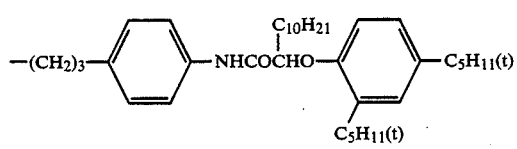
61
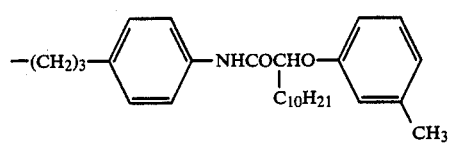

-continued
62
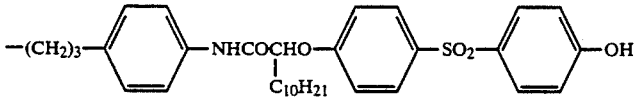
63
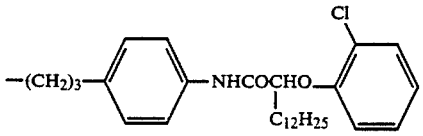
64
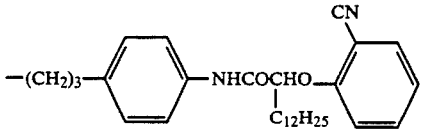
65
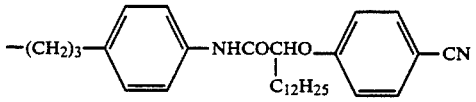
66
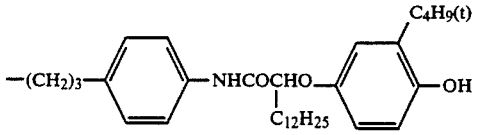
67
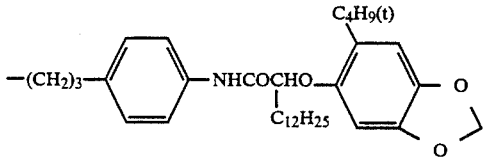
68
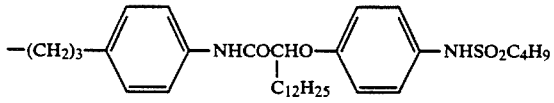
69
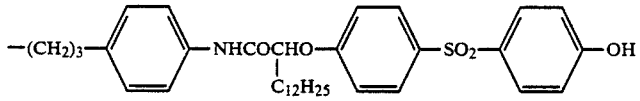
70
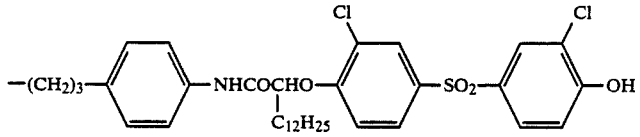
71
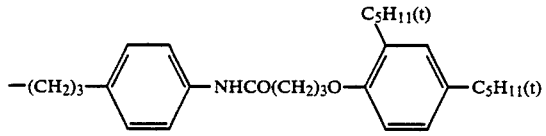
72
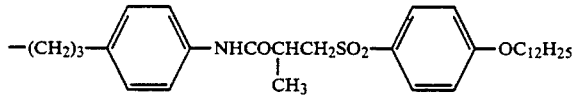
73
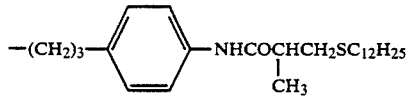

-continued
74
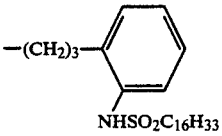
75
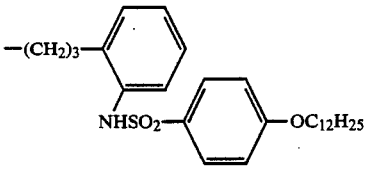
76
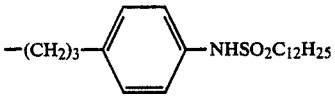
77
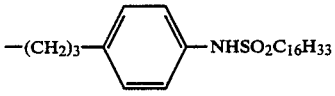
78
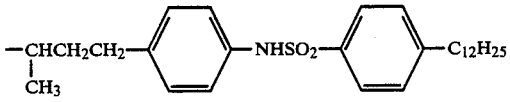
79
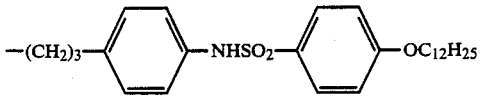
80
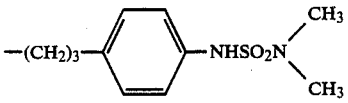
81
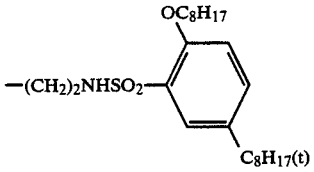
82
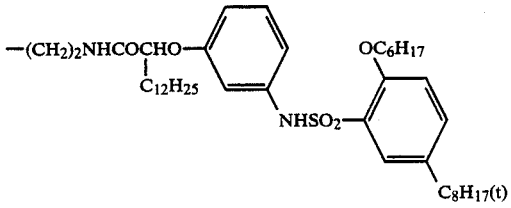
84
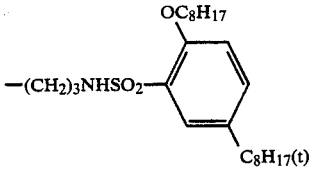
85
$-(CH_2)_3OC_{12}H_{25}$ -continued
86
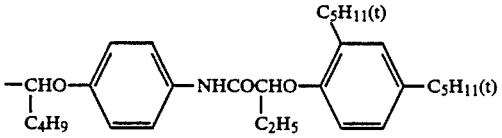
87
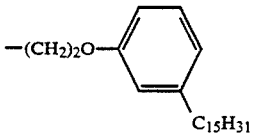
88
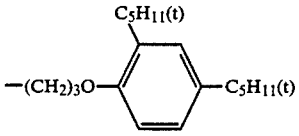
89
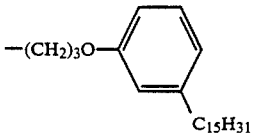
90
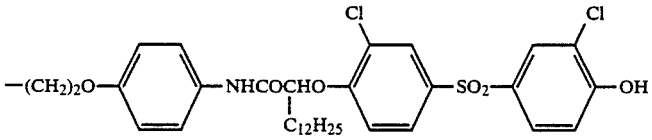
91
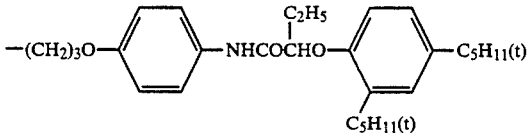
92
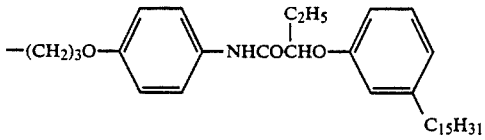
93
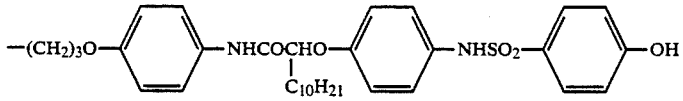
94
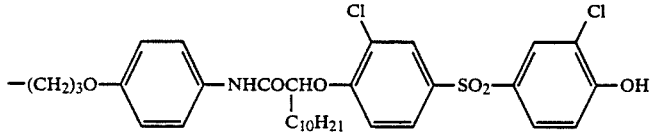
95
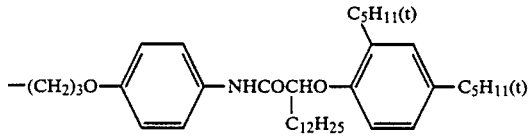
96
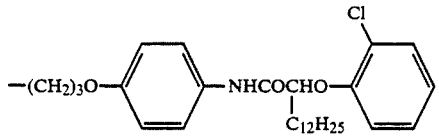

-continued
97
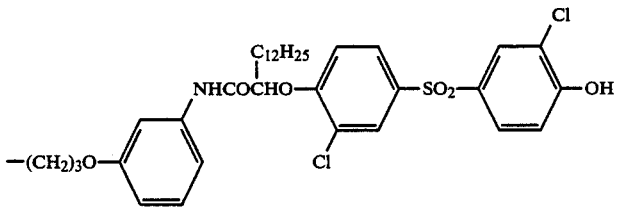
98
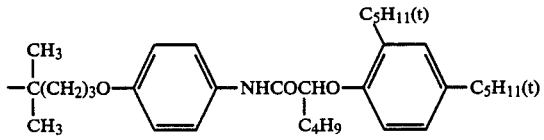
99
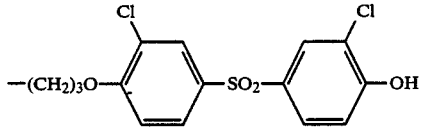
100
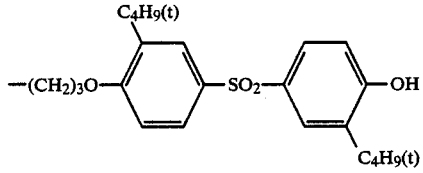
101
$-CH(CH_3)CH_2SC_{18}H_{37}$
102
$-C(CH_3)_2-CH_2SC_{18}H_{37}$
103
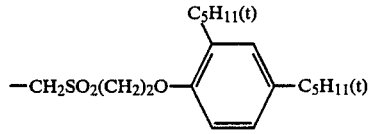
104
$-CH_2CH_2CH_2SO_2CH_2CH(C_8H_{17})(C_6H_{13})$
105
$-CH_2CH_2CH(C_7H_{15})SO_2C_{12}H_{25}$
106
$-CH_2CH_2CH_2SO_2CH_2CH_2SO_2C_{12}H_{25}$
107
$-CH_2CH_2CH_2CH(C_6H_{13})SO_2C_8H_{17}$
108
$-CH(CH_3)CH_2SO_2C_{18}H_{37}$
109
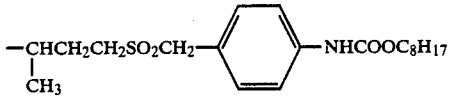
110
$-CH(C_2H_5)CH_2CH_2SO_2H_5$ -continued
111
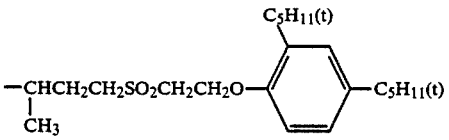
112
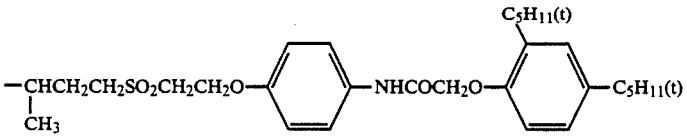
113
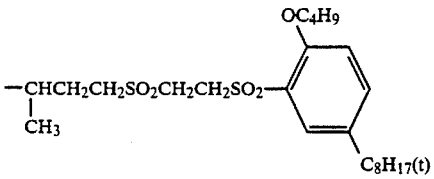
114
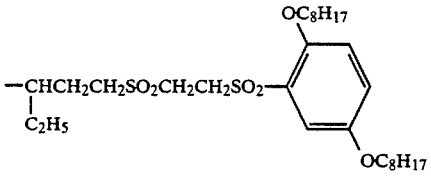
115
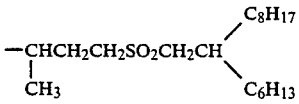
116
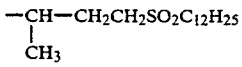
117
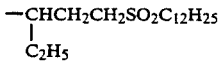
118
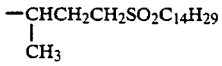
119
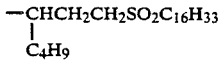
120
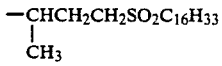
121
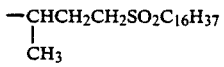
122
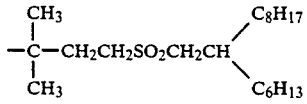
123
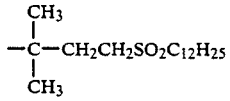
124
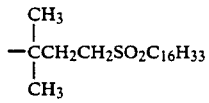

-continued
125
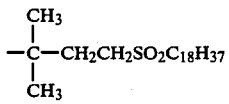
126
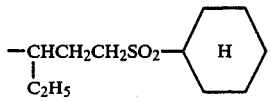
127
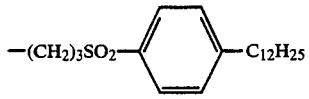
128
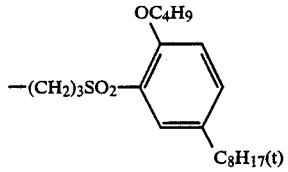
129
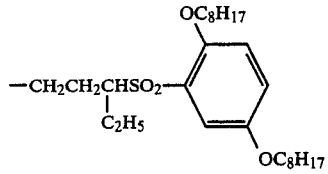
130
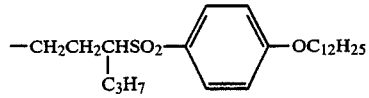
131
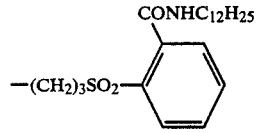
132
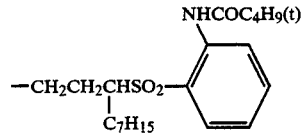
133
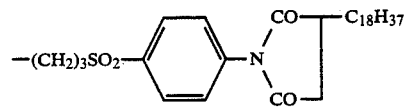
134
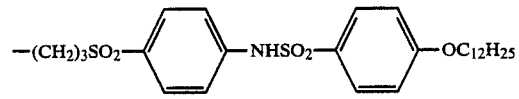
135
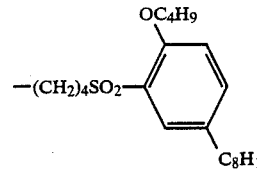

-continued
136
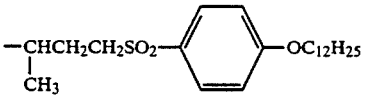
137
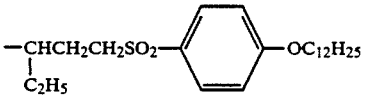
138
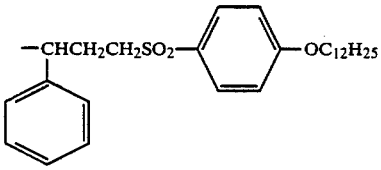
139
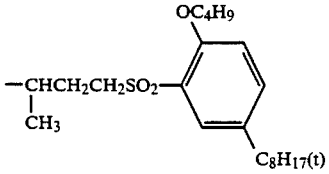
140
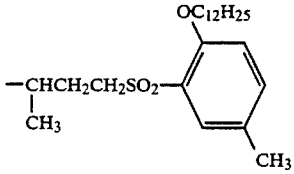
141
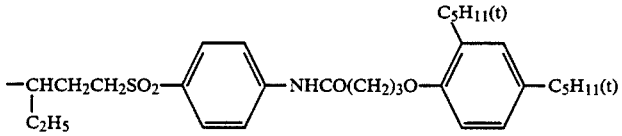
142
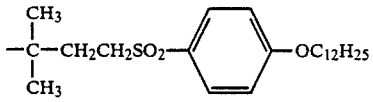
143
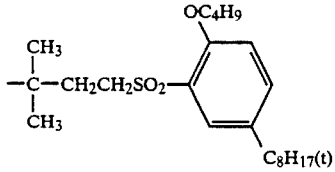
144
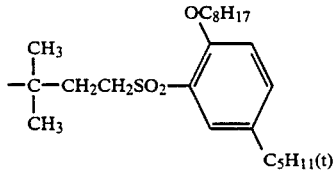
151
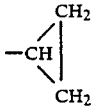
152
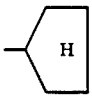

-continued
153
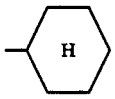
154
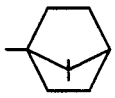
155
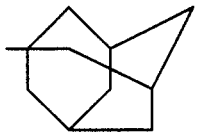
161
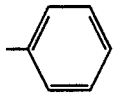
162
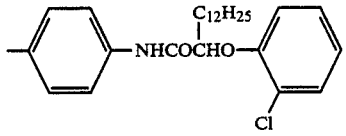
163
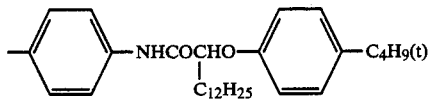
164
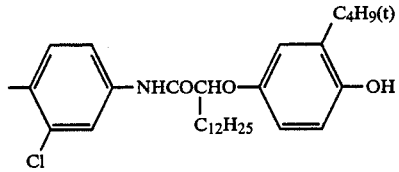
165
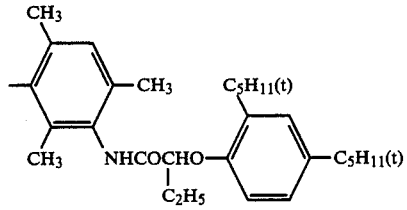
166
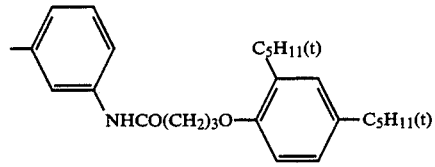
167
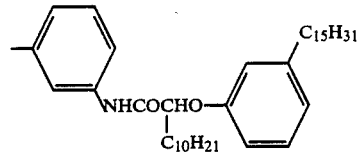

-continued
168
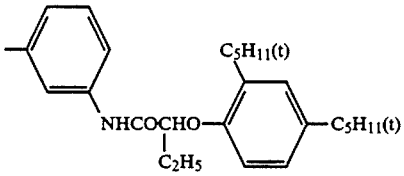
171
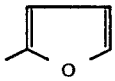
172 —CN
173 —$COCH_3$
174
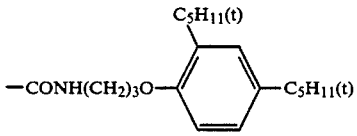
181
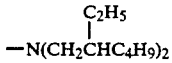
182
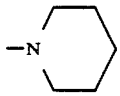
183
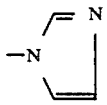
184
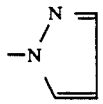
185
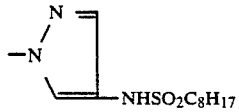
186
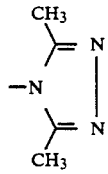
187
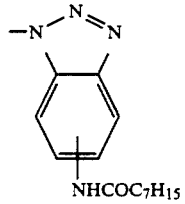
188
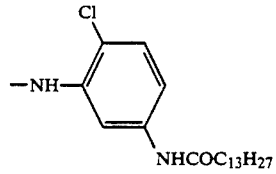

-continued
189
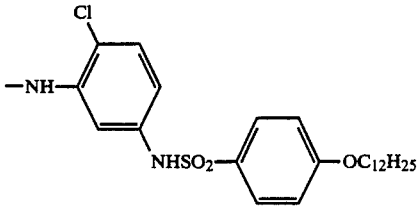
190 $-NHCOCF_3$
191 $-NHCOC_3F_7$
192 $-NHCO(CF_2)_8H$
193
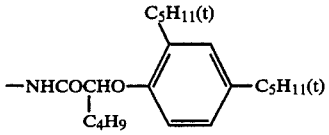
194
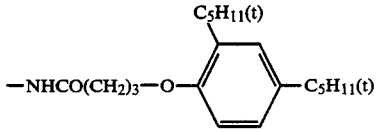
195
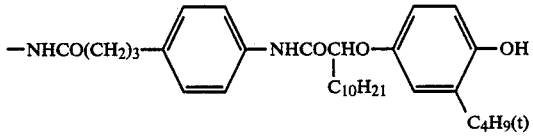
196
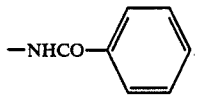
197
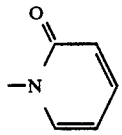
198
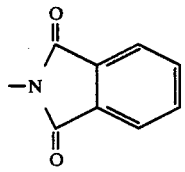
199
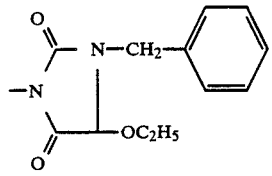
200
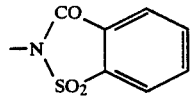

-continued
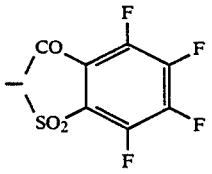
201
$-NHSO_2C_6H_{13}$ 202
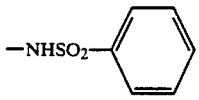
203
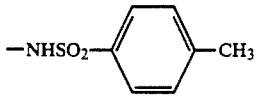
204
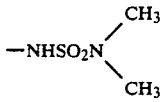
205
$-OCH_2CONHCH_2CH_2OCH_3$ 211
$-OC_2H_5$ 212
$-OCH_2CH_2SO_2CH_3$ 213
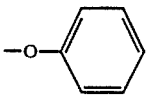
214
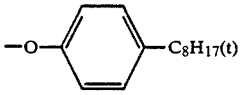
215
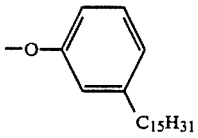
216
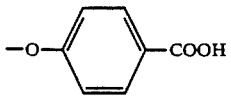
217
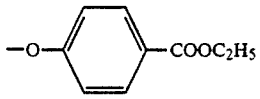
218
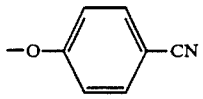
219
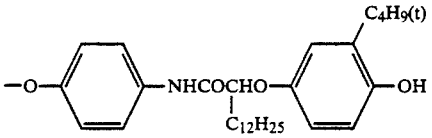
220

-continued

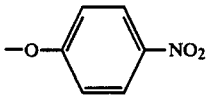

221

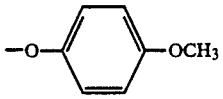

222

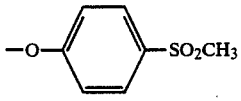

223

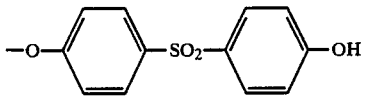

224

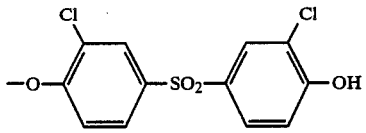

225

$-OCOC_{14}H_{29}$ 226

$-OSO_2CH_3$ 227

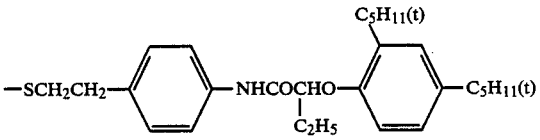

231

$-SC_8H_{17}$ 232

$-SC_{18}H_{37}$ 233

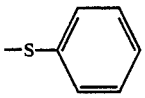

234

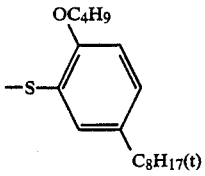

235

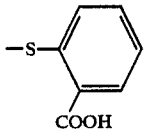

236

$-SO_2CH_3$ 237

$-SO_2C_{18}H_{37}$ 238

The above couplers were synthesized by referring to Journal of the Chemical Society, Perkin I (1977), pp. 2047-2052, U.S. Pat. No. 3,752,067, Japanese Provisional Patent Publications No. 99437/1984, No. 42045/1984, No. 162548/1984, No. 171956/1984, No. 33552/1985, No. 43659/1985, No. 172982/1985 and No. 190779/1985.

The coupler of the present invention can be used in an amount generally within the range of from $1\times10^{-3}$ mole to $5\times10^{-1}$ mole, preferably from $1\times10^{-2}$ to $5\times10^{-1}$ mole, per mole of the silver halide.

The coupler of the present invention can be used in combination with other kinds of magenta couplers.

As magenta couplers which may be combinedly used, there may be mentioned a pyrazolone series compounds, a pyrazolotriazole series compound, a pyrazolinobenzimidazole series compound and an indazolone type compound. The pyrazolone type magenta couplers may include the compounds disclosed in U.S. Pat. Nos. 2,600,788, 3,062,653, 3,127,269, 3,311,476, 3,419,391, 3,519,429, 3,558,318, 3,684,514 and 3,888,680, Japanese Provisional Patent Publications No. 29639/1974, No. 111631/1974, No. 129538/1974 and No. 13041/1975, Japanese Patent Publications No. 47167/1978, No. 10491/1979 and No. 30615/1980. The pyrazolotriazole type magneta couplers may include the couplers disclosed in U.S. Pat. No. 1,247,493 and Belgian Patent No. 792,525. As non-diffusion colored magenta couplers, there may be generally used the compounds arylazo-substituted at the coupling position of a colorless magenta coupler, which may include, for example, the compounds disclosed in U.S. Pat. Nos. 2,801,171, 2,983,608, 3,005,712 and 3,684,514, British Patent No. 937,612, Japanese Provisional Patent Publications No. 123625/1974 and No. 31448/1974.

In the color developing solution to be used in the present invention, further at least one compound selected from the formulae (II) and (III) shown below should be preferably contained.

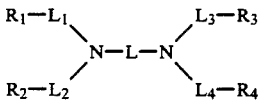

(II)

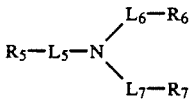

(III)

(in the formulae (II) and (III), L represents an alkylene group, a cycloalkylene group, a phenylene group, $-L_8-O-L_8-O-L_8-$ or $-L_9-Z-L_9-$ (where Z represents

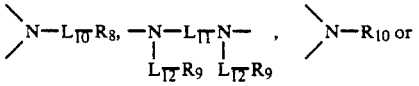

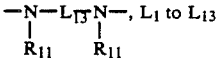

each represent an alkylene group, $R_1$ to $R_{11}$ each represent a hydrogen atom, a hydroxyl group, a carboxylic acid group (including its salt), or a phosphonic acid group (including its salt), provided that at least two of $R_1$ to $R_4$ are the carboxylic acid group (including its salt) or the phosphonic acid group (including its salt), and at least two of $R_5$ to $R_7$ are the carboxylic acid group (including its salt) or the phosphonic acid group (including its salt)).

The alkylene group, cycloalkylene group and phenylene group represented by L in the formulae (II) and (III), and the alkylene group represented by $L_1$ to $L_{13}$ include those having substitutents.

Next, preferable specific exemplary compounds represented by these formulae (II) and (III) are shown below.

| [Exemplary compounds] | |
|---|---|
| [II-1] | Ethylenediaminetetraacetic acid |
| [II-2] | Diethylenetriaminepentaacetic acid |
| [II-3] | Ethylenediamine-N-(β-oxyethyl)-N,N',N'-triacetic acid |
| [II-4] | Propylenediaminetetraacetic acid |
| [II-5] | Nitrilotriacetic acid |
| [II-6] | Cyclohexanediaminetetraacetic acid |
| [II-7] | Iminodiacetic acid |
| [II-8] | Dihydroxyethylglycinecitric acid (or tartaric acid) |
| [II-9] | Ethyl ether diaminetetraacetic acid |
| [II-10] | Glycol ether diaminetetraacetic acid |
| [II-11] | Ethylenediaminetetrapropionic acid |
| [II-12] | Phenylenediaminetetraacetic acid |
| [II-13] | Ethylenediaminetetraacetic acid disodium salt |
| [II-14] | Ethylenediaminetetraacetic acid tetra(trimethylammonium) salt |
| [II-15] | Ethylenediaminetetraacetic acid tetrasodium salt |
| [II-16] | Diethylenetriaminepentaacetic acid pentasodium salt |
| [II-17] | Ethylenediamine-N-(β-oxyethyl)-N,N',N'-triacetic acid sodium salt |
| [II-18] | Propylenediaminetetraacetic acid sodium salt |
| [II-19] | Nitrilotriacetic acid sodium salt |
| [II-20] | Cyclohexanediaminetetraacetic acid sodium salt |
| [III-1] | Nitrilotriacetic acid |
| [III-2] | Iminodiacetic acid |
| [III-3] | Nitrilotripropionic acid |
| [III-4] | Nitrilotrimethylenephosphonic acid |
| [III-5] | Iminodimethylenephosphonic acid |
| [III-6] | nitrilotriacetic acid trisodium salt |
| [III-7] | 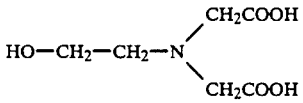 |
| [III-8] | 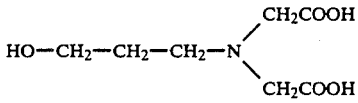 |
| [III-9] | 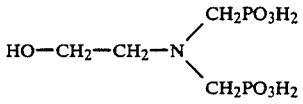 |
| [III-10] | 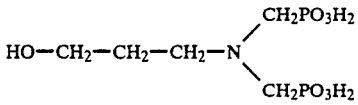 |

Of the chelating agents represented by the above formula (II) or (III), the compounds particularly preferably used from the point of the effect of the object of the present invention may include (II - 1), (II - 2), (II - 5), (II - 8), (II - 19), (III - 1) and (III - 4).

The amount of the chelating agent represented by the formula (II) or (III) may be preferably in the range of 0.1 to 20 g per liter of the color developing solution, particularly preferably in the range of 0.3 to 10 g, from the point of the object of the present invention.

In the color developing solution to be used in the present invention, it is further preferred to use at least one compound selected from the compounds represented by the formula (IV), the compounds represented by the formula (V), the compounds represented by the formula (VI) and the compounds represented by the formula (VII) shown below in combination.

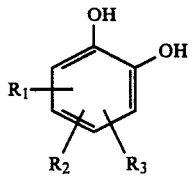

(IV)

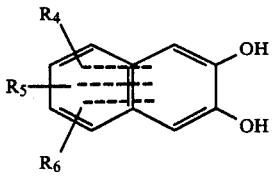

(V)

In the formulae, $R_1$, $R_2$, $R_3$, $R_4$, $R_5$ and $R_6$ each represent hydrogen atom, a halogen atom, a sulfonic acid group, an alkyl group having 1 to 7 carbon atoms, —$OR_7$, —$COOR_8$,

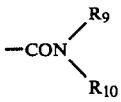

or a phenyl group. $R_7$, $R_8$, $R_9$ and $R_{10}$ each represent a hydrogen atom or an alkyl group havin 1 to 18 carbon atoms. However, when $R_1$ and $R_2$ represent —OH or a hydrogen atom, $R_3$ represents a hydrogen atom, a sulfonic acid group, an alkyl group having 1 to 7 carbon atoms, —$OR_7$, —$COOR_8$,
or a phenyl group.

As the alkyl group represented by the above $R_1$, $R_2$, $R_3$, $R_4$, $R_5$ and $R_6$, for example, there may be included a methyl group, an ethyl group, an iso-propyl group, an n-propyl group, a t-butyl group, an n0butyl group, a hydroxymethyl group, a hydroxyethyl group, a methylcarboxylic acid group, a benzyl group, etc. and the alkyl group represented by $R_7$, $R_8$, $R_9$ and $R_{10}$ has the same meaning as defined above, and further octyl group, etc. can be included.

Also, as the phenyl group represented by $R_1$, $R_2$, $R_3$, $R_4$, $R_5$ and $R_6$, a phenyl group, a 2-hydroxyphenyl group, a 4-aminophenyl group, etc. can be included.

Typical specific examples of the compounds represented by the above formulae (IV) and (V) are shown below, but the present invention is not limited thereto.

(IV - 1) 4-Isopropyl-1,2-dihydroxybenzene
(IV - 2) 1,2-Dihydroxybenzene-3.5-disulfonic acid
(IV - 3) 1,2,3-Trihydroxybenzene-5-carboxylic acid
(IV - 4) 1,2,3-Trihydroxybenzene-5-carboxymethyl ester
(IV - 5) 1,2,3-Trihydroxybenzene-5-carboxy-n-butyl ester
(IV - 6) 5-t-Butyl-1,2,3-trihydroxybenzene
(IV - 7) 1,2-Dihydroxybenzene-3,4,5-trisulfonic acid
(IV - 8) 1,2-Dihydroxybenzene-3,5,6-trisulfonic acid
(V - 1) 2,3-Dihydroxynaphthalene-6-sulfonic
(V - 3) 2,3,8-Trihydroxynaphthalene-6-sulfonic
(V - 3) 2,3-Dihydroxynaphthalene-6-carboxylic acid
(V - 4) 2,3-Dihydroxy-8-isopropyl-naphthalene
(V - 5) 2,3-Dihydroxy-8-chloro-naphthalene-6-sulfonic acid Of the above compounds, the compound particularly preferably employed in the present invention may be 1,2-dihydroxybenzene-3,5-disulfonic acid, which can be also used as an alkali metal salt such as sodium salt, potassium salt, etc.

In the present invention, the compound represented by the above formulae (IV) and (V) can be used in the range of 5 mg to 20 g per liter of the developing solution, and good results can be obtained by addition of preferably 10 mg to 10 g, more preferably 20 mg to 3 g.

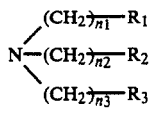

(VI)

(In the above formula (VI), $R_1$, $R_2$ and $R_3$ each represent a hydrogen atom, a hydroxy group, a carboxylic acid group (including its salt) or a phosphoric acid group (including its salt), provided that at least one of $R_1$, $R_2$ and $R_3$ is a hydroxyl group, and only either one of $R_1$, $R_2$ and $R_3$ is a carboxylic acid group (including its salt) or a phosphoric acid group (including its salt); and $n_1$, $n_2$ and $n_3$ each represent an integer of 1 to 3).

In the above formula (VI), $R_1$, $R_2$ and $R_3$ each represent a hydrogen atom, a hydroxy group, a carboxylic acid group (including its salt) or a phospholic acid group (including its salt). As the salt of the carboxylic acid group and the phosphoric acid group, for example, salts of alkali metal atoms, alkaline earth metal atoms, may be included, preferably salts of alkali metal atoms such as sodium, potassium, etc. Also, at least one of $R_1$, $R_2$ and $R_3$ is the hydroxyl group, and only either one of $R_1$, $R_2$ and $R_3$ is a carboxylic acid group (including its salt) or a phosphoric acid group (including its salt). $R_1$, $R_2$ and $R_3$ may be preferably selected respectively from the hydroxyl group, the carboxylic acid group (including its salt) or the phosphoric acid group (including its salt). $n_1$, $n_2$ and $n_3$ each represent an integer of 1 to 3.

In the following typical specific examples of the compounds represented by the formula (VI) are shown, which are not limitative of the present invention.

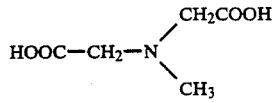

VI - 1

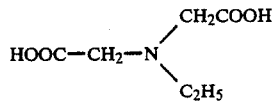

VI - 2

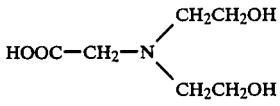

VI - 3

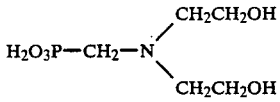

VI - 4

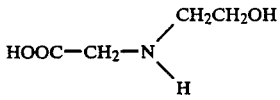

VI - 5

-continued

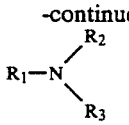

(VII)

In the formula (VII), $R_1$ is a hydroxyalkyl group having 2 to 6 carbon atoms, $R_2$ and $R_3$ each represent a hydrogen atom, an alkyl group having 1 to 6 carbon atoms, a hydroxyalkyl group having 2 to 6 carbon atoms, a benzyl group or a group of the formula:

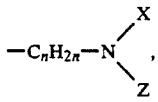

and n in the above formula represents an integer of 1 to 6, X and Z each represents a hydrogen atom, an alkyl group having 1 to 6 carbon atoms or a hydroxyalkyl group having 2 to 6 carbon atoms.

Of the compounds represented by the above formula (VII), particularly the compounds represented by the formula (VIIa) show below may preferably used.

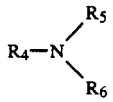

(VIIa)

In the formula (VIIa), $R_4$ represents a hydroxyalkyl group having 2 to 4 carbon atoms; and $R_5$ and $R_6$ each represent an alkyl group having 1 to 4 carbon atoms or a hydroxyalkyl group having 2 to 4 carbon atoms.

$R_1$ may be preferably a hydroxyalkyl group having 2 to 4 carbon atoms, $R_2$ and $R_3$ may be each preferably an alkyl group having 1 to 4 carbon atoms or an hydroxyl group having 2 to 4 carbon atoms.

Preferable specific examples represented by the above formula (VII) are as follows.

Ethanolamine, diethanolamine, triethaonolamine, di-isopropanolamine, 2-methylaminoethanol, 2-ethylaminoethanol, 2-dimethylaminoethanol, 2-diethylaminoethanol, 1-diethylamino-2-propanol, 3-diethylamino-1-propanol, 3-dimethylamino-1-propanol, isopropylaminoethanol, 3-amino-1-propanol, 2-amino-2-methyl-1,3-propanediol, ethylenediaminetetraisopropanol, benzyldiethanolamine, 2-amino-2-(hydroxymethyl)-1,3-propanediol.

These compounds represented by the above formulae (VI) and (VII) may be preferably used in amounts within the range of 3 g to 100 g per one liter of the color developing solution from the point of the effect of the object of the present invention, more preferably in the range of 6 g to 50 g.

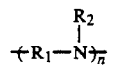

(VIII)

(wherein $R_1$ represents an alkylene group having 2 to 6 carbon atoms, $R_2$ represents an alkyl group and n represents an integer of 500 to 20,000).

The alkylene group having 2 to 6 carbon atoms represented by the above formula $R_1$ may be either straight or branched, preferably an alkylene group having 2 to 4 carbon atoms, such as an ethylene group, a propylene group, a butene group, an isobutene group, a dimethylethylene group, an ethylethylene group, etc. The alkyl group represented by $R_2$ may be preferably an alkyl group having 1 to 4 carbon atoms, such as a methyl group, an ethyl group, a propyl group, etc., and further includes those having substituents (e.g., a hydroxyl group, etc.). n represents the number of repeating units in the polymer chain, representing an integer of 500 to 20,000, preferably an integer of 500 to 2,000. The poly(ethyleneimine) where $R_1$ is a ethylene group is the most preferred for the object of the present invention.

In the following, specific examples of poly(alkyleneimine) represented by the formula (VIII) are shown, which are not limitative of the present invention.

EXEMPLARY COMPOUNDS

PAI - 1 Poly(ethyleneimine)
PAI - 2 Poly(propyleneimine)
PAI - 3 Poly(buteneimine)
PAI - 4 Poly(isobuteneimine)
PAI - 5 Poly(N-methylethyleneimine)
PAI - 6 Poly(N-β-hydroxyethylethyleneimine)
PAI - 7 Poly(2,2-dimethylethyleneimine)
PAI - 8 Poly(2-ethylethyleneimine)
PAI - 9 Poly(2-methylethyleneimine)

The poly(alkyleneimine) can be used in any desired amount in the color developing solution which can accomplish the object of the present invention, but generally used in the range preferably of 0.1 to 500 g, more preferably 0.5 g to 300 g, per one liter of the color developing solution.

The compound of the present invention represented by the above formula (I) may be used in combination with other preservatives, and examples of these preservatives which can be used in combination may include sodium sulfite, potassium sulfite, sodium bisulfite, potassium bisulfite, further bisulfite adducts or aldehydes or ketones, such as bisulfite adduct of formaldehyde, bisulfite adduct of glutaraldehyde, etc.

As the color developing agent to be used in the color developing solution of the present invention, p-phenylenediamine type compounds having water-soluble group may be preferably used for reducing coloration or color contamination.

A p-phenylenediamine type compound having water-soluble group not only has the advantage of no contamination of the light-sensitive material or difficult irritation of skin when attached on skin as compared with p-phenylenediamine compound having no hydroxyl group such as N,N-diethyl-p-phenylenediamine, etc., but also can be particularly combined with the compound represented by the formula (I) in the present invention to accomplish efficiently the object of the present invention.

The aforementioned water-soluble group may include an amino group of p-phenylenediamine type compound or at least one on benzene ring. Specific examples of water-soluble groups may include preferably $-(CH_2)_n-CH_2OH$, $-(CH_2)_m-NHSO_2-(CH_2)_n-CH_3$, $-(CH_2)_mO-(CH_2)_n-CH_3$, $-(CH_2CH_2O)_nC_mH_{2m+1}$ (wherein m and n each represent an integer of 0 or more), a —COOH group and a —$SO_3H$ group.
Specific exemplary compounds of the color developing agent preferably used in the present invention are shown below.
EXEMPLARY COLOR DEVELOPING AGENTS
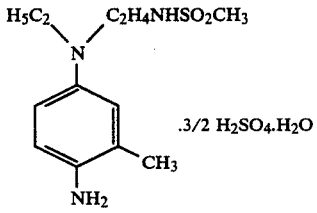
(A-1)
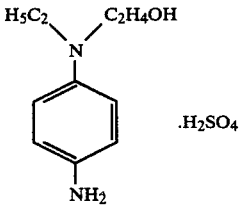
(A-2)
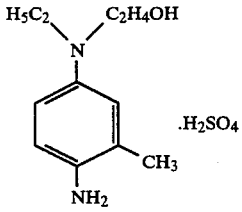
(A-3)
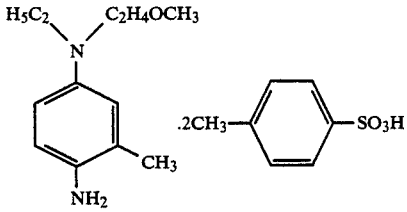
(A-4)
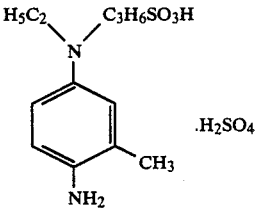
(A-5)
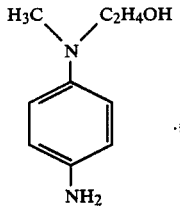
(A-6)
-continued
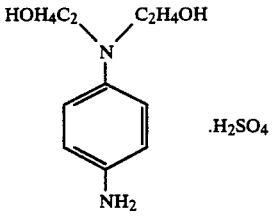
(A-7)
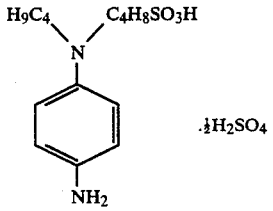
(A-8)
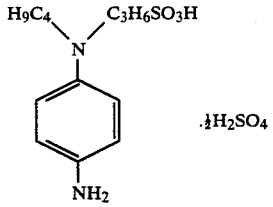
(A-9)
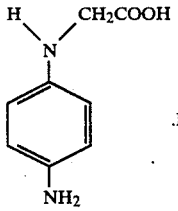
(A-10)
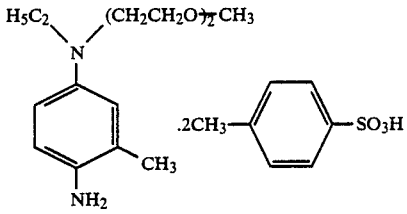
(A-11)
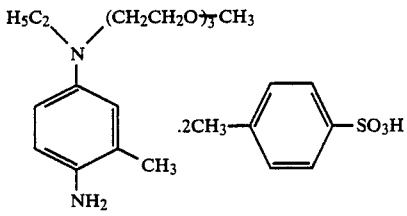
(A-12)
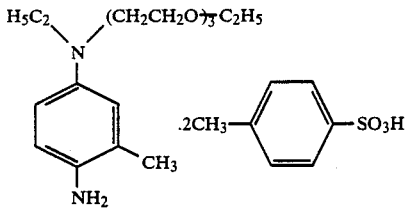
(A-13)

-continued

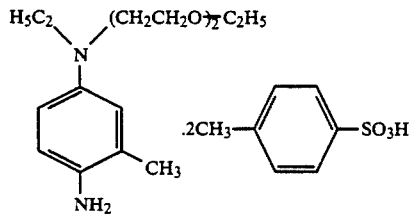

(A-14)

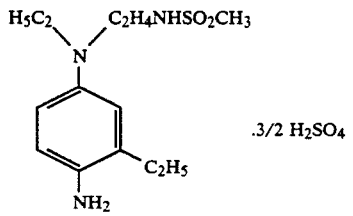

(A-15)

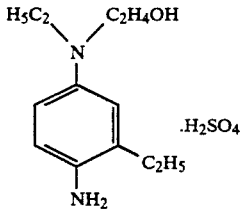

(A-16)

Among the color developing agents exemplified in the above, those which can be preferably used in the present invention as being free from generation of fog are compounds shown as exemplary Nos. (A-1), (A-2), (A-3), (A-4), (A-6), (A-7) and (A-15), and particularly preferred compound is No. (A-1).

The above color developing agents are generally used in the form of salts such as hydrochlorides, sulfate, p-toluenesulfonate, etc.

The color developing agent having a water-soluble group used in the present invention may be used preferably in the range of $1\times10^{-2}$ to $2\times10^{-1}$ mole per 1 liter of the color developing solution, more preferably from a viewpoint of the rapid processing, in the range of $1.5\times10^{-2}$ to $2\times10^{-1}$ mole per 1 liter of the color developing solution.

Also, the above color developing agent may be used either singly or as a combination of two or more kinds, or alternative, if desired, may be used in combination with a monochromatic developing agent such as phenidone, 4-hydroxymethyl-1-phenyl-3-pyrazolidone or Metol, etc.

Also, in place of using the above color developing agent in the color developing solution, the color developing agent may be added in the light-sensitive material, and the color developing agent to be used in that case may include dye precursors. Typical dye precursors may include those as described in Japanese Provisional Patent Publications No. 65429/1983, No. 24137/1983, etc. Specific examples may include 2',4'-bismethanesulfonamido-4-diethylaminodiphenylamine, 2'-methanesulfonamido-4'-(2,4,6-triisopropyl)benzenesulfonamido-2-methyl-4-N-(2-methanesulfonamidoethyl)ethylaminodiphenylamine, 2'-methanesulfonamido-4'-(2,4,6-triisopropyl)benzenesulfonamido-4-(hydroxytrisethoxy)diphenylamine, 4-N-(2-methanesulfonamidoethyl)ethylamino-2-methyl-2',4'-bis(2,4,6-triisopropyl)benzenesulfonamidodiphenylamine, 2,4'-bismethanesulfonamido-4-N,N-diethylaminodiphenylamine, 4-n-hexyloxy-2'-methansulfonamido-4'-(2,4,6-triisopropyl)benzenesulfonamidodiphenylamine, 4-methoxy-2'-methanesulfonamido-4'-(2,4,6-triisopropyl)benzenesulfonamidodiphenylamine, 4-dihexylamino-4'-(2,4,6-triisopropylbenzenesulfonamido)diphenylamine, 4-n-hexyloxy-3'-methyl-4'-(2,4,6-triisopropylbenzenesulfonamido)diphenylamine, 4-N,N-diethylamino-4'-(2,4,6-triisopropylbenzenesulfonamido)diphenylamine, 4-N,N-dimethylamino-2-phenylsulfonyl-4'-(2,4,6-triisopropylbenzenesulfonamido)diphenylamine, and the like.

The amount of the above dye precursor to be added in the light-sensitive material may be preferably 0.5 to 22 mg, more preferably 4 to 12 mg, per 100 $cm^2$ of the light-sensitive material.

In the present invention, by use of the triazylstilbene type fluorescent brightener shown by the formula (IX) shown below in the color developing solution according to the present invention, gamma of the cyan dye can be stabilized, whereby color contamination becomes preferably smaller.

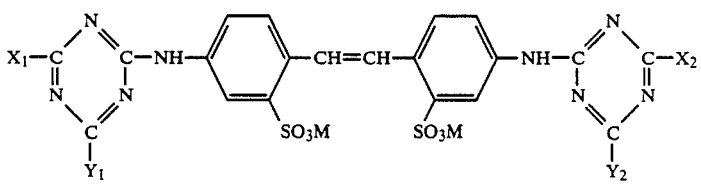

(IX)

In the formula, $X_1$, $X_2$, $Y_1$ and $Y_2$ each represent a hydroxy group, a halogen atom such as chlorine or bromine, a morpholino group, an alkoxy group (e.g., methoxy, ethoxy, methoxyethoxy, etc.), an aryloxy group (e.g., phenoxy, p-sulfophenoxy, etc.), an alkyl group (e.g., methyl, ethyl), an aryl group (e.g., phenyl, methoxyphenyl, etc.), an amino group, an alkylamino group (e.g., methylamino, ethylamino, propylamino, dimethylamino, cyclohexylamino, β-hydroxyethylamino, di(β-hydroxyethyl)amino, β-sulfoethylamino, N-(β-sulfoethyl)-N'-methylamino, N-(β-hydroxyethyl)-N'-methylamino, etc.), an arylamino group (e.g., anilino, o-, m-, p-sulfoanilino, o-, m-, p-chloroanilino, o-, m-, p-toluidino, o-, m-, p-carboxyanilino, o-, m-, p-hydroxyanilino, sulfonaphthylamino, o-, m-, p-aminoanilino, o-, m-, p-anizino, etc.). M represents a hydrogen atom, sodium, potassium, ammonium or lithium.

More specifically, the following compounds may be enumerated, but by no means limited to these.

Exemplary compounds
(A'-1)
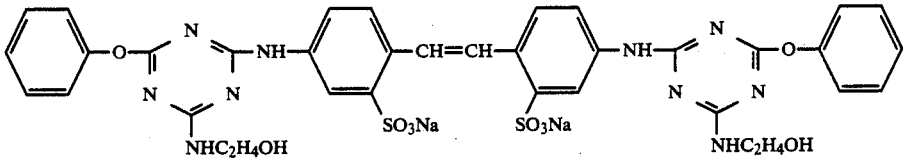
(A'-2)
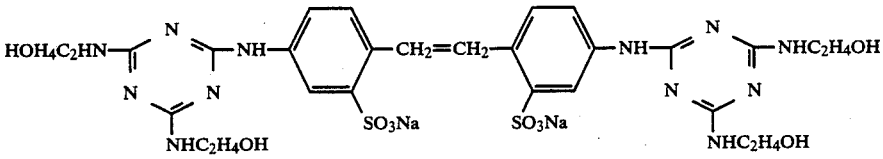
(A'-3)
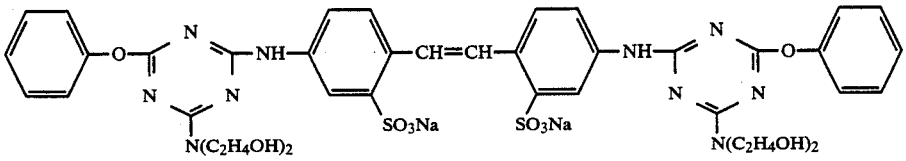
(A'-4)
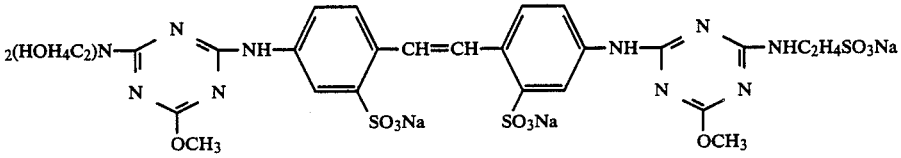
(A'-5)
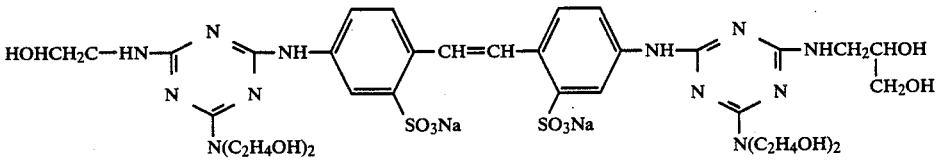
(A'-6)
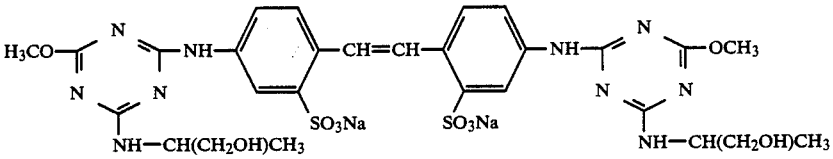
(A'-7)
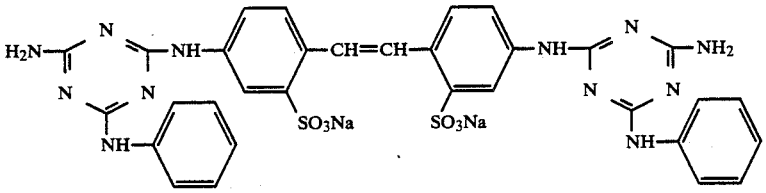
(A'-8)
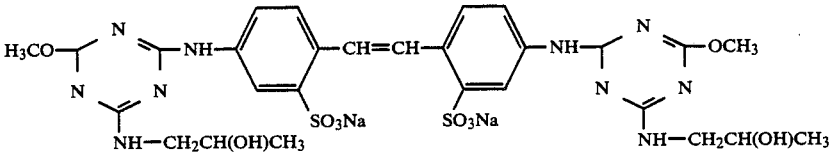
(A'-9)
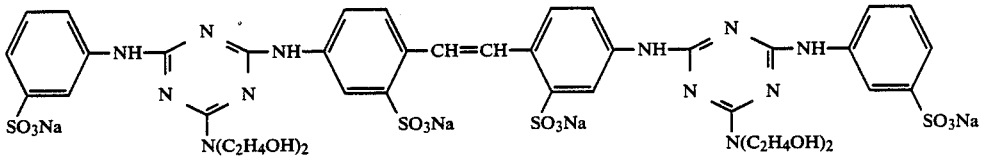

-continued

Exemplary compounds (A'-10)

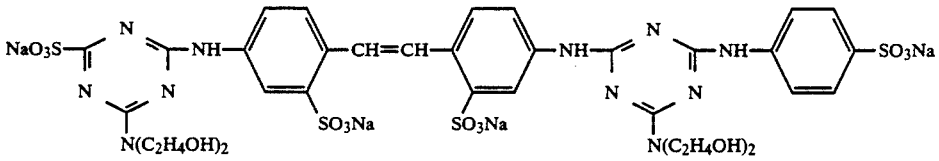

(A'-11)

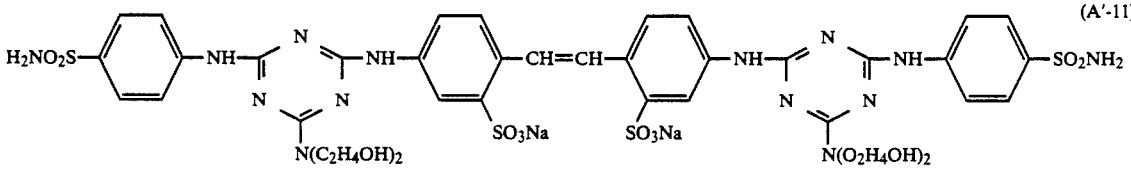

(A'-12)

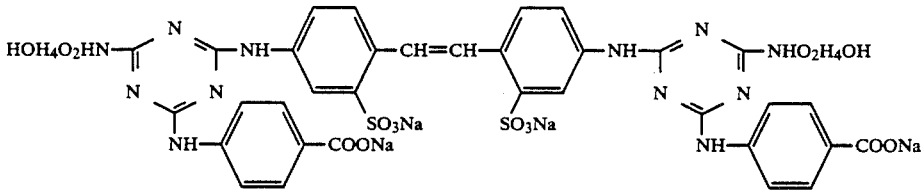

(A'-13)

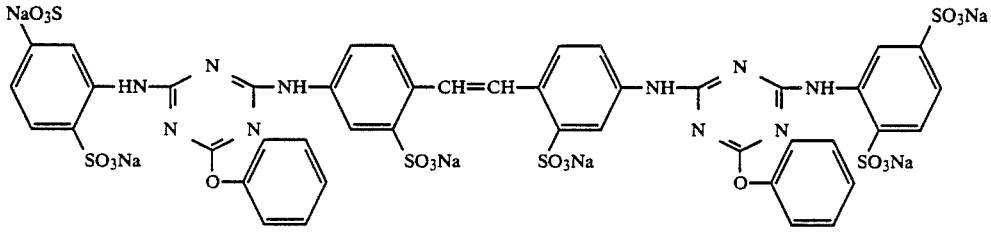

(A-14)

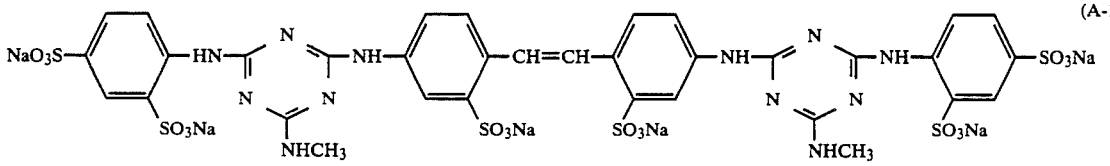

The triazylstilbene type fluorescent brightening agent represented by the formula (IX) can be synthesized by the conventional method as described in, for example, "Fluorescent brightening agent", edited by Association of Chemical Product Industry Kyokai (published on Aug., 1976), page 8.

These triazylstilbene type fluoroescent brightening agent is preferably used in the range of 0.2 to 6 g, particularly preferably 0.4 to 3 g per 1 liter of the color developing solution to be used in the present invention.

The color developing solution of the present invention may contain the following developing solution components, in addition to the above component.

As alkali agents other then the above carbonates, sodium hydroxide, potassium hydroxide, silicate, sodium metaborate, potassium metaborate, trisodium phosphate, tripotassium phosphate, borax, etc. may be used alone or in combination so far as the above effects of the present invention, namely, the effect of making the pH stable can be maintained. If necessary for the preparation of the solution, or for the purpose of increasing intensity of ions, there can be used a variety of salts such as disodium hydrogenphosphate, dipotassium hydrogenphosphate, sodium bicarbonate, potassium bicarbonate and borate.

Also, if necessary, an inorganic or organic antifoggant may be also added.

Also, a development accelerator can be also used, if desired. Such a developing accelerator may include every kind of pyridinium compounds as typified by those disclosed in U.S. Pat. Nos. 2,648,604 and 3,671,247 and Japanese Patent Publication No. 9503/1969 and other cationic compounds, cationic dyes such as phenosafranine, neutral salts such as thallium nitrate, polyethylene glycol or derivatives thereof disclosed in U.S. Pat. Nos. 2,533,990, 2,531,832, 2,950,970 and 2,577,127 and Japanese Patent Publication No. 9504/1969, nonionic compounds such as polythioethers, organic solvents disclosed in Japanese Patent Publication No. 9509/1969, or organic amines, ethanolamine, ethylenediamine, diethanolamine, triethanolamine, etc. It may also include benzyl alcohol, phenethyl alcohol, and bisides these, acetylene glycol, methyl ethyl ketone, cyclohexane, thioethers, pyridine, ammonia, hydrazine, amines, etc. disclosed in U.S. Pat. No. 2,304,925.

In the above, the poor solubility organic solvent particularly typified by benzyl alcohol tends to cause appearance of tar after use of the color developing solution for a long period of time, particularly during the running processing according to a low replenishing system. Appearance of such tar, when appeared in the neighborhood of a paper light-sensitive material to be processed, may even bring about such a serious trouble that a commercial value of the product is extremely damaged.

Also, since the poor solubility organic solvent has poor solubility to water, there is not only a cumbersomeness that a stirring instrument is needed to prepare the color developing solution itself, but also a limit to the development accelerating effect due to the badness of its solbility rate even with use of such a stirring instrument.

Further, the poor solubility organic solvent does have problems such that it has a great value for the burden to environmental pollution such as biochemical oxygen demand (BOD), and cannot be abandoned in sewerages, rivers or the like, so that much labor and cost are needed for waste liquor disposal. Accordingly, it is preferably used in a decreased amount, or not used.

In the color developing solution of the present invention, if necessary, ethylene glycol, methyl cellosolve, methanol, acetone, dimethylformamide, β-cyclodextrin and other compounds disclosed in Japanese Patent Publications No. 33378/1972 and No. 9509/1969 can be used as an organic solvent for increasing the dissolving degree of a developing agnet.

Moreover, an auxiliary developing agent can be used together with the developing agent. Such an auxiliary developing agent is known to include, for example, N-methyl-p-aminophenol hexasulfate (Metol), phenidone, N,N'-diethyl-p-aminophenol hydrochloride, N,N,N'N'-tetramethyl-p-phenylenediamine hydrochloride, and may be added usually in an amount of 0.01 g to 1.0 g/l. Besides these, if necessary, there can be further added competing couplers, fogging agents, colored couplers, development restrainer-releasing type couplers (the so-called DIR couplers) or development restrainer-releasing compounds.

Further, other various additives such as stain preventives, sludge preventives, overlaying effect accelerators, etc. can be used.

The respective components of the above color developing solution can be prepared by adding with stirring into a certain quantity of water successively. In this case, the components with lower solubility in water can be added as mixed with the above orgaic solvent such as triethanolamine. Also, more generally, a mixture of a plurarity of components that can be stably present together with each other, prepared in the form of a concentrated aqueous solution or a solid, may be added in water and stirred to obtain a solution as the color developing solution of the present invention.

In the present invention, the above color developing agent can be used in a desired pH range, and generally in the range of pH 8 or more, but, from a viewpoint of rapid processing, preferably in the range of pH 9.5 to 13.0, more preferably pH 9.8 to 13.0.

In the present invention, the color developing processing temperature may be not lower than 30° C. and not higher than 50° C., within which the higher it is, the more preferably it becomes possible to carry out rapid processing in a short time, but, from a view point of image preservation stability, the temperature should not be so high. Thus, the processing is preferably carried out at not lower than 33° C. and not higher than 45° C.

In general, the color developing is conventionally carried out in about 3 minutes and 30 seconds, but, in the present invention, it can be carried out in 2 minutes or less, or can be also carried out in the range of 30 seconds to 1 minute and 30 seconds.

In the present invention, the method can be applicable for any system which employes the color developing solution containing the compound of the present invention represented by the formula (I). For example, other various methods, typically one bath process, for example, various processing systems such as spraying system in which the processing solution is atomized, or the Webb system through contact with the carrier impregnated with the processing solution, or the developing method with a viscous processing solution, etc. However, the processing steps comprise substantially the steps of color developing, bleach-fixing, water washing or stabilizing processing as substitute for the water washing.

The bleach-fixing step may be either a bleach-fixing bath in which the bleaching step and the fixing steps are separately provided or a bleaching-fixing bath in which bleaching and fixing are processed in one bath.

The bleaching agent which can be used in the bleach-fixing solution to be used in the present invention is a metal complex of an organic acid. Sais complex comprises an organic acid such as aminopolycarboxylic acid or oxalic acid, citric acid, etc. having metal ions such as iron, cobalt, copper, etc. coordinated. As the most preferable organic acid to be used for formation of such a metal complex of organic acid, polycarboxylic acids may be included. These polycarboxylic acids or aminopolycarboxylic acids may be alkali metal salts, ammonium salts or water-soluble amine salts. Typical examples of these may be included those as shown below.

[1] Ethylenediaminetetraacetic acid
[2] Diethylenetriaminepentaacetic acid
[3] Ethylenediamine-N-(β-oxyethyl)-N,N',N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartaric acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Ethylenediaminetetraacetic acid disodium salt
[14] Ethylenediaminetetraacetic acid tetra(trimethylammonium) salt
[15] Ethylenediaminetetraacetic acid tetrasodium salt
[16] Diethylenetriaminepentaacetic acid pentasodium salt
[17] Ethylenediamine-N-(β-oxyethyl)-N,N',N'-triacetic acid sodium salt
[18] Propylenediaminetetraacetic acid sodium salt
[19] Nitrilotriacetic acid sodium salt
[20] Cyclohexanediaminetetraacetic acid sodium salt These bleaching agents may be used in amounts of 5 to 450 g/l, more preferably 20 to 250 g/l. For bleach-fixing solution is applied a solution with a composition containing, in addition to the bleaching agent as mentioned above, a silver halide fixing agent, and also a sulfite as the preservative, if desired. Also, a bleach-fixing solution comprising a composition of iron (III) ethylenediaminetetraacetate complex salt bleaching agent and a halide such as ammonium bromide other than the silver halide fixing agent as described above added in a small amount, or a bleach-fixing solution comprising a composition having contrariwise a large amount of a halide such as ammonium bromide therein, or further a special bleach-fixing solution with a composition comprising a combination of iron (III) ethylenediaminetetraacetate complex salt bleaching agent and a large amount of a halide such as ammonium bromide, etc. can be also used. As the above halide, other than ammonium bromide, hydrochloric acid, hydrobromic acid, lithium bromide, sodium bromide, potassium bromide, sodium iodide, potassium iodide, ammonium iodide, etc. can also be used.

As the above silver halide fixing agent to be contained in the bleach-fixing solution, there may be included compounds capable of reacting with a silver halide conventionally used for fixing processing to form water-soluble complex salts, for example, thiosulfates such as potassium thiosulfate, sodium thiosulfate and ammonium thiosulfate; thiocyanates such as potassium thiocyanate, sodium thiocyanate and ammonium thiocyanate; thioureas; thioethers; etc. as representative ones. These fixing agents may be used in an amount within the range which can be dissolved of 5 g/l or more, generally 70 g/l to 250 g/l.

In the bleach-fixing solution, various pH buffers such as boric acid, borax, sodium hydroxide, potassium hydroxide, sodium carbonate, potassium carbonate, sodium bicarbonate, potassium bicarbonate, acetic acid, sodium acetate and ammonium hydroxide may be contained either individually or as a combination of two or more kinds. Further, various fluorescent brighteners, deforming agent or surfactants can be contained. Also, preservatives such as bisulfate addition products of hydroxylamine, hydrazine or an aldehyde compound, organic chelating agents such as aminopolycarboxylic acid or stabilizers such as nitroalcohol and nitrate, and organic solvents such as methanol, dimethylsulfonamide and dimethylsulfoxide, can be conveniently contained.

In the bleach-fixing solution used in the present invention, various bleaching accelerators as disclosed in Japanese Provisional Patent Publication No. 280/1971, Japanese Patent Publications No. 8506/1970 and No. 556/1971, Belgian Patent No. 770,910, Japanese Patent Publications No. 8836/1970 and No. 9854/1978, Japanese Provisional Patent Publications No. 71634/1979 and No. 42349/1974, etc. can be added.

The bleach-fixing solution may be used at the pH of 4.0 or higher, generally at the pH of not less than 5.0 and not more than 9.5, more preferably at the pH of not less than 6.0 and not more than 8.5, and still more preferably at the pH of not less than 6.5 and not more than 8.5. The processing temperature to be used may be a temperature of not lower than 3° C., preferably not lower than 5° C., lower than the processing temperature in a color developing tank, and, desirably, a temperature of not lower than 55° C. while suppressing evaporation or the like.

In the present invention, subsequent to the above color developing and bleach-fixing steps, water washing or stabilizing processing substituting for water washing is applied.

In the following, the stabilizing solution substituting for water washing applicable for the present invention it to be explained.

The pH of the stabilizing solution substituting for water washing applicable for the present invention is within the range of 5.5 to 10.0, more preferably within the range of pH 6.3 to 9.5, particularly preferably within the range of 7.0 to 9.0. The pH controller which can be contained in the stabilizing solution substituting for water washing applicable for there present invention may be any of alkali agents or acid agents generally known in the art.

The processing temperature for stabilizing processing may be 15° C. to 60° C., preferably in the range from 20° C. to 45° C. Also, the processing time should preferably be as short as possible from the standpoint of rapid processing, but generally 20 seconds to 10 minutes, most preferably 1 minute to 3 minutes, and in the case of a multi-tank stabilization processing, the earlier stage should be processed within shorter time and the later tank within longer time. Particularly, successive processing with increased processing time by 20% to 50% of that in the prededing steps is desirable. After the stabilizing processing applicable for the present invention, no water washing processing is required at all, but rinsing or surface washing with a small amount of water within a very short time can be optionally practiced, if desired.

The method for supplying stabilizing solution substituting for water washing in the stabilizing processing step applicable for the present invention may be preferably one in which the solution is fed to the later bath and permitted to be overflowed from the previous bath in the case of a multi-tank counter-current system. Of course, processing with a single tank is possible. As the method for adding the above compound, it may be added as a concentrated solution in the stabilizing tank, or alternatively, the above compound and other additives may be added into the stabilizing solution substituting for water washing, which is then used as the solution to be supplied to the stabilizing supplemental solution substituting for water washing, or other various methods may be employed. It may be added according to any desired addition method.

Thus, in the present invention, processing with a stabilizing solution substituting for water washing refers to processing for stabilizing processing in which stabilizing processing is practiced immediately after processing with a bleach-fixing solution substantially without performing water washing processing, and the processing solution used for said stabilizing processing is called stabilizing solution substituting for water washing, and the processing tank stabilizing bath or stabilizing tank.

The effect of the present invention is great when the number of the stabilizing processing applicable for the present invention is 1 to 5, particularly preferably 1 to 3, preferably at most not more than 9.

The crystal of the silver halide grain to be used in the present invention may be normal crystal, twin crystal or others, and one with any desired ratio of the {100} plane to {111} plane can be used.

Further, the crystal structure of these silver halide grains may be either uniform from the inner portion to the outer portion, or of a layered structure in which the inner portion and the outer portion are heterogeneous (core-shell type).

Also, these silver halides may be either of the type in which latent image is formed primarily on the surface or of the type in which latent image is formed primarily internally of the grain. Further, flat silver halide grains (see Japanese Provisional Patent Publication Nos. 113934/1983 and 47959/1986) can also be used.

The silver halide grains to be used in the present invention may be obtained by any preparative methods including an acidic method, a neutral method and an ammoniacal method.

Also, seed grains may be prepared according to an acidic method, which are allowed to grow according to an ammoniacal method that can achieve higher growth rate, until they grow to have given size. When growing the silver halide grains, it is preferable to control the pH and pAg in a reaction vessel, and pouring and mixing silver ions and halide ions successively or simultaneously in the amount corresponding to the growth rate of silver halide grains as disclosed in, for example, in Japanese Provisional Patent Publication No. 48521/1978.

Preparation of the silver halide grains according to the present invention should be preferably practiced as described above. The composition containing said silver halide grains is called silver halide emulsion in the present specification.

The silver halide emulsion may be chemically sensitized by using active gelatin; sulfur sensitizer, for example, thiourea and cystine; selenium sensitizer; reduction sensitizer, for example stunnous salts, thiourea dioxide, polyamine, etc.; noble metal sensitizer, for example, gold sensitizer, specifically including sensitizer such as potassium aurothiocyanate, potassium chloroaurate and 2-aurothio-3-methylbenzothiazolium chloride, or sensitizing agents having a water soluble group, for example, ruthenium, palladium, platinum, rhodium, iridium, etc., specifically including ammonium chloropalladate, potassium chloroplatinate and sodium chloropalladate (Some of these act as a sensitizer or a fog-suppressing agent depending on whether they are in a large amount or a small amount.), etc., which may be used alone or in appropriate combination (for example, combination of a gold sensitizer with a sulfur sensitizer, combination of a gold sensitizer with a selenium sensitizer, etc.).

The silver halide emulsion according to the present invention may be subjected to chemical ripening by adding a sulfur-containing compound, and, before such chemical ripening, during the ripening, or after the ripening, at least one of hydroxytetrazaindenes and at least one of nitrogen-containing heterocyclic compounds having a mercapto group may be contained.

The silver halide used in the present invention may be optically sensitized by adding a suitable sensitizing dye in an amount of $5\times10^{-8}$ mole to $3\times10^{-3}$ mole per mole of silver halide so that sensitivities to respectively desired light-sensitive wavelength regions can be imparted thereto. There can be various types of sensitizing dyes, which sensitizing dyes can be used alone or in combination with two or more of them. The sensitizing dyes advantageously used in the present invention may include, for example, the following:

That is, sensitizing dyes to be used in a blue-sensitive silver halide emulsion may include, for example, those disclosed in West German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, Japanese Patent Publication Nos. 14033/1969 and 24844/1977, etc. Sensitizing dyes to be used in a green-sensitive silver halide emulsion may typically include, for example, cyanine dyes, merocyanine dyes or composite cyanine dyes disclosed in U.S. Pat. Nos. 1,939,201, 2,072,908, 2,739,149 and 2,945,763, British Patent No. 505,979, etc. Further, sensitizing dyes to be used in a red-sensitive silver halide emulsion may typically include, for example, cyanine dyes, merocyanine dyes or composite cyanine dyes disclosed in U.S. Pat. Nos. 2,269,234, 2,270,378, 2,442,710, 2,454,629 and 2,776,280, etc. Still further, the cyanine dyes, merocyanine dyes or composite cyanine dyes as disclosed in U.S. Pat. Nos. 2,213,995, 2,493,748 and 2,519,001, West German Patent No. 929,080 can be advantageously used in the green-sensitive silver halide emulsion or the red-sensitive silver halide emulsion.

These sensitizing dyes may be used alone or in combination of these.

If necessary, the light-sensitive photographic material of the present invention may be optically sensitized a desired wavelength region according to a spectral sensitization method by using a cyanine dye or a merocyanine dye alone or in combination.

A particularly preferable spectral sensitization method may typically include the methods disclosed in Japanese Patent Publication Nos. 4936/1968, 22884/1968, 18433/1970, 37433/1972, 28293/1973, 6209/1974 and 12375/1978, Japanese Provisional Patent Publication Nos. 23931/1977, 51932/1977, 80118/1979, 153926/1983, 116646/1984 and 116647/1984, etc., which are concerned with the combination of benzimidazolocarbocyanine with benzoxazolocarbocyanine.

Those concerned with the combination of carbocyanine having a benzimidazole nucleus with other cyanines or merocyanines may include, for example, those disclosed in Japanese Patent Publication Nos. 25831/1970, 11114/1972, 25379/1972, 38406/1973, 38407/1973, 34535/1979 and 1569/1980, Japanese Provisional Patent Publication Nos. 33220/1975, 38526/1975, 107127/1976, 115820/1976, 135528/1976 and 104916/1977 and 104917/1977, etc.

Those concerned with the combination of benzoxazolocarbocyanine (oxa-carboxyanine) with other carbocyanines may include, for example, those disclosed in Japanese Patent Publication Nos. 32753/1969 and 11627/1971, Japanese Provisional Patent Publication No. 1483/1982, etc., and those concerned with merocyanine may include, for example, those disclosed in Japanese Patent Publication Nos. 38408/1973, 41204/1973 and 40662/1975, Japanese Provisional Patent Publication Nos. 25728/1981, 10753/1983, 91445/1983, 116645/1984 and 33828/1975, etc.

Also, the methods concerned with the combination of thiacarbocyanine with other carbocyanines may include, for example, those disclosed in Japanese Patent Publication Nos. 4932/1968, 4933/1968, 26470/1970, 18107/1971 and 8741/1972, Japanese Provisional Patent Publication No. 114533/1984, etc., and the methods disclosed in Japanese Patent Publication No. 6207/1974, employing zeromethine- or dimethinemerocyanine, monomethine- or trimethinecyanine and styryl dyes, can be advantageously used.

For adding these sensitizing dyes into the silver halide emulsion according to the present invention, they are used as a dye solution obtained by previously dissolving them in a hydrophilic solvent such as methyl alcohol, ethyl alcohol, acetone, dimethylformamide and fluorinated alcohol disclosed in Japanese Patent Publication No. 40659/1975, etc.

They may be added at any time at the initiation of chemical ripening of the silver halide emulsions, during the ripening, or after completion of the ripening, or in some cases, at the step right before the coating of the emulsion.

Dyes that are water soluble or decolored by a color developing solution (AI dyes) may be added to photographic constituent layers of the light-sensitive silver halide color photographic material of the present invention. The AI dyes may include oxonol dyes and merocyanine dyes and azo dyes. Among them, particularly useful are oxonol dyes, hemioxonol dyes and merocyanine dyes. Examples of the AI dyes may include those disclosed in British Patent Nos. 584,609 and 1,277,429, Japanese Provisional Patent Publication Nos. 85130/1973, 99620/1974, 114420/1974, 129537/1974, 108115/1977, 25845/1984, 111640/1984 and 111641/1984, U.S. Pat. Nos. 2,274,782, 2,533,472, 2,956,079, 3,125,448, 3,148,187, 3,177,078, 3,247,127, 3,260,601, 3,540,887, 3,575,704, 3,653,905, 3,718,472, 4,071,312 and 4,070,352.

In general, these AI dyes may be used preferably in an amount of $2\times10^{-3}$ to $5\times10^{-1}$ mole, more preferably $1\times10^{-2}$ to $1\times10^{-1}$ mole, per mole of silver in an emulsion layer.

In the silver halide emulsion layers according to the present invention, respective couplers, namely compounds capable of forming dyes through the reaction with the oxidized product of the color developing agent can be contained.

As the above coupler which can be used in the present invention, various yellow couplers, magenta couplers and cyan couplers can be used without any limitation. These couplers may be either the so-called di-equivalent type or tetra-equivalent type couplers, and diffusible dye release type couplers, etc. can be also used by combination of these couplers.

Of the couplers for photography to be used in the present invention, cyan couplers are those cyan couplers as described above.

As magenta couplers for photography, there may be mentioned a pyrazolone series compounds, a pyrazolotriazole series compound, a pyrazolinobenzimidazole series compound and an indazolone type compound. The pyrazolone type magenta couplers may include the compounds disclosed in U.S. Pat. Nos. 2,600,788, 3,062,653, 3,127,269, 3,311,476, 3,419,391, 3,519,429, 3,558,318, 3,684,514 and 3,888,680, Japanese Provisional Patent Publication Nos. 29639/1974, 111631/1974, 129538/1974 and 13041/1975, Japanese Patent Publication Nos. 47167/1978, 10491/1979 and 30615/1980. The pyrazolotriazole type magneta couplers may include the couplers disclosed in U.S. Pat. No. 1,247,493 and Belgian Patent No. 792,525. As non-diffusion colored magenta couplers, there may be generally used the compounds arylazo-substituted at the coupling position of a colorless magenta coupler, which may include, for example, the compounds disclosed in U.S. Pat. Nos. 2,801,171, 2,983,608, 3,005,712 and 3,684,514, British Patent No. 937,612, Japanese Provisional Patent Publication Nos. 123625/1974 and 31448/1974.

Further, there may also be used a colored magenta coupler of the type of which the dye elutes out in the processing solution by the reaction with an oxidized product of the color developing agent, as described in U.S. Pat. No. 3,419,391.

As the yellow coupler for photography, while there have conventionally been used open-chain ketomethine compounds, a benzoylaceanilide type yellow coupler and a pyvaloylacetanilide type yellow coupler, which have generally and widely been employed, may be used in the present invention. There may be advantageously be employed a two equivalent type yellow coupler in which the carbon atom at the coupling site has been substituted by a substituent which is eliminatable at the time of coupling reaction. These examples have been described, together with their synthesis methods, in U.S. Pat. Nos. 2,875,057, 3,265,506, 3,664,841, 3,408,194, 3,277,155, 3,447,728 and 3,415,652, Japanese Patent Publication No. 13576/1974, Japanese Provisional Patent Publication Nos. 29432/1973, 68834/1973, 10736/1974, 122335/1974, 28834/1975 and 132926/1975.

The amount of the above-mentioned non-diffusible to be used in the present invention may generally be in the range of 0.05 to 2.0 moles per one mole of silver in the light-sensitive silver halide emulsion.

In the present invention, other than the above diffusion resistant couplers, DIR couplers may be preferably used.

Further, other than DIR compounds, compounds capable of releasing development inhibitors with development are also included in the present invention, as exemplified by those described in U.S. Pat. Nos. 3,297,445 and 3,379,529, West Germany Patent Publication (OLS) No. 2,417,914, Japanese Provisional Patent Publication Nos. 15271/1977, 9116/1987, 123838/1984 and 127038/1984.

The DIR compound to be used in the present invention is a compound capable of releasing a development inhibitor through the reaction with the oxidized product of a color developing agent.

Representative of such DIR compounds are DIR couplers having groups capable of forming compounds having development inhibiting action when eliminated from the active point introduced into the active point of the coupler, as exemplified by those described in GB Patent No. 935,454, U.S. Pat. Nos. 3,227,554, 4,095,984 and 4,149,886.

The above DIR coupler has the property that the coupler mother nucleus forms a dye, while releasing a development inhibitor, when subjected to the coupling reaction with oxidized product of the color developing agent. Also, in the present invention, there are included the compounds which release development inhibitors but do not form dyes when subjected to the coupling reaction with the oxidized product of a color developing agent, as described in U.S. Pat. Nos. 3,652,345, 3,928,041, 3,958,993, 3,961,959 and 4,052,213, Japanese Provisional Patent Publication Nos. 110529/1978, 13333/1979 and 161237/1980.

Further, the so-called timing DIR compounds are also included in the present invention, which are compounds of which mother nucleus forms a dye or a colorless compound, while the timing group eliminated is a compound capable of releasing a development inhibitor through intramolecular nucleophilic substitution reaction or elimination reaction, when reacted with the oxidized product of a color developing agent, as described in Japanese Provisional Patent Publication Nos. 145135/1979, 114946/1981 and 154234/1982.

Also, the present invention includes the timing DIR compounds in which the timing group as described above is bound to the coupler nucleus capable of forming a completely diffusible dye when reacted with the oxidized product of a color developing agent as described in Japanese Provisional Patent Publication Nos. 160954/1983 and 162949/1983.

The amount of the DIR compound contained in the light-sensitive material may be preferably within the range preferably of $1\times10^{-4}$ mole to $10\times10^{-3}$ mole per one mole of silver.

The light-sensitive silver halide color photographic material to be used in the present invention can incorporate other various additives for photography. For example, it is possible to use antifoggants, stabilizers, UV-ray absorbers, color contamination preventives, fluorescent brighteners, color image fading preventives, antistatic agents, film hardeners, surfactants, plasticizers, humectants, etc. as disclosed in Research Disclosure No. 17463.

In the light-sensitive silver halide color photographic material to be used in the present invention, the hydrophilic colloid to be used for preparation of emulsion may include any of gelatin, gelatin derivatives, graft polymers with gelatin, other polymers, albumin, proteins such as casein, etc. cellulose derivatives such as hydroxyethylcellulose derivatives, carboxymethylcellulose, etc., starch derivatives, single or copolymeric synthetic hydrophilic polymers such as polyvinyl alcohol, polyvinyl imidazole, polyacrylamide, etc.

As the support for the light-sensitive silver halide color photographic material to be used in the present invention, there may be included, for example, baryta paper, polyethylene-coated paper, polypropylene synthetic paper, transparent support having provided a reflection layer provided in combination or using a reflective member in combination, such as glass plate, cellulose acetate, cellulose nitrate or a polyester film such as polyethylene terephthalate, etc., polyamide film, polycarbonate film, polystyrene film, etc., or otherwise conventional transparent supports may be available. These supports may be selected appropriately depending on the purpose of use of the light-sensitive material.

For coating of the silver halide emulsion layer and other photographic constituent layers to be used in the present invention, various coating methods such as dipping coating, air doctor coating, curtain coating, hopper coating, etc. can be used. Also, the simultaneous coating method of two or more layers according to the method described in U.S. Pat. Nos. 2,761,791 and 2,941,898 can be used.

In the present invention, the coating position of each emulsion can be determined as desired. For example, in the case of a light-sensitive material for printing paper of full color, it is preferable to arrange successively the blue-sensitive silver halide emulsion layer, the green-sensitive emulsion layer and the red-sensitive emulsion layer from the support side. These light-sensitive emulsion layers may each comprise two or more layers.

In the light-sensitive material of the present invention, an intermediate layer with an appropriate thickness may be provided as desired depending on the purpose, and further various layers such as filter layer, curl prevention layer, protective layer, antihalation layer, etc. may be used as suitably combined. These constituent layers can use similarly the hydrophilic colloid which can be used in the emulsion layer as described above and various additives for photography which can be contained in the emulsion layer as described above can be also contained in those layers.

In the method for processing of a light-sensitive silver halide color photographic material of the present invention, as the light-sensitive silver halide photographic material, any of light-sensitive materials to be processed by the so-called inner system developing system containing couplers in the light sensitive material may be applicable, including any of light-sensitive silver halide color-photographic materials such as color paper, color negative film, color positive film, color reversal film for slide, color reversal film for movie, color reversal film for TV, reversal color paper, etc.

As described above, according to the present invention, there can be provided a method for processing of a light-sensitive color photographic material excellent in stability with lapse of time of color developing solution such as preservability, etc., and excellent in processing stability with little fluctuation in photographic performances such as fogging at the dye image or hardening in tone at the shoulder portion, etc.

Further, according to the present invention, a method for processing of a light-sensitive silver halide color photographic material with little fluctuation in maximum density of cyan dye or magenta dye can be provided.

EXAMPLES

The present invention is described in more detail by referring to Examples, but the embodiments of the present invention are not limited thereto.

EXAMPLE 1

Color developing solutions No. 1 to No. 6 with the following compositions were prepared.

| (Color developing solution) | |
|---|---|
| Potassium bromide | 1.0 g |
| Potassium sulfite | 0.5 g |
| Preservative | (indicated in Table 1) |
| Chelating agent | |
| (Exemplary compound V-1) | 2.0 g |
| (Exemplary compound IV-2) | 0.6 g |
| Color developing agent | |
| (Exemplary compound A-1) | 6.80 g |
| Potassium carbonate | 30 g |

Made up to 1 liter by adding water, and adjusted to pH 10.15 with use of potassium hydroxide or sulfuric acid.

To each of the above color developing solutions, 4 ppm of a ferric ion and 2 ppm of a copper ion were added (added by dissolving $FeCl_3$ and $CuSO_4.6H_2O$, respectively), and the color developing solutions were analysed by the cerium sulfate method while storing at 33° C. in a glass container having an open top rate of 150 $cm^2/1$ (i.e., having an air-contacting area of 150 $cm^2$ per 1 liter of the color developing solution), and the days before the density of the color developing solution became 0 were determined as the life of the color developing solution. The results are shown together in Table 1.

TABLE 1

| Color developing solution No. | Preservative (g/liter) | Life of color developing solution (days) |
|---|---|---|
| 1 (Comparative) | Hydroxylamine sulfate (2.0) | 4 |
| 2 (This invention) | Exemplary compound No.(1) (5.0) | 20 |
| 3 (This invention) | Exemplary compound No.(2) (5.0) | 21 |
| 4 (This invention) | Exemplary compound No.(3) (5.0) | 20 |
| 5 (This invention) | Exemplary compound No.(4) (5.0) | 21 |
| 6 (This | Exemplary com- | 20 |

TABLE 1-continued

| Color developing solution | Preservative | Life of color developing solution (days) |
|---|---|---|
| No. | (g/liter) | |
| invention) | pound No.(5) (5.0) | |

As is apparent from the results in Table 1, in the color developing solution using hydroxylamine sulfate which is one of the preservatives in the prior art, the life of the color developing solution when mixed with metal ions is short. In contrast, in any of the color developing agents by use of the compound of the present invention, the life is elongated to a great extent.

EXAMPLE 2

On a paper support having polyethylene laminated thereon, the respective layers shown below were successively provided by coating from the support side to prepare samples of light-sensitive materials.

Layer 1: A layer containing 1.20 g/m$^2$ of gelatin, 0.40 g/m$^2$ (in terms of silver; ditto hereinafter) of a blue-sensitive silver halide emulsion (AgBr: AgCl=4:96) and $1.0\times10^{-3}$ mole/m$^2$ of the following yellow couler (Y-R) dissolved in 0.55 g/m$^2$ of dioctyl phthalate.

Layer 2: An intermediate layer comprising 0.70 g/m$^2$ of gelatin.

Layer 3: A layer containing 1.20 g/m$^2$ of gelatin, 0.22 g/m$^2$ of a green-sensitive silver halide emulsion (AgBr: AgCl=3:97) and $1.0\times10^{-3}$ mole/m$^2$ of the following magenta couler (M-R) dissolved in 0.30 g/m$^2$ of dioctyl phthalate.

Layer 4: An intermediate layer comprising 0.70 g/m$^2$ of gelatin.

Layer 5: A layer containing 1.20 g/m$^2$ of gelatin, 0.28 g/m$^2$ of a red-sensitive silver halide emulsion (AgBr: AgCl=4:96) and $1.75\times10^{-3}$ mole/m$^2$ of the exemplary cyan couler (C-76) dissolved in 0.25 g/m$^2$ of dibutyl phthalate.

Layer 6: A layer containing 1.0 g/m$^2$ of gelatin and 0.32 g/m$^2$ of Tinuvin 328 (an ultraviolet absorbent produced by Ciba-Geigy Corp.) dissolved in 0.25 g/m$^2$ of dioctyl phthalate.

Layer 7: A layer containing 0.48 g/m$^2$ of gelatin.

As a hardening agent, 2,4-dichloro-6-hydroxy-s-triazine sodium salt was added to Layers 2, 4 and 7 each so as to be in an amount of 0.017 g per 1 g of gelatin.

Y-R

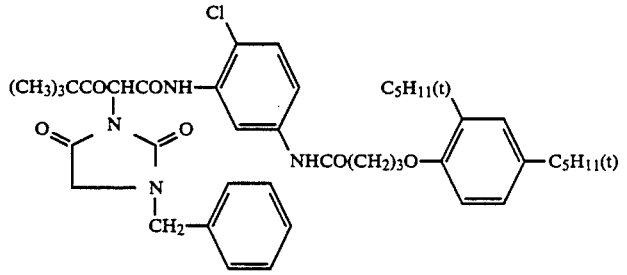

M-R

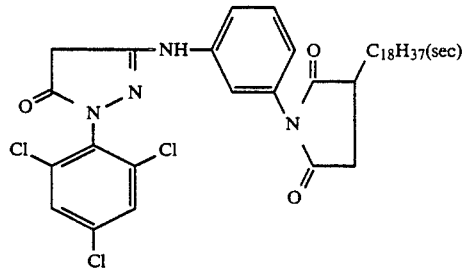

After carrying out wedgewise exposure on these samples according to the conventional method, the following developing processing was carried out.

| Processing step | Processing temperature | Processing time |
|---|---|---|
| [1] Color developing | 35° C. | 45 sec. |
| [2] Bleach-fixing | 35° C. | 45 sec. |
| [3] Washing | 30° C. | 90 sec. |
| [4] Drying | 60 to 80° C. | 60 sec. |

The color developing solutions used are those of No. 7 to No. 13 having the following compositions.

| (Color developing solution) | |
|---|---|
| Potassium bromide | 1.0 g |
| Potassium sulfite | 0.25 g |
| Preservative | (indicated in Table 2) |
| Chelating agent | |
| (Exemplary compound IV-2) | 0.5 g |
| (Exemplary compound V-2) | 2.0 g |
| Color developing agent | |
| (Exemplary compound A-1) | 5.6 g |
| Potassium carbonate | 30 g |

Made up to 1 liter by adding water, and adjusted to pH 10.15 with use of potassium hydroxide or sulfuric acid.

As the bleach-fixing solution, one having the following composition was employed.

| [Bleach-fixing solution] | |
|---|---|
| Ethylenediaminetetraacetic acid ferric ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Made up to 1 liter in total by adding water, and adjusted to pH 7.1 with use of potassium carbonate or glacial acetic acid.

The samples after processing were subjected to measurement of reflective density of cyan dye by use of Photoelectric Densitometer PDA-65 (produced by Konishiroku Photo Industry Co., Ltd.) to prepare a sentitometry curve simultaneously with measurement of the minimum reflective density. Next, the slope from the density point of the reflective density of 0.8 of cyan dye to the density point of the reflective density of 1.8 (gamma value) was calculated.

The same amount of the metal ion as in Example 1 was added into the color developing solution, which was then stored at 35° C. for one week. The same processing was repeated after storage, and the minimum density of magenta dye was measured, and cyan gamma value was calculated.

The difference in minimum reflective density of magenta dye before and after storage, and the difference in cyan gamma value were determined and listed in Table 2.

TABLE 2

| Experiment No. | Developing solution No. | Preservative (g/l) | Elevation of fog density of magenta | Elevation of gamma of cyan |
|---|---|---|---|---|
| 1 (Comparative) | 7 | Hydroxylamine sulfate (2.0) | +0.09 | +0.86 |
| 2 (This invention) | 8 | Exemplary No. (2) (4.5) | +0.03 | +0.19 |
| 3 (This invention | 9 | Exemplary No. (6) (4.5) | +0.03 | +0.21 |
| 4 (This invention) | 10 | Exemplary No. (7) (4.5) | +0.03 | +0.20 |
| 5 (This invention) | 11 | Exemplary No. (8) (4.5) | +0.03 | +0.21 |
| 6 (This invention) | 12 | Exemplary No. (3) (4.5) | +0.02 | +0.18 |
| 7 (This invention) | 13 | Exemplary No. (4) (4.5) | +0.02 | +0.18 |

As will be clear from the results shown in Table 2, in the material processed with the color developing solution using hydroxylamine sulfate which is one of the preservatives of the prior art, fog density of magenta and gamma of cyan after storage are markedly elevated. In contrast, it can be understood that those processed with the color developing solution by use of the compound of the present invention as the preservative are all good.

EXAMPLE 3

When the same experiment as Example 2 was repeated by use of the entirely the same color developing solution except for adding no chelating agent V-2 in the color developing solution No. 12 in Example 2, the magenta fog was further elevated by 0.02 and the gamma of the cyan was further increased by +0.2. Also, when the same experiment as Example 2 was repeated by preparing the color developing solutions No. 14 to No. 19 by varying the chelating agent in the developing solution No. 12 of Example 2 as shown in Table 3, substantially the same results as in Example 2 were obtained.

TABLE 3

| Color developing solution No. | 14 | 15 | 16 | 17 | 18 | 19 |
|---|---|---|---|---|---|---|
| Chelating agent | IV-2 0.6 g/l | IV-2 0.5 g/l | V-5 0.5 g/l | IV-2 0.6 g/l | IV-2 0.6 g/l | |
| | | | | II-1 2.0 g/l | II-2 2.0 g/l | VI-7 5.0 g/l |
| | II-2 2.0 g/l | II-5 2.0 g/l | II-1 2.0 g/l | Triethanolamine 11.0 g/l | III-7 5.0 g/l | II-1 2.0 g/l |

EXAMPLE 4

When the same experiment as Example 2 was conducted by adding each 2 g/liter of the exemplary compound (A'-2), (A'-4) and (A'-9) in the color developing solution No. 12 in Example 2, elevation of cyan gamma was further improved by 0.05.

EXAMPLE 5

The sample used in Example 2 and the sample in which the cyan coupler was replaced with the cyan coupler C-R shown below were processed according to the same processing steps as in Example 2.

The maximum density of cyan dye of the sample after processing was shown in Table 4. However, here, the preservative and its amount added in the color developing solution were made as shown in Table 4.

Cyan coupler (C - R)

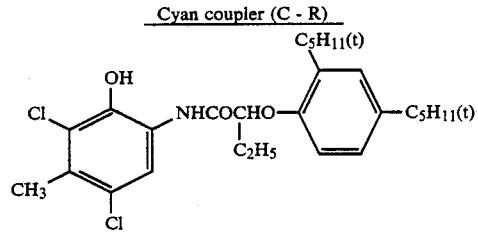

TABLE 4

| Experiment No. | Developing solution No. | Preservative | (g/l) | Maximum density of cyan dye: Sample No.* | Maximum density | Sample No.** | Maximum density |
|---|---|---|---|---|---|---|---|
| 8 (Comparative) | 20 (Comparative) | — | — | 1 | 2.60 | 18 | 2.59 |
| 9 (This | 21 (This | Exemplary | 2 | 2 | 2.58 | 19 | 2.53 |

TABLE 4-continued

| Experiment No. | Developing solution No. | Preservative | (g/l) | Maximum density of cyan dye: Sample No.* | Maximum density | Sample No.** | Maximum density |
|---|---|---|---|---|---|---|---|
| invention) | invention) | No. (1) | | | | | |
| 10 (This invention) | 22 (This invention) | | 4 | 3 | 2.52 | 20 | 2.41 |
| 11 (This invention) | 23 (This invention) | | 6 | 4 | 2.49 | 21 | 2.29 |
| 12 (This invention) | 24 (This invention) | | 8 | 5 | 2.43 | 22 | 2.21 |
| 13 (This invention) | 25 (This invention) | | 2 | 6 | 2.58 | 23 | 2.55 |
| 14 (This invention) | 26 (This invention) | Exemplary No. (2) | 4 | 7 | 2.55 | 24 | 2.45 |
| 15 (This invention) | 27 (This invention) | | 6 | 8 | 2.51 | 25 | 2.32 |
| 16 (This invention) | 18 (This invention) | | 8 | 9 | 2.46 | 26 | 2.23 |
| 17 (This invention) | 29 (This invention) | Exemplary No. (3) | 2 | 10 | 2.59 | 27 | 2.57 |
| 18 (This invention) | 30 (This invention) | | 4 | 11 | 2.57 | 28 | 2.48 |
| 19 (This invention) | 31 (This invention) | | 6 | 12 | 2.54 | 29 | 2.36 |
| 20 (This invention) | 32 (This invention) | | 8 | 13 | 2.50 | 30 | 2.31 |
| 21 (This invention) | 33 (This invention) | Exemplary No. (4) | 2 | 14 | 2.59 | 31 | 2.58 |
| 22 (This invention) | 34 (This invention) | | 4 | 15 | 2.57 | 32 | 2.49 |
| 23 (This invention) | 35 (This invention) | | 6 | 16 | 2.55 | 33 | 2.37 |
| 24 (This invention) | 36 (This invention) | | 8 | 17 | 2.51 | 34 | 2.33 |

*For samples No. 1–17, exemplary No. C-76 was used as the cyan coupler.
**For samples No. 18–34, the cyan coupler (c-R) was used as the cyan coupler.

As is apparent from Table 4, as contrasted to the fluctuation in maximum density of the cyan dye for the cyan coupler (C-R) relative to the change in amount of the compound of the present invention, it can be understood that the fluctuation in the maximum cyan dye density is extremely small in the case when employing the exemplary cyan coupler (C-76). Also, when the same experiment was conducted with samples employing exemplary cyan couplers (C-1), (C-3), (C-19), (C-58), etc., in place of the exemplary cyan coupler (C-76), good results with extremely small fluctuation in maximum density of cyan dye could be obtained.

EXAMPLE 6

In the same manner as in Example 2, except that the exemplary cyan coupler (C-76) in Layer 5 was replaced with the exemplary cyan coupler (C-8), the same measurements were carried out.

The difference in minimum reflective density of magenta dye before and after storage, and the difference in cyan gamma value were determined and listed in Table 5.

TABLE 5

| Experiment No. | Developing solution No. | Preservative (g/l) | Elevation of fog density of magenta | Elevation of gamma of cyan |
|---|---|---|---|---|
| 25 (Comparative) | 7 | Hydroxylamine sulfate (2.0) | +0.08 | +0.89 |
| 26 (This invention) | 8 | Exemplary No. (2) (4.5) | +0.03 | +0.19 |
| 27 (This invention) | 9 | Exemplary No. (6) (4.5) | +0.03 | +0.19 |
| 28 (This invention) | 10 | Exemplary No. (7) (4.5) | +0.03 | +0.20 |
| 29 (This invention) | 11 | Exemplary No. (8) (4.5) | +0.02 | +0.19 |

TABLE 5-continued

| Experiment No. | Developing solution No. | Preservative (g/l) | Elevation of fog density of magenta | Elevation of gamma of cyan |
|---|---|---|---|---|
| 30 (This invention) | 12 | Exemplary No. (3) (4.5) | +0.02 | +0.18 |
| 31 (This invention) | 13 | Exemplary No. (4) (4.5) | +0.02 | +0.17 |

As will be clear from the results shown in Table 5, in the material processed with the color developing solution using hydroxylamine sulfate which is one of the preservatives of the prior art, fog density of magenta and gamma of cyan after storage are markedly elevated. In contrast, it can be understood that those processed with the color developing solution by use of the compound of the present invention as the preservative are all good.

EXAMPLE 7

When the same experiment as Example 6 was repeated by use of the entirely the same color developing solution except for adding no chelating agent V-2 in the color developing solution No. 12 in Example 6, the magenta fog was further elevated by 0.02 and the gamma of the cyan was further increased by +0.2. Also, when the same experiment as Example 6 was repeated by using the color developing solutions No. 14 to No. 19 by varying the chelating agent in the developing solution No. 12 of Example 6, substantially the same results as in Example 6 were obtained.

EXAMPLE 8

When the same experiment as Example 6 was conducted by adding each 2 g/liter of the exemplary compound (A'-2), (A'-4) and (A'-9) in the color developing solution No. 12 in Example 6, elevation of cyan gamma was further improved by 0.05.

EXAMPLE 9

The sample used in Example 6 and the sample in which the cyan coupler was replaced with the cyan coupler C-R employed in Example 5 were processed according to the same processing steps as in Example 6.

The maximum density of cyan dye of the sample after processing was shown in Table 6. However, here, the preservative and its amount added in the color developing solution were made as shown in Table 6.

TABLE 6

| Experiment No. | Developing solution No. | Preservative (g/l) | Color developing agent A-1(g/l) | Maximum density of cyan dye: Sample No.* | Maximum density | Sample No.** | Maximum density |
|---|---|---|---|---|---|---|---|
| 32 | 37(This invention) | Exemplary | 2.5 | 35 | 2.54 | 51 | 2.12 |
| 33 | 38(This invention) | No. 1 | 3.5 | 36 | 2.55 | 52 | 2.27 |
| 34 | 39(This invention) | (3.0) | 5.5 | 37 | 2.56 | 53 | 2.51 |
| 35 | 40(This invention) | | 8.5 | 38 | 2.59 | 54 | 2.60 |
| 36 | 41(This invention) | Exemplary | 2.5 | 39 | 2.55 | 55 | 2.13 |
| 37 | 42(This invention) | No. 2 | 3.5 | 40 | 2.55 | 56 | 2.29 |
| 38 | 43(This invention) | (3.0) | 5.5 | 41 | 2.56 | 57 | 2.52 |
| 39 | 44(This invention) | | 8.5 | 42 | 2.58 | 58 | 2.59 |
| 40 | 45(This invention) | Exemplary | 2.5 | 43 | 2.54 | 59 | 2.15 |
| 41 | 46(This invention) | No. 3 | 3.5 | 44 | 2.54 | 60 | 2.31 |
| 42 | 47(This invention) | (3.0) | 5.5 | 45 | 2.55 | 61 | 2.51 |
| 43 | 48(This invention) | | 8.5 | 46 | 2.58 | 62 | 2.58 |
| 44 | 49(This invention) | Exemplary | 2.5 | 47 | 2.55 | 63 | 2.13 |
| 45 | 50(This invention) | No. 4 | 3.5 | 48 | 2.56 | 64 | 2.32 |
| 46 | 51(This invention) | (3.0) | 5.5 | 49 | 2.57 | 65 | 2.50 |
| 47 | 52(This invention) | | 8.5 | 50 | 2.60 | 66 | 2.59 |

*For samples No. 35 to 50, exemplary No. C-8 was used as the cyan coupler.
**For samples No. 51 to 66, the comparative cyan coupler CR was used as the cyan coupler.

As is apparent from Table 6, when using a coupler other than the present invention and a preservative according to the present invention, while lowering in maximum density of the cyan dye becomes large along with lowering of the concentration of the color developing agent in the color developing solution. When using a coupler of the present invention, if a preservative of the present invention has been employed, it can be understood that the fluctuation in the maximum cyan dye density is extremely small in the case when the concentration of the color developing agent in the color developing solution has lowered. Also, when the same experiment was conducted with samples employing exemplary cyan coupler (C-2) in place of the exemplary cyam coupler (C-8), good results with extremely small fluctuation in maximum density of cyan dye could be obtained.

EXAMPLE 10

In the same manner as in Example 2, except that the magenta coupler (M-R) in Layer 3 was replaced with the exemplary magenta coupler (18) and the exemplary cyan coupler (C-76) in Layer 5 was replaced with the cyan coupler (C-R) employed in Example 5, the same measurements were carried out.

The difference in minimum reflective density of magenta dye before and after storage, and the difference in cyan gamma value were determined and listed in Table 7.

TABLE 7

| Experiment No. | Developing solution No. | Preservative (g/l) | Elevation of fog density of magenta | Elevation of gamma of cyan |
|---|---|---|---|---|
| 48 (Comparative) | 7 | Hydroxylamine sulfate (2.0) | +0.08 | +0.94 |
| 49 (This invention) | 8 | Exemplary No. (2) (4.5) | +0.02 | +0.22 |
| 50 (This invention) | 9 | Exemplary No. (6) (4.5) | +0.03 | +0.21 |
| 51 (This invention) | 10 | Exemplary No. (7) (4.5) | +0.03 | +0.21 |
| 52 (This invention) | 11 | Exemplary No. (8) (4.5) | +0.03 | +0.22 |
| 53 (This invention) | 12 | Exemplary No. (3) (4.5) | +0.02 | +0.21 |
| 54 (This invention) | 13 | Exemplary No. (4) (4.5) | +0.02 | +0.20 |

As will be clear from the results shown in Table 7, in the material processed with the color developing solution using hydroxylamine sulfate which is one of the preservatives of the prior art, fog density of magenta and gamma of cyan after storage are markedly elevated. In contrast, it can be understood that those processed with the color developing solution by use of the compound of the present invention as the preservative are all good.

EXAMPLE 11

When the same experiment as Example 10 was repeated by use of the entirely the same color developing solution except for adding no chelating agent V-2 in the color developing solution No. 12 in Example 10, the magenta fog was further elevated by 0.02 and the gamma of the cyan was further increased by +0.2. Also, when the same experiment as Example 10 was repeated by using the color developing solutions No. 14 to No. 19 by varying the chelating agent in the developing solution No. 12 of Example 10, substantially the same results as in Example 10 were obtained.

EXAMPLE 12

When the same experiment as Example 10 was conducted by adding each 2 g/liter of the exemplary compound (A'-2), (A'-4) and (A'-9) in the color developing solution No. 12 in Example 10, elevation of cyan gamma was further improved by 0.05.

EXAMPLE 13

The sample used in Example 10 and the sample in which the cyan coupler was replaced with the magenta coupler M-R employed in Example 2 were processed according to the same processing steps as in Example 10.

The maximum density of cyan dye of the sample after processing was shown in Table 8. However, here, the preservative and its amount added in the color developing solution were made as shown in Table 10.

TABLE 8

| Experiment No. | Developing solution No. | Preservative | (g/l) | Maximum density of magenta dye: Sample No.* | Maximum density | Sample No.** | Maximum density |
|---|---|---|---|---|---|---|---|
| 55 | 53(Comparative) | — | — | 67 | 2.80 | 84 | 2.82 |
| 56 | 54(This invention) | Exemplary | 2 | 68 | 2.78 | 85 | 2.77 |
| 57 | 55(This invention) | No. (1) | 4 | 69 | 2.76 | 86 | 2.69 |
| 58 | 56(This invention) | | 6 | 70 | 2.74 | 87 | 2.63 |
| 59 | 57(This invention) | | 8 | 71 | 2.71 | 88 | 2.55 |
| 60 | 58(This invention) | Exemplary | 2 | 72 | 2.79 | 89 | 2.78 |
| 61 | 59(This invention) | No. (2) | 4 | 73 | 2.77 | 90 | 2.72 |
| 62 | 60(This invention) | | 6 | 74 | 2.75 | 91 | 2.65 |
| 63 | 61(This invention) | | 8 | 75 | 2.73 | 92 | 2.57 |
| 64 | 62(This invention) | Exemplary | 2 | 76 | 2.80 | 93 | 2.78 |
| 65 | 63(This invention) | No. (3) | 4 | 77 | 2.78 | 94 | 2.72 |
| 66 | 64(This invention) | | 6 | 78 | 2.77 | 95 | 2.66 |
| 67 | 65(This invention) | | 8 | 79 | 2.76 | 96 | 2.61 |
| 68 | 66(This invention) | Exemplary | 2 | 80 | 2.80 | 97 | 2.79 |
| 69 | 67(This invention) | No. (4) | 4 | 81 | 2.79 | 98 | 2.72 |
| 70 | 68(This invention) | | 6 | 82 | 2.78 | 99 | 2.66 |
| 71 | 69(This invention) | | 8 | 83 | 2.77 | 100 | 2.63 |

*For samples No. 67 to 83, exemplary No. 18 was used as the magenta coupler.
**For samples No. 84 to 100, comparative magenta coupler (M-R) was used as the magenta coupler.

As is apparent from Table 8, as contrasted to the fluctuation in maximum density of the magenta dye for the magenta coupler (M-R) relative to the change in amount of the compound of the present invention, it can be understood that the fluctuation in the maximum magenta dye density is extremely small in the case when employing the exemplary magenta coupler (C-76). Also, when the same experiment was conducted with samples employing exemplary magenta couplers (5), (44), (59), (104), etc., in place of the exemplary magenta coupler (18), good results with extremely small fluctuation in maximum density of magenta dye could be obtained.

We claim:

1. A processing solution of a light-sensitive silver halide color photographic material comprising a compound represented by formula I and a p-phenylenediamine-type compound having a water-soluble group:

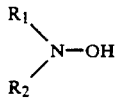

I wherein $R_1$ represents an alkyl group having 1 to 5 carbon atoms substituted with an alkoxy group, and $R_2$ represents a hydrogen atom, an alkyl group having 1 to 5 carbon atoms or an alkyl group having 1 to 5 carbon atoms substituted with an alkoxy group, and $R_1$ and $R_2$ may be bonded with each other to form a ring containing an oxygen atom.

2. The processing solution according to claim 1, wherein said solution further comprises at least one compound selected from the group consisting of the compounds represented by formulae II and III:

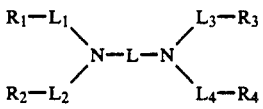

II

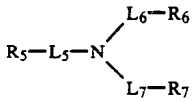

III wherein L represents an alkylene group, a cycloalkylene group, a phenylene group, -$L_8$-O-$L_8$-O-$L_8$- or -$L_9$-Z-$L_9$-; Z represents

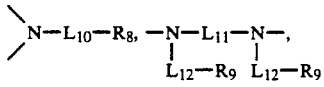

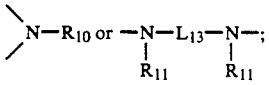

$L_1$ to $L_{13}$ each represent an alkylene group; $R_1$ to $R_{11}$ each represent a hydrogen atom, a hydroxyl group, a carboxylic acid group including its salt, or a phosphonic acid group including its salt, provided that at least two of $R_1$ to $R_4$ are the carboxylic acid group including its salt or the phosphonic acid group including its salt, and at least two of $R_5$ to $R_7$ are the carboxylic acid group including its salt or the phosphonic acid group including its salt.

3. The processing solution according to claim 1, wherein said solution further comprises at least one compound selected from the group consisting of the compounds represented by formulae IV, V, VI and VII:

IV

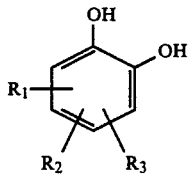

V

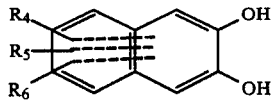

wherein $R_1$, $R_2$, $R_3$, $R_4$, $R_5$ and $R_6$ each represent a hydrogen atom, a halogen atom, a sulfonic acid group, an alkyl group having 1 to 7 carbon atoms, $—OR_7$, $—COOR_8$,

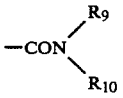

or a phenyl group; and $R_7$, $R_8$, $R_9$ and $R_{10}$ each represent a hydrogen atom or an alkyl group having 1 to 18 carbon atoms, provided that when $R_1$ and $R_2$ represent —OH or a hydrogen atom, $R_3$ represents a hydrogen atom, a sulfonic acid group, an alkyl group having 1 to 7 carbon atoms, $—OR_7$, $—COOR_8$,

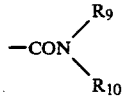

or a phenyl group;

VI

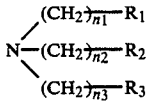

wherein $R_1$, $R_2$ and $R_3$ each represent a hydrogen atom, a hydroxy group, a carboxylic acid group including its salt or a phosphoric acid group including its salt, provided that at least one of $R_1$, $R_2$ and $R_3$ is a hydroxyl group, and only either one of $R_1$, $R_2$ and $R_3$ is a carboxylic acid group including its salt or a phosphoric acid group including its salt; and $n_1$, $n_2$ and $n_3$ each represent an integer of 1 to 3; and

VII

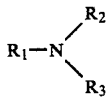

wherein $R_1$ is a hydroxyalkyl group having 2 to 6 carbon atoms; $R_2$ and $R_3$ each represent a hydrogen atom, an alkyl group having 1 to 6 carbon atoms, a hydroxyalkyl group having 2 to 6 carbon atoms, a benzyl group or a group of the formula:

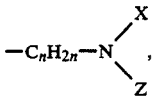

where n represents an integer of 1 to 6; and X and Z each represents a hydrogen atom, an alkyl group having 1 to 6 carbon atoms or a hydroxyalkyl group having 2 to 6 carbon atoms.

4. The processing solution according to claim 1, wherein said solution further comprises at least one compound represented by formula VIII:

VIII

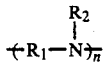

wherein $R_1$ represents an alkylene group having 2 to 6 carbon atoms; $R_2$ represents an alkyl group; and n represents an integer of 500 to 20,000.

5. The processing solution according to claim 1, wherein said solution further comprises at least one compound represented by formula IX:

IX

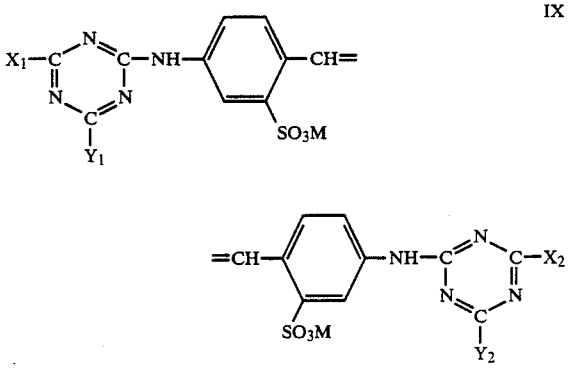

wherein $X_1$, $X_2$, $Y_1$ and $Y_2$ each represent a hydroxy group, a halogen atom, a morpholino group, an alkoxy group, an aryloxy group, an alkyl group, an aryl group, an amino group, an alkylamino group, an arylamino group; and M represents a hydrogen atom, sodium, potassium, ammonium or lithium.

6. The processing solution according to claim 1, wherein said water-soluble group is:

$—(CH_2)_n—CH_2OH$;
$—(CH_2)_m—NHSO_2—(CH_2)_n—CH_3$;
$—(CH_2)_mO—(CH_2)_n—CH_3$;
$—(CH_2CH_2O)_nC_mH_{2m+1}$;
—COOH; or
$—SO_3H$ wherein m and n each represent an integer of 0 or more.

7. The processing solution according to claim 1, wherein said p-phenylenediamine-type compound is selected from the group of compounds consisting of those represented by formulas A-1 to A-16 or salts thereof:

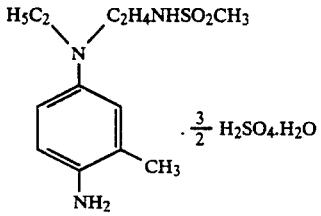
(A-1)
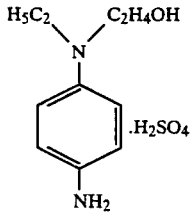
(A-2)
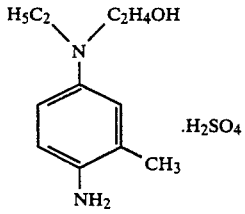
(A-3)
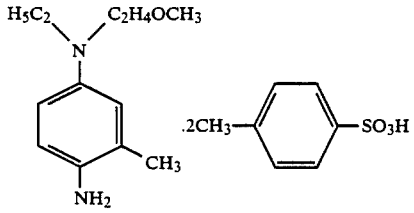
(A-4)
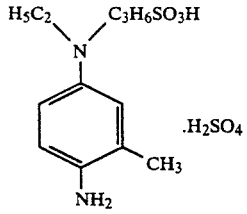
(A-5)
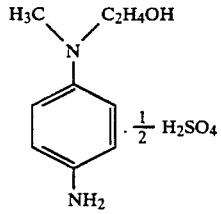
(A-6)
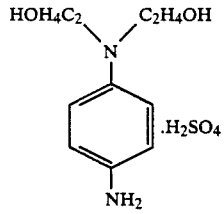
(A-7)
-continued
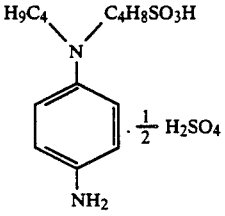
(A-8)
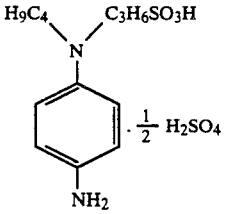
(A-9)
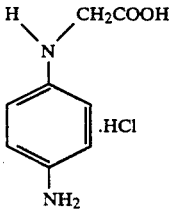
(A-10)
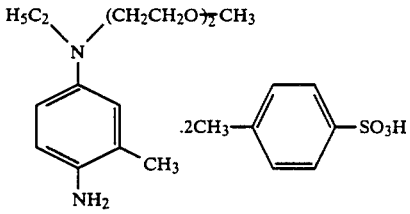
(A-11)
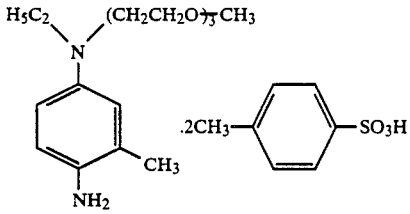
(A-12)
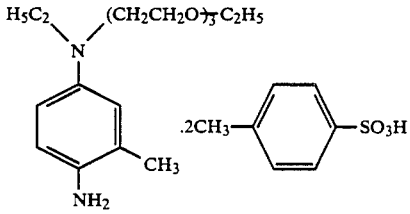
(A-13)
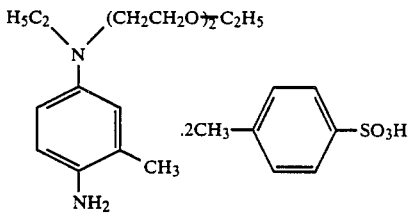
(A-14)

-continued

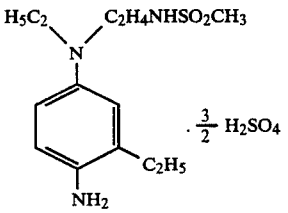

(A-15)

-continued

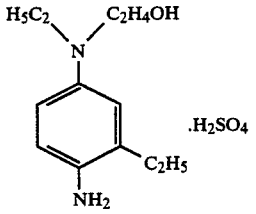

(A-16)

8. The processing solution according to claim 7, wherein said p-phenylenediamine-type compound is selected from the group of compounds consisting of those represented by formulas A-1, A-2, A-3, A-4, A-6, A-7 and A-15 or salts thereof.

9. The processing solution according to claim 7, wherein said p-phenylenediamine-type compound is selected from the group of compounds consisting of those represented by formula A-1 or a salt thereof.

10. The processing solution according to claim 1, wherein said p-phenylenediamine-type compound is present in amounts ranging from $1\times10^{-2}$ to $2\times10^{-1}$ mole per liter of said processing solution.

11. The processing solution according to claim 10, wherein said p-phenylenediamine-type compound is present in amounts ranging from $1.5\times10^{-2}$ to $2\times10^{-1}$ mole per liter of said processing solution.

* * * * *